US009746159B1

(12) United States Patent
Fletcher et al.

(10) Patent No.: US 9,746,159 B1
(45) Date of Patent: Aug. 29, 2017

(54) LIGHTING SYSTEM HAVING A SEALING SYSTEM

(71) Applicant: EcoSense Lighting Inc., Los Angeles, CA (US)

(72) Inventors: Robert Fletcher, Pasadena, CA (US); Edward R Adams, Englewood, TN (US); Paul Pickard, Acton, CA (US); Raghuram L. V. Petluri, Cerritos, CA (US)

(73) Assignee: ECOSENSE LIGHTING INC., Los Angeles, CA (US)

( * ) Notice: Subject to any disclaimer, the term of this patent is extended or adjusted under 35 U.S.C. 154(b) by 282 days.

(21) Appl. No.: 14/702,765

(22) Filed: May 4, 2015

Related U.S. Application Data

(63) Continuation-in-part of application No. 14/636,205, filed on Mar. 3, 2015, now Pat. No. 9,651,227, and a
(Continued)

(51) Int. Cl.
*F21V 7/00* (2006.01)
*F21V 15/01* (2006.01)
(Continued)

(52) U.S. Cl.
CPC ..... *F21V 15/01* (2013.01); *F21V 3/00* (2013.01); *F21V 5/048* (2013.01); *F21V 7/04* (2013.01); *F21V 31/005* (2013.01)

(58) Field of Classification Search
None
See application file for complete search history.

(56) References Cited

U.S. PATENT DOCUMENTS 2,430,472 A 11/1947 Levy
D149,124 S 3/1948 Hewitt
(Continued)

FOREIGN PATENT DOCUMENTS

CA 2623604 A1 8/2009
CN 1536686 A 10/2004
(Continued)

OTHER PUBLICATIONS

PCT/US2007/023110, Journee Lighting Inc., International Preliminary Report on Patentability dated Sep. 8, 2009.
(Continued)

*Primary Examiner* — Britt D Hanley
(74) *Attorney, Agent, or Firm* — Jay M. Brown

(57) ABSTRACT

Lighting system including housing having base plate, and housing wall projecting in upward direction. Container with LED in housing having visible light-transmissive top plate and container wall projecting in downward direction. Gasket is configured for forming seal between container wall and base plate to form sealed container. Rail interposed between interior side of housing wall and exterior side of container wall. Rail has first side facing towards interior side of housing wall and second side facing toward exterior side of container wall. First raised region forms part of interior side of housing wall or part of first side of rail. Second raised region forms part of exterior side of container wall or part of second side of rail. First raised region is configured for limiting movement of rail away from base plate along upward direction, and second raised region is configured for limiting such movement of container wall.

78 Claims, 26 Drawing Sheets

Related U.S. Application Data continuation-in-part of application No. 14/636,204, filed on Mar. 3, 2015, now Pat. No. 9,568,665.

(51) Int. Cl.

| | |
|---|---|
| ***F21V 5/04*** | (2006.01) |
| ***F21V 7/04*** | (2006.01) |
| ***F21V 31/00*** | (2006.01) |
| ***F21V 3/00*** | (2015.01) |

(56) References Cited

U.S. PATENT DOCUMENTS

| | | | |
|---|---|---|---|
| D152,113 | S | 12/1948 | Mehr |
| 2,458,967 | A | 1/1949 | Wiedenhoeft |
| 2,678,380 | A | 5/1954 | Westby |
| 2,702,378 | A | 2/1955 | Talty |
| D191,734 | S | 11/1961 | Daher |
| 3,040,170 | A | 6/1962 | Chwan |
| 3,078,366 | A | 2/1963 | Winkler |
| 3,120,929 | A | 2/1964 | Henning |
| 3,220,471 | A | 11/1965 | Coe |
| 3,247,368 | A | 4/1966 | McHugh |
| 3,435,891 | A | 4/1969 | Parrish |
| D214,582 | S | 7/1969 | Routh |
| D217,096 | S | 4/1970 | Birns |
| 3,538,321 | A | 11/1970 | Longenecker |
| 3,639,751 | A | 2/1972 | Pichel |
| 3,643,038 | A | 2/1972 | Sato |
| D231,559 | S | 4/1974 | Darling et al. |
| D234,712 | S | 4/1975 | Kennedy et al. |
| 3,989,976 | A | 11/1976 | Tabor |
| 4,090,210 | A | 5/1978 | Wehling et al. |
| 4,091,444 | A | 5/1978 | Mori |
| 4,138,716 | A | 2/1979 | Muhlethaler |
| D251,500 | S | 4/1979 | Aigner |
| 4,258,413 | A | 3/1981 | Mausser |
| 4,345,306 | A | 8/1982 | Summey |
| 4,414,489 | A | 11/1983 | Young |
| 4,420,207 | A | 12/1983 | Nishikawa |
| 4,423,471 | A | 12/1983 | Gordin et al. |
| 4,445,164 | A | 4/1984 | Giles, III |
| 4,453,203 | A | 6/1984 | Pate |
| 4,467,403 | A | 8/1984 | May |
| 4,473,873 | A | 9/1984 | Quiogue |
| 4,564,888 | A | 1/1986 | Lewin |
| 4,578,742 | A | 3/1986 | Klein |
| 4,580,859 | A | 4/1986 | Frano |
| 4,609,979 | A | 9/1986 | Kristofek |
| 4,674,015 | A | 6/1987 | Smith |
| 4,727,648 | A | 3/1988 | Savage |
| 4,733,335 | A | 3/1988 | Serizawa |
| D296,717 | S | 7/1988 | Kane et al. |
| 4,755,918 | A | 7/1988 | Pristash |
| 4,757,431 | A | 7/1988 | Cross |
| 4,761,721 | A | 8/1988 | Willing |
| D300,876 | S | 4/1989 | Sakai |
| 4,833,579 | A | 5/1989 | Skegin |
| 4,837,927 | A | 6/1989 | Savage |
| 4,870,327 | A | 9/1989 | Jorgensen |
| 4,872,097 | A | 10/1989 | Miller |
| 4,882,667 | A | 11/1989 | Skegin |
| 4,918,497 | A | 4/1990 | Edmond |
| D308,114 | S | 5/1990 | Shemitz |
| D308,260 | S | 5/1990 | Shemitz |
| 4,966,862 | A | 10/1990 | Edmond |
| D315,030 | S | 2/1991 | Jacobs et al. |
| D316,303 | S | 4/1991 | Layne |
| D316,306 | S | 4/1991 | Shemitz |
| 5,027,168 | A | 6/1991 | Edmond |
| D319,512 | S | 8/1991 | Lettenmayer |
| D322,862 | S | 12/1991 | Miller |
| 5,087,212 | A | 2/1992 | Hanami |
| D325,645 | S | 4/1992 | Grange |
| 5,140,507 | A | 8/1992 | Harwood |
| D330,944 | S | 11/1992 | Wereley |
| 5,174,649 | A | 12/1992 | Alston |
| 5,177,404 | A | 1/1993 | Cohen |
| 5,210,051 | A | 5/1993 | Carter, Jr. |
| D336,536 | S | 6/1993 | Shaanan et al. |
| 5,235,470 | A | 8/1993 | Cheng |
| D340,514 | S | 10/1993 | Liao |
| 5,253,152 | A | 10/1993 | Yang |
| 5,282,364 | A | 2/1994 | Cech |
| 5,303,124 | A | 4/1994 | Wrobel |
| 5,324,213 | A | 6/1994 | Frantz |
| 5,325,281 | A | 6/1994 | Harwood |
| D348,744 | S | 7/1994 | Johnson et al. |
| 5,335,159 | A | 8/1994 | Chen et al. |
| 5,337,225 | A | 8/1994 | Brookman |
| 5,338,944 | A | 8/1994 | Edmond et al. |
| 5,359,345 | A | 10/1994 | Hunter |
| 5,367,229 | A | 11/1994 | Yang |
| 5,381,323 | A | 1/1995 | Osteen et al. |
| 5,387,901 | A | 2/1995 | Hardt |
| 5,393,993 | A | 2/1995 | Edmond et al. |
| 5,410,462 | A | 4/1995 | Wolfe |
| 5,416,342 | A | 5/1995 | Edmond et al. |
| 5,436,809 | A | 7/1995 | Brassier |
| 5,440,466 | A | 8/1995 | Belisle |
| 5,450,303 | A | 9/1995 | Markiewicz et al. |
| 5,490,048 | A | 2/1996 | Brassier |
| 5,504,665 | A | 4/1996 | Osteen et al. |
| 5,515,253 | A | 5/1996 | Sjobom |
| 5,516,390 | A | 5/1996 | Tomita |
| 5,523,589 | A | 6/1996 | Edmond et al. |
| D373,437 | S | 9/1996 | Kira |
| 5,584,574 | A | 12/1996 | Haddad |
| 5,599,091 | A | 2/1997 | Kira |
| 5,604,135 | A | 2/1997 | Edmond et al. |
| 5,628,557 | A | 5/1997 | Huang |
| 5,631,190 | A | 5/1997 | Negley |
| 5,632,551 | A | 5/1997 | Roney |
| 5,634,822 | A | 6/1997 | Gunell |
| 5,655,832 | A | 8/1997 | Pelka |
| 5,658,066 | A | 8/1997 | Hirsch |
| D383,236 | S | 9/1997 | Krogman |
| D384,336 | S | 9/1997 | Gerber |
| 5,676,453 | A | 10/1997 | Parkyn, Jr. |
| D390,992 | S | 2/1998 | Shemitz |
| 5,713,662 | A | 2/1998 | Kira |
| 5,739,554 | A | 4/1998 | Edmond et al. |
| 5,757,144 | A | 5/1998 | Nilssen |
| 5,788,533 | A | 8/1998 | Alvarado-Rodriguez |
| 5,794,685 | A | 8/1998 | Dean |
| 5,800,050 | A | 9/1998 | Leadford |
| 5,806,955 | A | 9/1998 | Parkyn, Jr. |
| D408,823 | S | 4/1999 | Kirby |
| 5,890,793 | A | 4/1999 | Stephens |
| 5,894,196 | A | 4/1999 | McDermott |
| 5,898,267 | A | 4/1999 | McDermott |
| 5,909,955 | A | 6/1999 | Roorda |
| 5,912,477 | A | 6/1999 | Negley |
| 5,938,316 | A | 8/1999 | Yan |
| 6,022,130 | A | 2/2000 | Donato |
| 6,051,940 | A | 4/2000 | Arun |
| 6,072,160 | A | 6/2000 | Bahl |
| 6,079,851 | A | 6/2000 | Altman |
| 6,083,021 | A | 7/2000 | Lau |
| 6,104,536 | A | 8/2000 | Eckhardt |
| 6,120,600 | A | 9/2000 | Edmond et al. |
| 6,124,673 | A | 9/2000 | Bishop |
| 6,149,112 | A | 11/2000 | Thieltges |
| 6,149,288 | A | 11/2000 | Huang |
| 6,176,594 | B1 | 1/2001 | Yarconi |
| D437,449 | S | 2/2001 | Soller |
| D437,652 | S | 2/2001 | Uhler |
| 6,187,606 | B1 | 2/2001 | Edmond et al. |
| 6,198,233 | B1 | 3/2001 | McConaughy |
| 6,201,262 | B1 | 3/2001 | Edmond et al. |
| D443,710 | S | 6/2001 | Chiu |
| 6,244,877 | B1 | 6/2001 | Asao |
| 6,249,375 | B1 | 6/2001 | Silhengst |
| D445,936 | S | 7/2001 | Mier-Langner et al. |
| 6,260,981 | B1 | 7/2001 | Fiene |

(56) References Cited

U.S. PATENT DOCUMENTS

| | | | |
|---|---|---|---|
| D446,592 | S | 8/2001 | Leen |
| 6,273,588 | B1 | 8/2001 | Arakelian |
| D448,508 | S | 9/2001 | Benghozi |
| 6,312,787 | B1 | 11/2001 | Hayashi et al. |
| 6,318,883 | B1 | 11/2001 | Sugiyama |
| D452,843 | S | 1/2002 | Henrici |
| 6,341,523 | B2 | 1/2002 | Lynam |
| D457,673 | S | 5/2002 | Martinson |
| 6,386,723 | B1 | 5/2002 | Eberlein et al. |
| 6,390,646 | B1 | 5/2002 | Yan |
| 6,392,360 | B2 | 5/2002 | McConaughy |
| 6,426,704 | B1 | 7/2002 | Hutchison |
| 6,435,693 | B1 | 8/2002 | Fiene |
| 6,439,736 | B1 | 8/2002 | Fiene |
| 6,439,743 | B1 | 8/2002 | Hutchison |
| 6,439,749 | B1 | 8/2002 | Miller et al. |
| 6,441,943 | B1 | 8/2002 | Roberts |
| D462,801 | S | 9/2002 | Huang |
| 6,450,662 | B1 | 9/2002 | Hutchison |
| 6,450,664 | B1 | 9/2002 | Kelly |
| D464,455 | S | 10/2002 | Fong |
| D464,939 | S | 10/2002 | Chuang |
| D465,046 | S | 10/2002 | Layne |
| 6,473,002 | B1 | 10/2002 | Hutchison |
| 6,474,839 | B1 | 11/2002 | Hutchison |
| 6,478,453 | B2 | 11/2002 | Lammers |
| 6,488,386 | B1 | 12/2002 | Yan |
| 6,508,567 | B1 | 1/2003 | Fiene |
| D470,962 | S | 2/2003 | Chen |
| 6,525,939 | B2 | 2/2003 | Liang |
| D472,339 | S | 3/2003 | Russello et al. |
| 6,527,422 | B1 | 3/2003 | Hutchison |
| 6,530,674 | B2 | 3/2003 | Grierson et al. |
| D473,529 | S | 4/2003 | Feinbloom |
| 6,540,382 | B1 | 4/2003 | Simon |
| 6,561,690 | B2 | 5/2003 | Balestriero |
| D476,439 | S | 6/2003 | O'Rourke |
| 6,600,175 | B1 | 7/2003 | Baretz et al. |
| 6,601,970 | B2 | 8/2003 | Ueda |
| 6,618,231 | B2 | 9/2003 | McConaughy |
| 6,632,006 | B1 | 10/2003 | Rippel |
| 6,636,003 | B2 | 10/2003 | Rahm et al. |
| D482,476 | S | 11/2003 | Kwong |
| 6,641,284 | B2 | 11/2003 | Stopa et al. |
| 6,662,211 | B1 | 12/2003 | Weller |
| 6,682,211 | B2 | 1/2004 | English |
| 6,683,419 | B2 | 1/2004 | Kriparos |
| 6,691,768 | B2 | 2/2004 | Hsieh |
| 6,703,640 | B1 | 3/2004 | Hembree |
| 6,733,164 | B1 | 5/2004 | Smith, Jr. |
| D491,306 | S | 6/2004 | Zucker |
| 6,744,693 | B2 | 6/2004 | Brockmann |
| 6,752,645 | B2 | 6/2004 | Nakamura |
| 6,773,138 | B2 | 8/2004 | Coushaine |
| 6,787,999 | B2 | 9/2004 | Stimac |
| 6,788,510 | B2 | 9/2004 | McConaughy |
| 6,791,119 | B2 | 9/2004 | Slater, Jr. et al. |
| 6,814,462 | B1 | 11/2004 | Fiene |
| 6,824,296 | B2 | 11/2004 | Souza |
| 6,824,390 | B2 | 11/2004 | Brown |
| 6,827,469 | B2 | 12/2004 | Coushaine |
| 6,853,010 | B2 | 2/2005 | Slater, Jr. et al. |
| 6,860,617 | B2 | 3/2005 | Fiene |
| 6,863,424 | B2 | 3/2005 | Smith |
| 6,864,513 | B2 | 3/2005 | Lin |
| 6,869,206 | B2 | 3/2005 | Zimmerman |
| 6,871,993 | B2 | 3/2005 | Hecht |
| D504,967 | S | 5/2005 | Kung |
| 6,893,144 | B2 | 5/2005 | Fan |
| D506,065 | S | 6/2005 | Sugino |
| 6,902,200 | B1 | 6/2005 | Beadle |
| 6,902,291 | B2 | 6/2005 | Rizkin |
| 6,903,380 | B2 | 6/2005 | Barnett |
| 6,905,232 | B2 | 6/2005 | Lin |
| 6,946,806 | B1 | 9/2005 | Choi |
| 6,958,497 | B2 | 10/2005 | Emerson et al. |
| 6,966,677 | B2 | 11/2005 | Galli |
| 6,979,097 | B2 | 12/2005 | Elam |
| D516,020 | S | 2/2006 | Wong |
| D516,229 | S | 2/2006 | Tang |
| 6,998,650 | B1 | 2/2006 | Wu |
| 7,040,774 | B2 | 5/2006 | Beeson et al. |
| 7,063,130 | B2 | 6/2006 | Huang |
| 7,063,440 | B2 | 6/2006 | Mohacsi |
| 7,066,617 | B2 | 6/2006 | Mandy |
| D524,975 | S | 7/2006 | Oas |
| 7,070,301 | B2 | 7/2006 | Magarill |
| 7,077,546 | B2 | 7/2006 | Yamauchi |
| D527,119 | S | 8/2006 | Maxik |
| D527,131 | S | 8/2006 | McCarthy, III |
| 7,093,958 | B2 | 8/2006 | Coushaine |
| 7,095,056 | B2 | 8/2006 | Vitta et al. |
| 7,097,332 | B2 | 8/2006 | Vamberi |
| 7,098,397 | B2 | 8/2006 | Lange |
| 7,111,963 | B2 | 9/2006 | Zhang |
| 7,111,971 | B2 | 9/2006 | Coushaine |
| 7,112,916 | B2 | 9/2006 | Goh |
| D530,683 | S | 10/2006 | Rivas |
| 7,131,749 | B2 | 11/2006 | Wimberly |
| 7,132,804 | B2 | 11/2006 | Lys |
| 7,138,667 | B2 | 11/2006 | Barnett |
| 7,149,089 | B2 | 12/2006 | Blasko |
| 7,150,553 | B2 | 12/2006 | English |
| D535,774 | S | 1/2007 | Weston et al. |
| 7,159,997 | B2 | 1/2007 | Reo |
| 7,160,004 | B2 | 1/2007 | Peck |
| 7,172,319 | B2 | 2/2007 | Holder et al. |
| D538,951 | S | 3/2007 | Maxik |
| D539,459 | S | 3/2007 | Benghozi |
| 7,198,386 | B2 | 4/2007 | Zampini |
| 7,207,696 | B1 | 4/2007 | Lin |
| D541,957 | S | 5/2007 | Wang |
| 7,210,957 | B2 | 5/2007 | Mrakovich et al. |
| 7,213,940 | B1 | 5/2007 | van de Ven et al. |
| 7,221,374 | B2 | 5/2007 | Dixon |
| D544,110 | S | 6/2007 | Hooker |
| D545,457 | S | 6/2007 | Chen |
| 7,234,950 | B1 | 6/2007 | Wickett |
| 7,237,930 | B2 | 7/2007 | Onishi et al. |
| D548,691 | S | 8/2007 | Krieger |
| 7,273,299 | B2 | 9/2007 | Parkyn et al. |
| D552,779 | S | 10/2007 | Starck |
| 7,282,840 | B2 | 10/2007 | Chih |
| 7,286,296 | B2 | 10/2007 | Chaves |
| 7,288,902 | B1 | 10/2007 | Melanson |
| 7,293,908 | B2 | 11/2007 | Beeson et al. |
| 7,303,301 | B2 | 12/2007 | Koren |
| D561,924 | S | 2/2008 | Yiu |
| D563,013 | S | 2/2008 | Levine |
| 7,329,907 | B2 | 2/2008 | Pang et al. |
| D564,119 | S | 3/2008 | Metlen |
| 7,344,279 | B2 | 3/2008 | Mueller |
| 7,344,296 | B2 | 3/2008 | Matsui |
| 7,357,534 | B2 | 4/2008 | Snyder |
| 7,358,657 | B2 | 4/2008 | Koelger |
| 7,358,679 | B2 | 4/2008 | Lys et al. |
| 7,360,925 | B2 | 4/2008 | Coushaine |
| D568,829 | S | 5/2008 | Yamashita |
| 7,369,386 | B2 | 5/2008 | Rasmussen |
| D570,505 | S | 6/2008 | Maxik |
| 7,381,942 | B2 | 6/2008 | Chin et al. |
| D574,095 | S | 7/2008 | Hill |
| 7,396,139 | B2 | 7/2008 | Savage |
| 7,396,146 | B2 | 7/2008 | Wang |
| 7,413,326 | B2 | 8/2008 | Tain |
| D576,545 | S | 9/2008 | Mandel |
| D576,964 | S | 9/2008 | Shaner |
| D577,453 | S | 9/2008 | Metlen |
| D577,836 | S | 9/2008 | Engebrigtsen |
| 7,422,347 | B2 | 9/2008 | Miyairi et al. |
| D579,421 | S | 10/2008 | Chu |
| D581,080 | S | 11/2008 | Mier-Langner |
| D581,554 | S | 11/2008 | To |
| D581,583 | S | 11/2008 | Peng |

(56) References Cited

U.S. PATENT DOCUMENTS 7,452,115 B2 11/2008 Alcelik
7,456,499 B2 11/2008 Loh et al.
D583,975 S 12/2008 Kushinskaya et al.
7,458,820 B2 12/2008 Ohta
7,467,888 B2 12/2008 Fiene
D585,588 S 1/2009 Alexander
D585,589 S 1/2009 Alexander
7,481,552 B2 1/2009 Mayfield, III et al.
D586,498 S 2/2009 Wu
D587,389 S 2/2009 Benensohn
7,494,248 B2 2/2009 Li
7,497,581 B2 3/2009 Beeson et al.
7,513,675 B2 4/2009 Mier-Langner
D591,894 S 5/2009 Flank
D592,799 S 5/2009 Scott
7,532,324 B2 5/2009 Liu et al.
7,537,464 B2 5/2009 Brandenburg
7,539,028 B2 5/2009 Baurle et al.
D593,512 S 6/2009 Lin
7,540,761 B2 6/2009 Weber
7,549,786 B2 6/2009 Higley
D597,246 S 7/2009 Meyer, IV
D597,247 S 7/2009 Meyer, IV
7,559,784 B2 7/2009 Hsiao
7,564,180 B2 7/2009 Brandes
D597,704 S 8/2009 Peng
D599,040 S 8/2009 Alexander
7,575,332 B2 8/2009 Cok
7,575,338 B1 8/2009 Verfuerth
7,580,192 B1 8/2009 Chu
D601,276 S 9/2009 Grajcar
7,591,572 B1 9/2009 Levine
7,594,738 B1 9/2009 Lin
D602,868 S 10/2009 Vogt
7,604,365 B2 10/2009 Chang
7,607,802 B2 10/2009 Kang
7,621,770 B1 11/2009 Finizio
7,626,345 B2 12/2009 Young
7,628,506 B2 12/2009 Verfuerth
7,637,635 B2 12/2009 Xiao
D608,043 S 1/2010 Ko
D610,543 S 2/2010 Coushaine
D610,723 S 2/2010 Grajcar
D610,729 S 2/2010 Kushinskaya et al.
7,665,862 B2 2/2010 Villard
7,674,018 B2 3/2010 Holder et al.
7,679,281 B2 3/2010 Kim et al.
7,686,481 B1 3/2010 Condon et al.
7,690,810 B2 4/2010 Saitoh et al.
7,703,951 B2 4/2010 Piepgras
7,722,227 B2 5/2010 Zhang
7,727,009 B2 6/2010 Goto
7,731,395 B2 6/2010 Parkyn et al.
7,731,396 B2 6/2010 Fay
7,736,029 B2 6/2010 Chen et al.
7,737,634 B2 6/2010 Leng et al.
7,740,380 B2 6/2010 Thrailkill
7,744,259 B2 6/2010 Walczak
7,744,266 B2 6/2010 Higley
7,748,870 B2 7/2010 Chang
7,759,881 B1 7/2010 Melanson
7,766,508 B2 8/2010 Villard et al.
7,766,518 B2 8/2010 Piepgras
7,784,966 B2 8/2010 Verfuerth
7,785,124 B2 8/2010 Lin
D625,870 S 10/2010 Feigenbaum
D626,094 S 10/2010 Alexander
7,806,562 B2 10/2010 Behr
7,810,951 B1 10/2010 Lee et al.
7,810,955 B2 10/2010 Stimac et al.
7,810,995 B2 10/2010 Fadler et al.
7,813,111 B2 10/2010 Anderson
7,819,549 B2 10/2010 Narendran et al.
D627,507 S 11/2010 Lai
D627,727 S 11/2010 Alexander
D628,156 S 11/2010 Alexander
7,828,576 B2 11/2010 Lin
7,837,348 B2 11/2010 Narendran et al.
7,841,753 B2 11/2010 Liu
D629,365 S 12/2010 Garcia de Vicuna
7,845,393 B2 12/2010 Kao
7,857,482 B2 12/2010 Reo
7,857,498 B2 12/2010 Smith
7,866,850 B2 1/2011 Alexander
7,874,700 B2 1/2011 Patrick
D633,244 S 2/2011 Kramer et al.
D633,248 S 2/2011 Alexander
7,889,421 B2 2/2011 Narendran
7,896,517 B2 3/2011 Mandy
7,901,108 B2 3/2011 Kabuki et al.
7,914,162 B1 3/2011 Huang
7,914,198 B2 3/2011 Mier-Langner
7,918,581 B2 4/2011 van de Ven
7,918,589 B2 4/2011 Mayfield, III et al.
7,922,364 B2 4/2011 Tessnow
7,923,907 B2 4/2011 Tessnow
7,942,559 B2 5/2011 Holder et al.
7,952,114 B2 5/2011 Gingrich, III
7,965,494 B1 6/2011 Morris
7,972,038 B2 7/2011 Albright
7,972,054 B2 7/2011 Alexander
7,976,194 B2 7/2011 Wilcox et al.
7,985,005 B2 7/2011 Alexander
7,988,336 B1 8/2011 Harbers
7,993,031 B2 8/2011 Grajcar
8,002,438 B2 8/2011 Ko
8,007,131 B2 8/2011 Liu
D645,007 S 9/2011 Alexander
D645,594 S 9/2011 Grawe
8,021,008 B2 9/2011 Ramer
8,029,157 B2 10/2011 Li et al.
8,033,680 B2 10/2011 Sharrah
8,052,310 B2 11/2011 Gingrinch, III
8,066,403 B2 11/2011 Sanfilippo et al.
D650,504 S 12/2011 Kim et al.
D650,935 S 12/2011 Beghelli
8,080,819 B2 12/2011 Mueller et al.
8,083,364 B2 12/2011 Allen
8,096,668 B2 1/2012 Abu-Ageel
8,100,560 B2 1/2012 Ahland, III
8,100,564 B2 1/2012 Ono
8,102,167 B2 1/2012 Irissou et al.
8,102,683 B2 1/2012 Gaknoki et al.
D654,607 S 2/2012 Kim et al.
8,118,450 B2 2/2012 Villard
8,118,454 B2 2/2012 Rains, Jr. et al.
8,123,376 B2 2/2012 van de Ven et al.
8,125,776 B2 2/2012 Alexander
D655,432 S 3/2012 Beghelli
D655,840 S 3/2012 Heaton et al.
D655,842 S 3/2012 Sabernig
8,129,669 B2 3/2012 Chen et al.
8,136,958 B2 3/2012 Verfuerth
8,138,690 B2 3/2012 Chemel et al.
8,142,047 B2 3/2012 Acampora et al.
8,143,803 B2 3/2012 Beij et al.
8,152,336 B2 4/2012 Alexander
8,154,864 B1 4/2012 Nearman
8,162,498 B2 4/2012 Ramer et al.
D659,871 S 5/2012 Lee et al.
D660,229 S 5/2012 Tseng
8,172,425 B2 5/2012 Wen
8,172,436 B2 5/2012 Coleman
8,177,395 B2 5/2012 Alexander
8,182,122 B2 5/2012 Chiu
8,191,613 B2 6/2012 Yuan
8,193,738 B2 6/2012 Chu et al.
8,201,965 B2 6/2012 Yamada
8,205,998 B2 6/2012 Ramer et al.
8,210,722 B2 7/2012 Holder et al.
8,212,469 B2 7/2012 Rains, Jr. et al.
8,215,798 B2 7/2012 Rains, Jr. et al.
8,232,745 B2 7/2012 Chemel et al.
D665,340 S 8/2012 Obata

(56) References Cited

U.S. PATENT DOCUMENTS

| | | | |
|---|---|---|---|
| 8,242,766 | B2 | 8/2012 | Gaknoki et al. |
| 8,292,482 | B2 | 10/2012 | Harbers |
| 8,297,788 | B2 | 10/2012 | Bishop |
| 8,297,792 | B1 | 10/2012 | Wang |
| 8,297,808 | B2 | 10/2012 | Yuan |
| 8,319,437 | B2 | 11/2012 | Carlin |
| 8,324,838 | B2 | 12/2012 | Shah et al. |
| 8,330,378 | B2 | 12/2012 | Maehara et al. |
| 8,337,043 | B2 | 12/2012 | Verfuerth |
| 8,344,602 | B2 | 1/2013 | Lai |
| 8,360,609 | B2 | 1/2013 | Lee et al. |
| 8,360,621 | B2 | 1/2013 | Avila et al. |
| 8,385,071 | B2 | 2/2013 | Lin |
| 8,403,541 | B1 | 3/2013 | Rashidi |
| 8,410,716 | B2 | 4/2013 | Yao et al. |
| 8,414,178 | B2 | 4/2013 | Alexander |
| 8,434,898 | B2 | 5/2013 | Sanfilippo et al. |
| 8,436,556 | B2 | 5/2013 | Eisele et al. |
| 8,454,193 | B2 | 6/2013 | Simon et al. |
| 8,459,841 | B2 | 6/2013 | Huang |
| 8,462,523 | B2 | 6/2013 | Gaknoki et al. |
| 8,465,178 | B2 | 6/2013 | Wilcox et al. |
| 8,469,542 | B2 | 6/2013 | Zampini, II et al. |
| 8,503,083 | B2 | 8/2013 | Seo |
| 8,529,102 | B2 | 9/2013 | Pickard et al. |
| 8,531,134 | B2 | 9/2013 | Chemel et al. |
| 8,536,802 | B2 | 9/2013 | Chemel et al. |
| 8,536,805 | B2 | 9/2013 | Shah et al. |
| 8,543,249 | B2 | 9/2013 | Chemel et al. |
| D690,859 | S | 10/2013 | Mollaghaffari |
| 8,545,045 | B2 | 10/2013 | Tress |
| 8,545,049 | B2 | 10/2013 | Davis |
| 8,547,034 | B2 | 10/2013 | Melanson et al. |
| 8,552,664 | B2 | 10/2013 | Chemel et al. |
| 8,556,469 | B2 | 10/2013 | Pickard |
| 8,558,518 | B2 | 10/2013 | Irissou et al. |
| 8,562,180 | B2 | 10/2013 | Alexander |
| 8,569,972 | B2 | 10/2013 | Melanson |
| 8,573,807 | B2 | 11/2013 | Borkar et al. |
| 8,573,816 | B2 | 11/2013 | Negley et al. |
| 8,575,858 | B2 | 11/2013 | Policy et al. |
| 8,579,467 | B1 | 11/2013 | Szeto |
| 8,581,504 | B2 | 11/2013 | Kost et al. |
| 8,581,521 | B2 | 11/2013 | Welten et al. |
| 8,585,245 | B2 | 11/2013 | Black |
| 8,587,211 | B2 | 11/2013 | Melanson |
| 8,593,074 | B2 | 11/2013 | Hatley et al. |
| 8,593,129 | B2 | 11/2013 | Gaknoki et al. |
| 8,593,814 | B2 | 11/2013 | Ji |
| D694,925 | S | 12/2013 | Fukasawa |
| 8,598,809 | B2 | 12/2013 | Negley et al. |
| 8,602,591 | B2 | 12/2013 | Lee |
| 8,610,364 | B2 | 12/2013 | Melanson et al. |
| 8,610,365 | B2 | 12/2013 | King et al. |
| 8,611,106 | B2 | 12/2013 | Fang |
| 8,616,724 | B2 | 12/2013 | Pickard |
| 8,624,505 | B2 | 1/2014 | Huang |
| D699,179 | S | 2/2014 | Alexander |
| 8,643,038 | B2 | 2/2014 | Collins |
| 8,646,944 | B2 | 2/2014 | Villard |
| 8,646,949 | B2 | 2/2014 | Brunt, Jr. et al. |
| 8,652,357 | B2 | 2/2014 | Ryu |
| 8,653,750 | B2 | 2/2014 | Deurenberg et al. |
| D700,728 | S | 3/2014 | Fukasawa |
| 8,684,556 | B2 | 4/2014 | Negley et al. |
| 8,684,569 | B2 | 4/2014 | Pickard et al. |
| 8,690,383 | B2 | 4/2014 | Zampini, II et al. |
| 8,698,421 | B2 | 4/2014 | Ludorf |
| D704,369 | S | 5/2014 | Lindsley et al. |
| 8,723,427 | B2 | 5/2014 | Collins et al. |
| 8,740,444 | B2 | 6/2014 | Reynolds et al. |
| 8,742,684 | B2 | 6/2014 | Melanson |
| 8,749,131 | B2 | 6/2014 | Rains, Jr. et al. |
| 8,749,173 | B1 | 6/2014 | Melanson et al. |
| 8,757,840 | B2 | 6/2014 | Pickard et al. |
| 8,760,073 | B2 | 6/2014 | Ko |
| 8,760,080 | B2 | 6/2014 | Yu |
| 8,764,225 | B2 | 7/2014 | Narendran et al. |
| 8,777,455 | B2 | 7/2014 | Pickard et al. |
| 8,783,913 | B2 | 7/2014 | Wilcox et al. |
| 8,783,938 | B2 | 7/2014 | Alexander |
| 8,786,201 | B2 | 7/2014 | Hamamoto et al. |
| 8,786,210 | B2 | 7/2014 | Delucia |
| 8,786,211 | B2 | 7/2014 | Gilliom |
| 8,786,212 | B2 | 7/2014 | Terazawa |
| 8,786,213 | B2 | 7/2014 | Yang et al. |
| 8,791,642 | B2 | 7/2014 | van de Ven |
| 8,794,792 | B1 | 8/2014 | Moghal |
| 8,796,948 | B2 | 8/2014 | Weaver |
| 8,810,227 | B2 | 8/2014 | Flaibani et al. |
| 8,814,385 | B2 | 8/2014 | Onaka et al. |
| 8,816,593 | B2 | 8/2014 | Lys et al. |
| 8,820,964 | B2 | 9/2014 | Gould |
| 8,836,226 | B2 | 9/2014 | Mercier et al. |
| 8,840,278 | B2 | 9/2014 | Pickard |
| 8,847,515 | B2 | 9/2014 | King et al. |
| 8,853,958 | B2 | 10/2014 | Athalye et al. |
| 8,858,028 | B2 | 10/2014 | Kim |
| 8,876,322 | B2 | 11/2014 | Alexander |
| 8,888,315 | B2 | 11/2014 | Edwards |
| 8,888,506 | B2 | 11/2014 | Nishimura |
| 8,901,838 | B2 | 12/2014 | Akiyama et al. |
| 8,944,647 | B2 | 2/2015 | Bueeler |
| D724,773 | S | 3/2015 | Ryu |
| 8,970,101 | B2 | 3/2015 | Sutardja |
| 9,010,967 | B2 | 4/2015 | Jensen |
| 9,052,100 | B2 | 6/2015 | Blackstone |
| 9,307,588 | B2 | 4/2016 | Li |
| 9,488,362 | B2 | 11/2016 | Wilcox et al. |
| 2001/0006463 | A1 | 7/2001 | Fischer |
| 2001/0053628 | A1 | 12/2001 | Hayakawa |
| 2002/0046826 | A1 | 4/2002 | Kao |
| 2002/0067613 | A1 | 6/2002 | Grove |
| 2002/0106925 | A1 | 8/2002 | Yamagishi |
| 2002/0117692 | A1 | 8/2002 | Lin |
| 2003/0058658 | A1 | 3/2003 | Lee |
| 2003/0072156 | A1 | 4/2003 | Pohlert |
| 2003/0128543 | A1 | 7/2003 | Rekow |
| 2003/0174517 | A1 | 9/2003 | Kiraly |
| 2003/0185005 | A1 | 10/2003 | Sommers |
| 2003/0209963 | A1 | 11/2003 | Altgilbers |
| 2004/0005800 | A1 | 1/2004 | Hou |
| 2004/0090781 | A1 | 5/2004 | Yeoh |
| 2004/0090784 | A1 | 5/2004 | Ward |
| 2004/0212991 | A1 | 10/2004 | Galli |
| 2004/0218372 | A1 | 11/2004 | Hamasaki |
| 2005/0032402 | A1 | 2/2005 | Takanashi |
| 2005/0047170 | A1 | 3/2005 | Hilburger |
| 2005/0083698 | A1 | 4/2005 | Zampini |
| 2005/0122713 | A1 | 6/2005 | Hutchins |
| 2005/0130336 | A1 | 6/2005 | Collins, III |
| 2005/0146884 | A1 | 7/2005 | Scheithauer |
| 2005/0174780 | A1 | 8/2005 | Park |
| 2005/0205878 | A1 | 9/2005 | Kan |
| 2005/0242362 | A1 | 11/2005 | Shimizu |
| 2005/0269060 | A1 | 12/2005 | Ku |
| 2005/0270775 | A1 | 12/2005 | Harbers |
| 2005/0286265 | A1 | 12/2005 | Zampini et al. |
| 2006/0001381 | A1 | 1/2006 | Robinson |
| 2006/0039156 | A1 | 2/2006 | Chen |
| 2006/0062019 | A1 | 3/2006 | Young |
| 2006/0076672 | A1 | 4/2006 | Petroski |
| 2006/0141851 | A1 | 6/2006 | Matsui |
| 2006/0146422 | A1 | 7/2006 | Koike |
| 2006/0146531 | A1 | 7/2006 | Reo et al. |
| 2006/0152140 | A1 | 7/2006 | Brandes |
| 2006/0221272 | A1 | 10/2006 | Negley et al. |
| 2006/0262544 | A1 | 11/2006 | Piepgras |
| 2006/0262545 | A1 | 11/2006 | Piepgras |
| 2007/0025103 | A1 | 2/2007 | Chan |
| 2007/0064428 | A1 | 3/2007 | Beauchamp |
| 2007/0096057 | A1 | 5/2007 | Hampden-Smith |
| 2007/0109795 | A1 | 5/2007 | Gabrius |
| 2007/0139923 | A1 | 6/2007 | Negley et al. |

(56) References Cited

U.S. PATENT DOCUMENTS

2007/0153521 A1 7/2007 Konuma
2007/0158668 A1 7/2007 Tarsa et al.
2007/0170447 A1 7/2007 Negley et al.
2007/0223218 A1* 9/2007 You ..... F21S 8/031 362/231
2007/0223219 A1 9/2007 Medendorp, Jr.
2007/0238327 A1 10/2007 Hsu
2007/0242461 A1 10/2007 Reisenauer
2007/0253201 A1 11/2007 Blincoe
2007/0253202 A1 11/2007 Wu
2007/0253209 A1 11/2007 Loh et al.
2007/0268698 A1 11/2007 Chen et al.
2007/0269915 A1 11/2007 Leong et al.
2007/0275576 A1 11/2007 Yang
2007/0285028 A1 12/2007 Tsinker et al.
2007/0295969 A1 12/2007 Chew et al.
2007/0297177 A1 12/2007 Wang
2008/0012036 A1 1/2008 Loh et al.
2008/0013316 A1 1/2008 Chiang
2008/0043470 A1 2/2008 Wimberly
2008/0076272 A1 3/2008 Hsu
2008/0080190 A1 4/2008 Walczak
2008/0084700 A1 4/2008 van de Ven
2008/0106907 A1 5/2008 Trott
2008/0112121 A1 5/2008 Cheng
2008/0117500 A1 5/2008 Narendran et al.
2008/0121921 A1 5/2008 Loh et al.
2008/0130275 A1 6/2008 Higley
2008/0142194 A1 6/2008 Zhou
2008/0157112 A1 7/2008 He
2008/0158881 A1 7/2008 Liu
2008/0158887 A1 7/2008 Zhu
2008/0165530 A1 7/2008 Hendrikus
2008/0173884 A1 7/2008 Chitnis et al.
2008/0179611 A1 7/2008 Chitnis et al.
2008/0192478 A1 8/2008 Chen
2008/0198112 A1 8/2008 Roberts
2008/0219002 A1 9/2008 Sommers et al.
2008/0219303 A1 9/2008 Chen et al.
2008/0224598 A1 9/2008 Baretz
2008/0224631 A1 9/2008 Melanson
2008/0274641 A1 11/2008 Weber
2008/0298058 A1* 12/2008 Kan ..... F21V 15/01 362/240
2008/0308825 A1 12/2008 Chakraborty et al.
2009/0021936 A1 1/2009 Stimac et al.
2009/0026913 A1 1/2009 Mrakovich
2009/0034283 A1 2/2009 Albright
2009/0046464 A1 2/2009 Liu
2009/0050907 A1 2/2009 Yuan et al.
2009/0050908 A1 2/2009 Yuan et al.
2009/0052158 A1 2/2009 Bierhuizen
2009/0080185 A1 3/2009 McMillan
2009/0086474 A1 4/2009 Chou
2009/0091935 A1 4/2009 Tsai
2009/0103299 A1 4/2009 Boyer et al.
2009/0129084 A1 5/2009 Tsao
2009/0141500 A1 6/2009 Peng
2009/0154166 A1 6/2009 Zhang
2009/0167203 A1 7/2009 Dahlman et al.
2009/0180276 A1 7/2009 Benitez
2009/0184616 A1 7/2009 van de Ven et al.
2009/0195168 A1 8/2009 Greenfeld
2009/0225551 A1 9/2009 Chang et al.
2009/0236997 A1 9/2009 Liu
2009/0294114 A1 12/2009 Yang
2009/0296388 A1 12/2009 Wu et al.
2009/0310354 A1 12/2009 Zampini, II et al.
2009/0317988 A1 12/2009 Lin
2010/0015821 A1 1/2010 Hsu
2010/0019697 A1 1/2010 Korsunsky
2010/0026158 A1 2/2010 Wu
2010/0027258 A1 2/2010 Maxik
2010/0060202 A1 3/2010 Melanson et al.
2010/0072505 A1 3/2010 Gingrich, III
2010/0073783 A1 3/2010 Sun
2010/0073884 A1 3/2010 Peloza
2010/0091487 A1 4/2010 Shin
2010/0091497 A1 4/2010 Chen
2010/0102696 A1 4/2010 Sun
2010/0110684 A1 5/2010 Abdelsamed et al.
2010/0110728 A1 5/2010 Dubrow et al.
2010/0128484 A1 5/2010 Peng
2010/0132918 A1 6/2010 Lin
2010/0141173 A1 6/2010 Negrete
2010/0142189 A1 6/2010 Hong
2010/0149818 A1 6/2010 Ruffin
2010/0157605 A1 6/2010 Chang
2010/0174345 A1 7/2010 Ashdown
2010/0195323 A1 8/2010 Schaefer et al.
2010/0230709 A1 9/2010 Kanno
2010/0238630 A1 9/2010 Xu
2010/0243219 A1 9/2010 Yang
2010/0246179 A1 9/2010 Long
2010/0246195 A1* 9/2010 Muller ..... F21S 8/00 362/375
2010/0260945 A1 10/2010 Kites
2010/0271825 A1 10/2010 Black
2010/0284181 A1 11/2010 O'Brien et al.
2010/0296289 A1 11/2010 Villard et al.
2010/0301360 A1 12/2010 Van De Ven
2010/0301774 A1 12/2010 Chemel et al.
2010/0308742 A1 12/2010 Melanson
2010/0319953 A1 12/2010 Yochum
2011/0013397 A1 1/2011 Catone et al.
2011/0043129 A1 2/2011 Koolen
2011/0044046 A1 2/2011 Abu-Ageel
2011/0049749 A1 3/2011 Bailey
2011/0050100 A1 3/2011 Bailey
2011/0050101 A1 3/2011 Bailey
2011/0050124 A1 3/2011 Bailey
2011/0051407 A1 3/2011 St. Ives et al.
2011/0051414 A1 3/2011 Bailey
2011/0090684 A1 4/2011 Logan et al.
2011/0097921 A1 4/2011 Hsu
2011/0103070 A1 5/2011 Zhang et al.
2011/0115381 A1 5/2011 Carlin
2011/0122643 A1 5/2011 Spork
2011/0134634 A1 6/2011 Gingrich, III
2011/0136374 A1 6/2011 Mostoller
2011/0140620 A1 6/2011 Lin et al.
2011/0157891 A1 6/2011 Davis
2011/0180841 A1 7/2011 Chang
2011/0193490 A1 8/2011 Kumar
2011/0210360 A1 9/2011 Negley
2011/0222270 A1 9/2011 Porciatti
2011/0222277 A1 9/2011 Negley
2011/0253358 A1 10/2011 Huang
2011/0255287 A1 10/2011 Li
2011/0273079 A1 11/2011 Pickard
2011/0279015 A1 11/2011 Negley
2011/0285308 A1 11/2011 Crystal
2011/0285314 A1 11/2011 Carney et al.
2011/0292483 A1 12/2011 Pakhchyan et al.
2011/0306219 A1 12/2011 Swanger
2011/0309773 A1 12/2011 Beers
2011/0316441 A1 12/2011 Huynh
2011/0316446 A1 12/2011 Kang et al.
2012/0002417 A1 1/2012 Li
2012/0014115 A1 1/2012 Park et al.
2012/0018754 A1 1/2012 Lowes
2012/0019127 A1 1/2012 Hirosaki
2012/0021623 A1 1/2012 Gorman
2012/0025729 A1 2/2012 Melanson et al.
2012/0038280 A1 2/2012 Zoorob et al.
2012/0038291 A1 2/2012 Hasnain
2012/0051048 A1 3/2012 Smit
2012/0051056 A1 3/2012 Derks
2012/0051068 A1 3/2012 Pelton
2012/0092860 A1 4/2012 Blackstone
2012/0106152 A1 5/2012 Zheng
2012/0112661 A1 5/2012 van de Ven
2012/0119658 A1 5/2012 McDaniel
2012/0140468 A1 6/2012 Chang

(56) References Cited

U.S. PATENT DOCUMENTS

2012/0140474 A1 6/2012 Jurik et al.
2012/0146519 A1 6/2012 Briggs
2012/0169242 A1 7/2012 Olson
2012/0175653 A1 7/2012 Weber
2012/0187830 A1 7/2012 Shum
2012/0223657 A1 9/2012 van de Ven
2012/0224177 A1 9/2012 Harbers et al.
2012/0236553 A1 9/2012 Cash
2012/0250309 A1 10/2012 Handsaker
2012/0268894 A1 10/2012 Alexander
2012/0286304 A1 11/2012 Letoquin
2012/0286319 A1 11/2012 Lee
2012/0287642 A1 11/2012 Zeng
2012/0292660 A1 11/2012 Kanno
2012/0307487 A1 12/2012 Eckel
2012/0307494 A1 12/2012 Zlotnikov et al.
2012/0313124 A1 12/2012 Clatterbuck
2013/0002167 A1 1/2013 Van de Ven
2013/0003370 A1 1/2013 Watanabe
2013/0003388 A1 1/2013 Jensen
2013/0026942 A1 1/2013 Ryan
2013/0042510 A1 2/2013 Nall et al.
2013/0049602 A1 2/2013 Raj
2013/0049603 A1 2/2013 Bradford
2013/0049627 A1 2/2013 Roberts
2013/0069100 A1* 3/2013 Ahmed ..... F21V 15/01 257/99
2013/0069561 A1 3/2013 Melanson et al.
2013/0070441 A1 3/2013 Moon
2013/0070442 A1 3/2013 Negley
2013/0082612 A1 4/2013 Kim
2013/0083510 A1 4/2013 Park
2013/0094225 A1 4/2013 Leichner
2013/0095673 A1 4/2013 Brandon
2013/0140490 A1 6/2013 Fujinaga
2013/0162140 A1 6/2013 Shamoto et al.
2013/0170220 A1 7/2013 Bueeler
2013/0170221 A1 7/2013 Isogai et al.
2013/0176728 A1 7/2013 Bizzotto et al.
2013/0193869 A1 8/2013 Hong et al.
2013/0221489 A1 8/2013 Cao et al.
2013/0229114 A1 9/2013 Eisele et al.
2013/0229804 A1 9/2013 Holder et al.
2013/0235555 A1 9/2013 Tanaka
2013/0235579 A1 9/2013 Smith
2013/0235580 A1 9/2013 Smith
2013/0241392 A1 9/2013 Pickard et al.
2013/0241440 A1 9/2013 Gaknoki et al.
2013/0249434 A1 9/2013 Medendorp
2013/0250573 A1 9/2013 Taskar et al.
2013/0250581 A1 9/2013 Tang et al.
2013/0258636 A1 10/2013 Rettke
2013/0265777 A1 10/2013 Zollers et al.
2013/0300303 A1 11/2013 Liu
2013/0301252 A1 11/2013 Hussell et al.
2013/0322072 A1 12/2013 Pu et al.
2014/0015419 A1 1/2014 Shah et al.
2014/0016318 A1 1/2014 Pokrajac
2014/0036510 A1 2/2014 Preston et al.
2014/0043813 A1 2/2014 Dube' et al.
2014/0048743 A1 2/2014 Le-Mercier
2014/0049241 A1 2/2014 Gaknoki et al.
2014/0049962 A1 2/2014 Holder et al.
2014/0055038 A1 2/2014 Cappitelli et al.
2014/0055054 A1 2/2014 Borkar et al.
2014/0062330 A1 3/2014 Neundorfer
2014/0063779 A1 3/2014 Bradford
2014/0071685 A1 3/2014 Black
2014/0071696 A1 3/2014 Park, II et al.
2014/0078715 A1 3/2014 Pickard et al.
2014/0078722 A1 3/2014 Caldwell et al.
2014/0078746 A1 3/2014 Caldwell et al.
2014/0103796 A1 4/2014 Jansen
2014/0126205 A1 5/2014 Davis
2014/0126224 A1 5/2014 Brunt, Jr. et al.
2014/0134880 A1 5/2014 Yeh
2014/0140052 A1 5/2014 Villard
2014/0159077 A1 6/2014 Kuenzler
2014/0159600 A1 6/2014 Sutardja
2014/0167601 A1 6/2014 Harry
2014/0167646 A1 6/2014 Zukauskas et al.
2014/0176016 A1 6/2014 Li
2014/0198531 A1 7/2014 Iwasaki
2014/0217433 A1 8/2014 Tudorica
2014/0217907 A1 8/2014 Harris
2014/0218909 A1 8/2014 Tetsuo et al.
2014/0225511 A1 8/2014 Pickard et al.
2014/0225532 A1 8/2014 Groeneveld
2014/0233193 A1 8/2014 Alexander
2014/0268631 A1 9/2014 Pickard
2014/0268724 A1 9/2014 Yanping
2014/0268737 A1 9/2014 Athalye et al.
2014/0286016 A1 9/2014 Montagne
2014/0286018 A1 9/2014 Zhang et al.
2014/0355302 A1 12/2014 Wilcox et al.
2014/0361701 A1 12/2014 Siessegger et al.
2014/0367633 A1 12/2014 Bibl
2015/0002034 A1 1/2015 van de Ven
2015/0029717 A1 1/2015 Shen et al.
2015/0036339 A1 2/2015 Ashdown et al.
2015/0043218 A1 2/2015 Hu
2015/0060922 A1 3/2015 Wilcox
2015/0109820 A1 4/2015 Wilcox et al.
2015/0146438 A1* 5/2015 Rauer-Hans ..... F21V 31/005 362/374
2015/0236225 A1 8/2015 David
2015/0295144 A1 10/2015 Weiler
2016/0174319 A1 6/2016 Li
2016/0215967 A1* 7/2016 Chad ..... F21V 23/06

FOREIGN PATENT DOCUMENTS

CN 201739849 A 2/2011
CN 202040752 A 11/2011
CN 102269351 A 12/2011
GB 2457016 A 8/2009
JP 61-070306 U 5/1986
JP 2003-092022 A 3/2003
JP 2004-179048 A 6/2004
JP 2004-265626 A 9/2004
JP 2005-017554 A 1/2005
JP 2005-071818 A 3/2005
JP 2005-235778 A 9/2005
JP 2005-267964 A 9/2005
JP 2006-236796 A 9/2006
JP 2006-253274 A 9/2006
JP 2006-310138 A 11/2006
JP D1307268 B 8/2007
JP D1307434 B 8/2007
JP 2007-273205 A 10/2007
JP 2007-273209 A 10/2007
JP 2011-508406 A 3/2011
JP 2011-204495 A 10/2011
JP 2011-204658 A 10/2011
KR 1020070039683 A 4/2007
KR 1020090013704 A 2/2009
KR 100974942 B1 8/2010
KR 1020120050280 A 5/2012
TW 2004-25542 A 11/2004
TW 290967 M 5/2006
TW 296481 M 8/2006
TW 1273858 B 2/2007
TW 1318461 B 12/2009
WO DM/057383 B 9/2001
WO 02/12788 A1 2/2002
WO 02/15281 A2 2/2002
WO 2004/071143 A1 8/2004
WO 2005/093862 A2 10/2005
WO 2006/066531 A1 6/2006
WO 2006066531 A1 6/2006
WO 2007/128070 A1 11/2007
WO 2008/108832 A1 9/2008
WO 2009/044330 A1 4/2009
WO 2009108799 A1 9/2009

(56) References Cited

FOREIGN PATENT DOCUMENTS

| | | | |
|---|---|---|---|
| WO | 2009/120555 | A1 | 10/2009 |
| WO | 2010/016002 | A1 | 2/2010 |
| WO | 2010059647 | A1 | 5/2010 |
| WO | 2011019945 | A1 | 2/2011 |
| WO | 2013059298 | A1 | 4/2013 |
| WO | 2013192014 | A2 | 12/2013 |
| WO | 2013192014 | A3 | 12/2013 |
| WO | 2014099681 | A2 | 6/2014 |
| WO | 2014099681 | A3 | 12/2014 |
| WO | 2015199853 | A1 | 12/2015 |

OTHER PUBLICATIONS

PCT/US2009/035321, Journee Lighting Inc., International Preliminary Report on Patentability dated Aug. 31, 2010.
PCT/US2009/064858, Journee Lighting Inc., International Preliminary Report on Patentability dated May 24, 2011.
PCT/US2010/045361, Journee Lighting Inc., International Preliminary Report on Patentability dated Feb. 14, 2012.
PCT/US2012/060588, Ecosense Lighting Inc., filed on Oct. 17, 2012.
PCT/US2012/060588, Ecosense Lighting Inc., International Search Report and Opinion dated Mar. 29, 2013.
PCT/US2012/060588, Ecosense Lighting Inc., International Preliminary Report on Patentability dated Apr. 22, 2014.
PCT/US2013/045708, Journee Lighting Inc., International Search Report and Opinion dated Nov. 27, 2013.
PCT/US2013/045708, Journee Lighting Inc., International Preliminary Report on Patentability dated May 12, 2015.
PCT/US2013/075172, Ecosense Lighting Inc., filed on Dec. 13, 2013.
PCT/US2013/075172, Ecosense Lighting Inc., International Search Report and Opinion dated Sep. 26, 2014.
PCT/US2013/075172, Ecosense Lighting Inc., International Preliminary Report on Patentability dated Jun. 23, 2015.
PCT/US2016/020521, Ecosense Lighting Inc., filed on Mar. 2, 2016.
PCT/US2016/020521, Ecosense Lighting Inc., International Search Report and Opinion dated May 3, 2016.
PCT/US2016/016972, Ecosense Lighting Inc., filed on Feb. 8, 2016.
PCT/US2016/016972, Ecosense Lighting Inc., International Search Report and Opinion dated Apr. 11, 2016.
PCT/US2016/030613, Ecosense Lighting Inc., filed on May 3, 2016.
PCT/US2016/020523, Ecosense Lighting Inc., filed on Mar. 2, 2016.
PCT/US2016/020523, Ecosense Lighting Inc., International Search Report and Opinion dated May 6, 2016.
PCT/US2016/015470, Ecosense Lighting Inc., filed on Jan. 28, 2016, Entitled "Zoned Optical Cup."
Petluri et al., U.S. Appl. No. 62/288,368, filed Jan. 28, 2016, entitled "Multizone Mixing Cup".
PCT/US2016/015473, Ecosense Lighting Inc., filed on Jan. 28, 2016, Entitled "Illuminating with a Multizone Mixing Cup".
PCT/US2016/015473, Ecosense Lighting Inc., International Search Report and Opinion dated Apr. 22, 2016.
Petluri et al., U.S. Appl. No. 15/170,806, filed Jun. 1, 2016, entitled "Illuminating with a Multizone Mixing Cup."
PCT/US2016/015318, Ecosense Lighting Inc., filed on Jan. 28, 2016, Entitled "Compositions for LED Light Conversions."
PCT/US2016/015318, Ecosense Lighting Inc., International Search Report and Opinion, dated Apr. 11, 2016.
PCT/US2016/015348, Ecosense Lighting Inc., filed on Jan. 28, 2016, Entitled "Systems for Providing Tunable White Light with High Color Rendering."
PCT/US2016/015348, Ecosense Lighting Inc., International Search Report and Opinion dated Apr. 11, 2016.
PCT/US2016/015368, Ecosense Lighting Inc., filed Jan. 28, 2016, Entitled "Systems for Providing Tunable White Light with High Color Rendering."
PCT/US2016/015368, Ecosense Lighting Inc., International Search Report and Opinion dated Apr. 19, 2016.
Petluri et al., U.S. Appl. No. 15/173,538, filed Jun. 3, 2016, entitled "System for Providing Tunable White Light with High Color Rendering."
Petluri et al., U.S. Appl. No. 15/173,554, filed Jun. 3, 2016, entitled "System for Providing Tunable White Light with High Color Rendering."
PCT/US2016/015385, Ecosense Lighting Inc., filed on Jan. 28, 2016, Entitled "Methods for Generating Tunable White Light with High Color Rendering."
PCT/US2016/015402, Ecosense Lighting Inc., filed on Jan. 28, 2016, Entitled "Methods for Generating Tunable White Light With High Color Rendering."
PCT/US2016/015435, Ecosense Lighting Inc., filed on Jan. 28, 2016, Entitled "Methods for Generating Melatonin-Response-Tuned White Light with High Color Rendering."
PCT/US2016/015437, Ecosense Lighting Inc., filed on Jan. 28, 2016, Entitled "Methods for Generating Melatonin-Response-Tuned White Light with High Color Rendering."
PCT/US2016/015441, Ecosense Lighting Inc., filed on Jan. 28, 2016, Entitled "Methods for Generating Melatonin-Response-Tuned White Light with High Color Rendering."
Petluri et al., U.S. Appl. No. 15/176,083, filed Jun. 7, 2016, entitled "Compositions for LED Light Conversions."
PCT/US2016/030613, Ecosense Lighting Inc., International Search Report and Opinion dated Aug. 5, 2016.
PCT/US2016/046245, Ecosense Lighting Inc., filed on Aug. 10, 2016.
PCT/US2016/015470, Ecosense Lighting Inc., International Search Report and Opinion dated Jul. 8, 2016.
PCT/US2016/015385, Ecosense Lighting Inc., International Search Report and Opinion dated Apr. 8, 2016.
PCT/US2016/015402, Ecosense Lighting Inc., International Search Report and Opinion dated Apr. 22, 2016.
PCT/US2016/015435, Ecosense Lighting Inc., International Search Report and Opinion dated Mar. 31, 2016.
PCT/US2016/015437, Ecosense Lighting Inc., International Search Report and Opinion dated Mar. 31, 2016.
PCT/US2016/015441, Ecosense Lighting Inc., International Search Report and Opinion dated Mar. 31, 2016.
Acuity Brands, "Acuity Brands Introduces Luminaire for Tunable White Technology," downloaded from http://news.acuitybrands.com/US/acuity-brands-introduces-luminaires-with-tunable-white-technology/s/54ae242f-1222-4b8b-be0d-36637bde8cd2 on May 28, 2014, 2pp.
Acuity Brands Lighting Inc. Product Catalog, downloaded from www.acuitybrands.com, dated Apr. 2013, 90pp.
Acuity Brands, "A Guided Tour of Area Light Sources—Past, Present and Future," downloaded from www.acuitybrands.com, version dated Jun. 20, 2013, 72pp.
Alanod GmbH, "WhiteOptics," downloaded from www.alanod.com, dated Apr. 2014, 12pp.
Altman Lighting, "Spectra Cube," downloaded from http://altmanstagelighting.com/altman-led-green-lighting/led-spectra-cube/Altman-Spectra-Cube-Data-Sheet-v3.pdf on May 28, 2014, 1p.
Bega Lighting, "In-ground luminaire RGBW IP 67 Product data sheet," downloaded from http://www.bega.com/download/datenblaetter/en/7926.pdf on May 28, 2014, 1p.
CORM 2011 Conference, Gaithersburg, MD, "Calculation of CCT and Duv and Practical Conversion Formulae," dated May 3-5, 2011, National Institute of Standards and Technology, 28pp.
Lumitronix, "Carclo lens for side emitting 360 degrees," downloaded from http://www.leds.de/en/High-Power-LEDs/Lenses-and-optics/Carclo-lens-for-side-emitting-360.html on May 28, 2014, 2pp.
"Introduction to Catmull-Rom Splines," downloaded on Aug. 7, 2015 from www.mvps.org/directx/articles/catmull/, 2pp.

(56) References Cited

OTHER PUBLICATIONS

Wikipedia, "CIE 1931 color space," version dated Apr. 23, 2014, downloaded from www.wikipedia.org, 12pp.
Osram Sylvania, "ColorCalculator User Guide", downloaded on Jun. 3, 2014 from www.sylvania.com, 44pp.
Osram Sylvania, "ColorCalculator User Guide", downloaded on Oct. 19, 2015 from www.sylvania.com, 50pp.
Kenneth Kelly, "Color Designations for Lights," U.S. Department of Commerce, National Bureau of Standards, Research Paper RP1565, Journal of Research of the National Bureau of Standards, vol. 31, Nov. 1943, pp. 271-278.
Philips Color Kinetics, "LED Cove Lighting," downloaded on May 28, 2014 from http://www.colorkinetics.com/ls/guides-brochures/pck-led-cove-lighting.pdf, 32pp.
Philips Color Kinetics, "IntelliWhite LED Lighting Systems," downloaded on May 28, 2014 from http://www.colorkinetic.com/ls/intelliwhite/, 2pp.
Philips Color Kinetics, "Color-Changing LED Lighting Systems," downloaded on May 27, 2014 from http://www.colorkinetics.com/ls/rgb/, 2pp.
Wikipedia, "Color temperature," version dated May 21, 2014, downloaded on Jun. 3, 2014 from www.wikipedia.org, 17pp.
Cree, "LED Color Mixing: Basics and Background," downloaded on Sep. 24, 2014 from www.cree.com, 24pp.
Cree, "Cree(r) LMH2 LED Modules," Product Family Data Sheet, downloaded on May 27, 2014 from http://www.cree.com/~/media/Files/Cree/LED%20Components%20and%20Modules/Modules/Data%20Sheets/LEDModules_LMH2.pdf, 18pp.
"Dialight ES Series RGB LED Luminaire," downloaded on May 28, 2014 from http://www.dialight.com/Assets/Brochures_And_Catalogs/Illumination/MDEXESTEMORGB_A.pdf , 2pp.
Naomi Miller, "Color Spaces and Planckian Loci: Understanding all those Crazy Color Metrics," U.S. Department of Energy, Pacific Northwest National Laboratory, Portland, Oregon, downloaded on May 30, 2014, 49pp.
Kahen, Keith, "High-Efficiency Colloidal Quantum Dot Phosphors," University at Buffalo, SUNY, DOE SSL R&D Workshop, Long Beach, California, Jan. 29-31, 2013, 12pp.
Bush, Steve, "Chip gives dim-to-warm LED lighting without MCU," dated Apr. 1, 2014, downloaded from http://www.electronicsweekly.com/news/components/led-lighting/chip-gives-dim-warm-led-lighting-without-mcu-2014-04/ , 6pp.
"Ecosense to reveal new TROV LED Linear Platform at 2015 Lightfair International in New York City," May 4, 2015, blog downloaded from www.ecosense.com, 3pp.
"Ecosense to reveal new TROV LED Linear Platform at 2015 Lightfair International in New York City," May 4, 2015, press release downloaded from www.ecosense.com, 2pp.
Freyssinier, Jean P. et al., "Class A Color Designation for Light Sources Used in General Illumination," J. Light & Vis. Env., vol. 37, Nos. 2-3, Nov. 7, 2013, pp. 10-14.
Freyssinier, Jean P. et al., "White Lighting: A Provisional Model for Predicting Perceived Tint in 'White' Illumination," Color Res. & App'n, vol. 39, No. 5, Oct. 2014, pp. 466-479.
Freyssinier, Jean P. et al., "The Class A Color Designation for Light Sources," Rensselaer Polytechnic Institute, 2013 DOE Solid-State Lighting R&D Workshop, Hilton Long Beach, California, Jan. 29-31, 2013, 26pp.
Freyssinier, Jean P. et al., "Class A Lighting," Rensselaer Polytechnic Institute, Strategies in Light 2012, 27 pp.
Freyssinier, Jean P. et al., "White Lighting," Color Res. & App'n, (volume unknown), Sep. 3, 2011, downloaded from http://www.lrc.rpi.edu/programs/solidstate/assist/pdf/SIL-2012_FreyssinierRea_WhiteLighting.pdf, 12pp.
Rea et al., "White lighting for residential applications," Lighting Res. Technol., Mar. 27, 2012, downloaded from www.sagepublications.com at http://lrt.sagepub.com/content/early/2012/03/27/1477153512442936, 15pp.
Oh, Jeong et al., "Full down-conversion of amber-emitting phosphor-converted light-emitting diodes with powder phosphors and a long-wave pass filter," Optics Express, vol. 18, No. 11, May 24, 2010, pp. 11063-11072.
"Microcellular Reflective Sheet MCPET," downloaded on Feb. 3, 2015 from www.furukawa.co.jp/foam/, 6pp.
"Aculux—Black Body Dimming and Tunable White Responsive Technologies," downloaded on May 28, 2014 from http://www.junolightinggroup.com/literature/LIT-AX-LED-BBD-TW.pdf , 28pp.
"Khatod—Symmetric & Asymmetric Strip Lens," downloaded on May 5, 2015 from www.khatod.com, 3pp.
"KKDC Catalog 2.0," downloaded on May 28, 2014 from http://www.kkdc.co.uk/media/kkdc-catalogue.pdf, 134pp.
"KKDC UK—Linear LED Lighting," downloaded from www.kkdc.co.uk/application/interior.php on Oct. 22, 2015, 5pp.
Overton, Gail, "LEDS: White LED comprises blue LED and inexpensive dye," LaserFocusWorld, Feb. 12, 2013, Downloaded from http://www.laserfocusworld.com/articles/print/volume-49/issue-02/world-news/leds--white-led-comprises-blue-led-and-inexpensive-dye.html, 5pp.
"LEDIL TIR Lens Guide," downloaded from www.ledil.com on Jan. 22, 2015, 8pp.
"LED Linear—linear lighting solutions, product overview," downloaded on May 28, 2014 from http://www.led-linear.com/en/product-overview/system-catalogue/, 3pp.
"LEDnovation—BR30 Warm Dimming," downloaded on May 28, 2014 from www.lednovation.com/products/BR30_LED.asp, 2pp.
Wikipedia, "Lenticular lens," downloaded on Feb. 18, 2015 from www.wikipedia.org, 5pp.
"Lenticular Sheets," downloaded on Feb. 24, 2015 from www.lenticular-sheets.lpceurope.eu/, 2pp.
Unzner, Norbert, "Light Analysis in lighting technology," B&S Electronische Geralte GmbH, 2001, 14pp.
"Lightolierr—Solid-State Lighting," downloaded on May 28, 2014 from http://www.lightolier.com/prospots/leds_solidstate.jsp, 1p.
Wikipedia, "Line of purples," downloaded on Oct. 20, 2015 from www.wikipedia.org, 2pp.
"Lumenbeam Catalog," downloaded on May 27, 2014 from 11_160_en_lumenpulse_lumenbeam_rgb_lbl_rgb_brochure.zip, 63pp.
"Lumenetix—Araya Technology," downloaded on May 28, 2014 from www.lumenetix.com/araya-technology, 3pp.
"Lumenpulse—Lumenbeam Large Color Changing,", downloaded on May 27, 2014 from www.lumenpulse.com/en/product/11/lumenbeam-large-color-changing, 4pp.
"Lumenpulse—Lumencove Family," downloaded on May 28, 2014 from http://www.lumenpulse.com/en/products#! 3/0/0/0/0/0, 2pp.
Knight, Colette, "XICATO—Investigations on the use of LED modules for optimized color appearance in retail applications," downloaded on May 28, 2014 from http://www.xicato.com/sites/default/tiles/documents/Summary_Investigations_on_the_use_of_LED_modules_for_optimized_color_appearance_in_retail_applications.pdf, 5pp.
"Zumtobel—IYON Tunable White,", downloaded on Oct. 19, 2015 from http://www.zumtobel.com/tunablewhite/en/index.html#topic_04, 1p.
"Zumtobel—IYON LED Spotlight Catalog," downloaded on Oct. 19, 2015 from http://www.zumtobel.com/PDB/Ressource/teaser/en/com/Iyon.pdf, 40pp.
"Lumenpulse—Lumenbeam Large Pendant Dynamic White," downloaded on May 28, 2014 from http://www.lumenpulse.com/en/product/72/lumenbeam-large-pendant-dynamic-white, 1p.
"Lumileds Application Brief AB08—Optical Testing for SuperFlux, SnapLED and Luxeon Emitters," downloaded on Sep. 24, 2014 from www.lumileds.com, 15pp.
"CandlePowerForums—SOLD: Luxeon III side-emitter white LED," downloaded on May 28, 2014 from http://www.candlepowerforums.com/vb/showthread.php?140276-SOLD-Luxeon-III-side-emitter-white-LED, 4pp.
"Lumileds LUXEON Z,", downloaded on May 2, 2015 from www.lumileds.com, 2pp.

(56) References Cited

OTHER PUBLICATIONS

"Alanod MIRO Catalog," downloaded on Jan. 30, 2015 from www.alanod.com, 8pp.
"Nanoco Group—Cadmium Free Quantum Dots," downloaded on May 30, 2014 from www.nanocotechnologies.com/what-we-do/products/cadmium-free-quantum-dots, 3pp.
"Nanosys—Quantum Dots," downloaded on May 30, 2014 from www.nanosysinc.com/what-we-do/quantum-dots/, 3pp.
"Ocean NanoTech—Products," downloaded on May 30, 2014 from www.oceannanotech.com/Products.php, 1p.
"NNCrystal—blog post—May 17, 2010," downloaded from http://led-lights-led.blogspot.com/2010/05/nncrystal-us-corporation-to-supply.html, 4pp.
"A Warmer, Cozier White Light: NXP Transforms LED Color Quality," dated Jan. 9, 2013, downloaded from http://www.nxp.com/news/press-releases/2013/01/a-warmer-cozier-white-light-nxp-transforms-led-color-quality.html, 2pp.
"Lighting Global Technical Notes, Optical Control Techniques for Off-grid Lighting Products," Jul. 2011 and May 2012, 6pp.
"Pacific Light Technologies—Quantum Dots in Solid State Lighting," downloaded on Oct. 23, 2015 from www.pacificlighttech.com/quantum-dots-in-ssl/, 2pp.
"Philips Lighting—Dim Tone,", downloaded on May 27, 2014 from www.usa.lighting.philips.com/lightcommunity/trends/led/dimtone/, 1p.
"Philips—Dimmable to warm light for the perfect ambience," downloaded on May 27, 2014 from www.usa.lighting.philips.com, 2pp.
"Philips—Turn up Ambience and Tone Down Energy Use with Philips BR30 DimTone," downloaded on May 27, 2014 from www.usa.lighting.philips.com, 11pp.
Wikipedia, "Planckian locus," downloaded on May 30, 2014 from www.wikipedia.org, 5pp.
Wikipedia, "Quantum dot,", downloaded on May 30, 2014 from http://en.wikipedia.org/wiki/Quantum_dot, 15pp.
"Phosphortech—Flexible Phosphor Sheet—RadiantFlex Datasheet," Aug. 2014, downloaded from www.phosphortech.com, lOpp.
Wikipedia, "Reflectivity,", downloaded on Jan. 22, 2015 from www.wikipedia.org, 3pp.
"Refraction by lenses," downloaded on Feb. 17, 2015 from www.physicsclassroom.com, 5pp.
"RTLED—White Paper: Binning and LED," downloaded on Oct. 13, 2014 from www.rtled.com, 3pp.
Near, Al, "Seeing Beyond CRI," LED Testing & Application, Nov. 2011, downloaded from www.ies.org/lda/hottopics/led/4.pdf, 2pp.
"Selux—Olivio luminaire," press release dated Mar. 26, 2014, downloaded from http://www.selux.com/be/en/news/press/press-detail/article/evolutionary-progress-the-olivio-family-of-system-luminaires-now-with-premium-quality-white-and.html, 3pp.
"LEDIL—Strada-F Series," downloaded on May 5, 2015 from www.ledil.com, 7pp.
"Sylvania—Ultra SE(tm) LED Lamp Family," downloaded on May 27, 2014 from www.sylvania.com, 3pp.
"Sylvania Ultra SE(tm) LED Light Bulbs with Color Dimming Sunset Effects," downloaded on May 27, 2014 from https://www.youtube.com/watch?v=oZEc-VfJ8EU, 2pp.
Wikipedia, "Transmittance," downloaded on Jan. 22, 2015 from www.wikipedia.org, 4pp.
"United Lumen—A Volumetric Displaced Phosphor Light Engine which elegantly and efficiently distributes light in a pattern similar to an incandescent bulb," downloaded on Jul. 9, 2014 from www.unitedlumen.com, 1p.
"United Lumen—Solid State Volumetric Technology," downloaded on Jul. 9, 2014 from www.unitedlumen.com, 1p.
"United Lumen—High Brightness V-LED Technology," downloaded on May 15, 2014 from www.unitedlumen.com, 1p.
"USAI Lighting Catalog," downloaded on May 27, 2014 from http://www.usaillumination.com/pdf/Warm_Glow_Dimming.pdf, 50pp.
"WINONA—Parata 700 Series Cove," downloaded on May 28, 2014 from www.acuitybrands.com, 2pp.
"WINONA PARATA Catalog," downloaded on May 28, 2014 from www.acuitybrands.com, 24pp.
Petluri et al., U.S. Appl. No. 14/526,504, filed Oct. 28, 2014, entitled "Lighting Systems Having Multiple Light Sources," 92pp.
Petluri et al., U.S. Appl. No. 14/636,204, filed Mar. 3, 2015, entitled "Lighting Systems Including Lens Modules for Selectable Light Distribution," 119pp.
Pickard et al., U.S. Appl. No. 14/617,849, filed Feb. 9, 2015, entitled "Lighting Systems Generating Controlled and Wavelength-Converted Light Emissions," 83pp.
Rodgers et al., U.S. Appl. No. 14/702,800, filed May 4, 2015, entitled "Lighting Systems Including Asymmetric Lens Modules for Selectable Light Distribution," 116pp.
Pickard et al., U.S. Appl. No. 14/636,205, filed Mar. 3, 2015, entitled "Low-Profile Lighting System Having Pivotable Lighting Enclosure," 56pp.
Fletcher et al., U.S. Appl. No. 29/533,667, filed Jul. 20, 2015, entitled "LED Luminaire Having a Mounting System," 10pp.
Fletcher et al., U.S. Appl. No. 29/519,149, filed Mar. 3, 2015, entitled "LED Luminaire," 8pp.
Fletcher et al., U.S. Appl. No. 29/519,153, filed Mar. 3, 2015, entitled "LED Luminaire," 8pp.
Fletcher et al., U.S. Appl. No. 14/816,827, filed Aug. 3, 2015, entitled "Lighting System Having a Mounting Device," 126pp.
Rodgers et al., U.S. Appl. No. 62/202,936, filed Aug. 10, 2015, entitled "Optical Devices and Systems Having a Converging Lens With Grooves," 133pp.
Fletcher et al., U.S. Appl. No. 29/532,383, filed Jul. 6, 2015, entitled "LED Luminaire Having a Mounting System," 10pp.
Fletcher et al., U.S. Appl. No. 29/533,635, filed Jul. 20, 2015, entitled "LED Luminaire Having a Mounting System," 10pp.
Fletcher et al., U.S. Appl. No. 29/533,666, filed Jul. 20, 2015, entitled "LED Luminaire Having a Mounting System," 10pp.

* cited by examiner

LIGHTING SYSTEM HAVING A SEALING SYSTEM

BACKGROUND OF THE INVENTION

1. Field of the Invention

The present invention relates to the field of lighting systems that include semiconductor light-emitting devices.

2. Background of the Invention

Numerous lighting systems that include semiconductor light-emitting devices have been developed. As examples, some of such lighting systems may have features for protection from precipitation, humidity, and other fluids. Despite the existence of these lighting systems, further improvements are still needed in lighting systems that include semiconductor light-emitting devices.

SUMMARY

In an example of an implementation, a lighting system is provided that includes: a housing having a base plate and a housing wall, the housing wall projecting in an upward direction away from the base plate, the housing wall having an end and an interior side. In this example, the lighting system also includes a container in the housing, the container having a visible light-transmissive top plate and a container wall, the container wall projecting in a downward direction away from the top plate toward the base plate, the container wall having an end and an exterior side. In this example of the lighting system, a gasket is interposed between the base plate and the end of the container wall, the gasket being configured for forming a seal between the container wall and the base plate to form a sealed container. Additionally in this example of the lighting system, there is a lighting module in the container, the lighting module including a semiconductor light-emitting device ("SLED"), the SLED being configured for emitting light emissions along a central light emission axis toward the top plate. In this example of the lighting system, there is a rail interposed between the interior side of the housing wall and the exterior side of the container wall, the rail having a first side facing towards the interior side of the housing wall and having a second side facing toward the exterior side of the container wall. This example of the lighting system further includes a first raised region forming a part of the interior side of the housing wall or forming a part of the first side of the rail, and a second raised region forming a part of the exterior side of the container wall or forming a part of the second side of the rail. In this example of the lighting system, the first raised region is configured for limiting movement of the rail away from the base plate along the upward direction, and the second raised region is configured for limiting movement of the container wall away from the base plate along the upward direction.

Other systems, processes, features and advantages of the invention will be or will become apparent to one with skill in the art upon examination of the following figures and detailed description. It is intended that all such additional systems, processes, features and advantages be included within this description, be within the scope of the invention, and be protected by the accompanying claims.

BRIEF DESCRIPTION OF THE FIGURES

The invention can be better understood with reference to the following figures. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
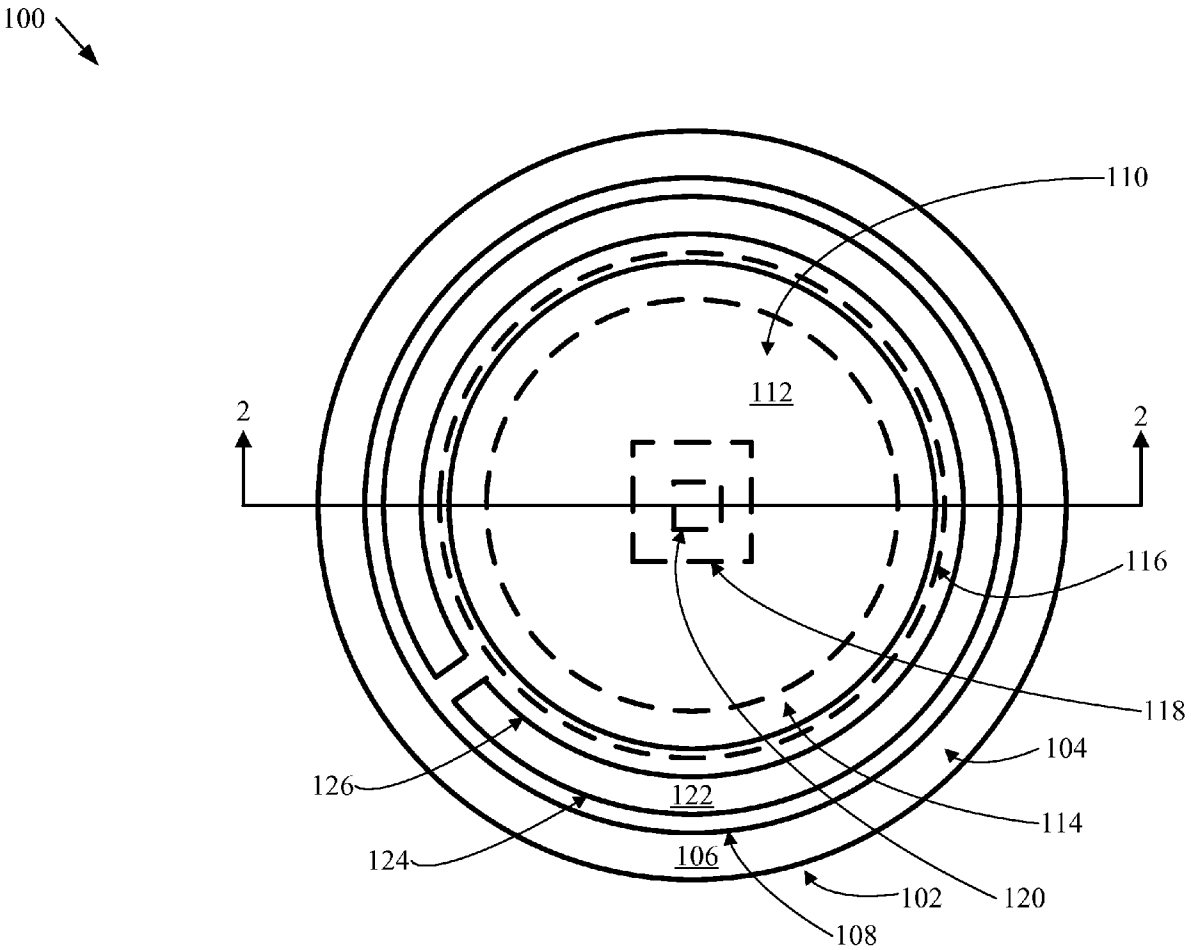
FIG. 1 is a top view showing an example [100] of an implementation of a lighting system.

Various lighting systems that utilize semiconductor light-emitting devices have been designed. Some of these existing systems have included various features intended to protect the lighting devices from precipitation, humidity, other ambient fluids containing water, and other chemical fluids. However, existing lighting systems often have demonstrably failed to provide effective protection against these fluids, which can damage and otherwise adversely affect such lighting systems.

In some examples, lighting systems accordingly are provided herein, that may include [to be added, from the claims].

The following definitions of terms, being stated as applying "throughout this specification", are hereby deemed to be incorporated throughout this specification, including but not limited to the Summary, Brief Description of the Figures, Detailed Description, and Claims.

Throughout this specification, the term "semiconductor" means: a substance, examples including a solid chemical element or compound, that can conduct electricity under some conditions but not others, making the substance a good medium for the control of electrical current.

Throughout this specification, the term "semiconductor light-emitting device" (also being abbreviated as "SLED") means: a light-emitting diode; an organic light-emitting diode; a laser diode; or any other light-emitting device having one or more layers containing inorganic and/or organic semiconductor(s). Throughout this specification, the term "light-emitting diode" (herein also referred to as an "LED") means: a two-lead semiconductor light source having an active pn-junction. As examples, an LED may include a series of semiconductor layers that may be epitaxially grown on a substrate such as, for example, a substrate that includes sapphire, silicon, silicon carbide, gallium nitride or gallium arsenide. Further, for example, one or more semiconductor p-n junctions may be formed in these epitaxial layers. When a sufficient voltage is applied across the p-n junction, for example, electrons in the n-type semiconductor layers and holes in the p-type semiconductor layers may flow toward the p-n junction. As the electrons and holes flow toward each other, some of the electrons may recombine with corresponding holes, and emit photons. The energy release is called electroluminescence, and the color of the light, which corresponds to the energy of the photons, is determined by the energy band gap of the semiconductor. As examples, a spectral power distribution of the light generated by an LED may generally depend on the particular semiconductor materials used and on the structure of the thin epitaxial layers that make up the "active region" of the device, being the area where the light is generated. As examples, an LED may have a light-emissive electroluminescent layer including an inorganic semiconductor, such as a Group III-V semiconductor, examples including: gallium nitride; silicon; silicon carbide; and zinc oxide. Throughout this specification, the term "organic light-emitting diode" (herein also referred to as an "OLED") means: an LED having a light-emissive electroluminescent layer including an organic semiconductor, such as small organic molecules or an organic polymer. It is understood throughout this specification that a semiconductor light-emitting device may include: a non-semiconductor-substrate or a semiconductor-substrate; and may include one or more electrically-conductive contact layers. Further, it is understood throughout this specification that an LED may include a substrate formed of materials such as, for example: silicon carbide; sapphire; gallium nitride; or silicon. It is additionally understood throughout this specification that a semiconductor light-emitting device may have a cathode contact on one side and an anode contact on an opposite side, or may alternatively have both contacts on the same side of the device.

Further background information regarding semiconductor light-emitting devices is provided in the following documents, the entireties of all of which hereby are incorporated by reference herein: U.S. Pat. Nos. 7,564,180; 7,456,499; 7,213,940; 7,095,056; 6,958,497; 6,853,010; 6,791,119; 6,600,175; 6,201,262; 6,187,606; 6,120,600; 5,912,477; 5,739,554; 5,631,190; 5,604,135; 5,523,589; 5,416,342; 5,393,993; 5,359,345; 5,338,944; 5,210,051; 5,027,168; 5,027,168; 4,966,862; and 4,918,497; and U.S. Patent Application Publication Nos. 2014/0225511; 2014/0078715; 2013/0241392; 2009/0184616; 2009/0080185; 2009/0050908; 2009/0050907; 2008/0308825; 2008/0198112; 2008/0179611; 2008/0173884; 2008/0121921; 2008/0012036; 2007/0253209; 2007/0223219; 2007/0170447; 2007/0158668; 2007/0139923; and 2006/0221272.

Throughout this specification, the term "spectral power distribution" means: the emission spectrum of the one or more wavelengths of light emitted by a semiconductor light-emitting device. Throughout this specification, the term "peak wavelength" means: the wavelength where the spectral power distribution of a semiconductor light-emitting device reaches its maximum value as detected by a photo-detector. As an example, an LED may be a source of nearly monochromatic light and may appear to emit light having a single color. Thus, the spectral power distribution of the light emitted by such an LED may be centered about its peak wavelength. As examples, the "width" of the spectral power distribution of an LED may be within a range of between about 10 nanometers and about 30 nanometers, where the width is measured at half the maximum illumination on each side of the emission spectrum. Throughout this specification, the term "full-width-half-maximum" ("FWHM") means: the full width of the spectral power distribution of a semiconductor light-emitting device measured at half the maximum illumination on each side of its emission spectrum. Throughout this specification, the term "half-width-half-maximum" ("HWHM") means: half of the full width of a FWHM. Throughout this specification, the term "dominant wavelength" means: the wavelength of monochromatic light that has the same apparent color as the light emitted by a semiconductor light-emitting device, as perceived by the human eye. As an example, since the human eye perceives yellow and green light better than red and blue light, and because the light emitted by a semiconductor light-emitting device may extend across a range of wavelengths, the color perceived (i.e., the dominant wavelength) may differ from the peak wavelength.

Throughout this specification, the term "luminous flux", also referred to as "luminous power", means: the measure in lumens of the perceived power of light, being adjusted to reflect the varying sensitivity of the human eye to different wavelengths of light. Throughout this specification, the term "radiant flux" means: the measure of the total power of electromagnetic radiation without being so adjusted. Throughout this specification, the term "central light emission axis" means a direction along which the light emissions of a semiconductor light-emitting device have a greatest radiant flux. It is understood throughout this specification that light emissions "along a central light emission axis" means light emissions that: include light emissions in the directions of the central light emission axis; and may further include light emissions in a plurality of other generally similar directions.

It is understood throughout this specification that light emissions "along the longitudinal axis" means light emissions that: include light emissions in the directions of the longitudinal axis; and may further include light emissions in a plurality of other generally similar directions. It is understood throughout this specification that light emissions "in directions transverse to the longitudinal axis" means light emissions that: include light emissions in the directions being orthogonal to the longitudinal axis; and may further include light emissions in a plurality of other generally similar directions. It is understood throughout this specification that light emissions "in directions spaced apart from directions along the longitudinal axis" means light emissions in directions being similar to and spaced apart from the directions along the longitudinal axis. It is understood throughout this specification that light emissions "in directions spaced apart from directions transverse to the longitudinal axis" means light emissions in directions being similar to and spaced apart from the directions being transverse to the longitudinal axis.

Throughout this specification, the term "luminescent" means: characterized by absorption of electromagnetic radiation (e.g., visible light, UV light or infrared light) causing the emission of light by, as examples: fluorescence; and phosphorescence.

Throughout this specification, the term "object" means a material article or device. Throughout this specification, the term "surface" means an exterior boundary of an object. Throughout this specification, the term "incident visible light" means visible light that propagates in one or more directions towards a surface. Throughout this specification, the term "reflective surface" means a surface of an object that causes incident visible light, upon reaching the surface, to then propagate in one or more different directions away from the surface without passing through the object. Throughout this specification, the term "planar reflective surface" means a generally flat reflective surface.

Throughout this specification, the term "reflectance" means a fraction of a radiant flux of incident visible light having a specified wavelength that is caused by a reflective surface of an object to propagate in one or more different directions away from the surface without passing through the object. Throughout this specification, the term "reflected light" means the incident visible light that is caused by a reflective surface to propagate in one or more different directions away from the surface without passing through the object. Throughout this specification, the term "Lambertian reflectance" means diffuse reflectance of visible light from a surface, in which the reflected light has uniform radiant flux in all of the propagation directions. Throughout this specification, the term "specular reflectance" means mirror-like reflection of visible light from a surface, in which light from a single incident direction is reflected into a single propagation direction. Throughout this specification, the term "spectrum of reflectance values" means a spectrum of values of fractions of radiant flux of incident visible light, the values corresponding to a spectrum of wavelength values of visible light, that are caused by a reflective surface to propagate in one or more different directions away from the surface without passing through the object. Throughout this specification, the term "transmittance" means a fraction of a radiant flux of incident visible light having a specified wavelength that is permitted by a surface of an object to pass through the object having the surface. Throughout this specification, the term "transmitted light" means the incident visible light that is permitted by a surface to pass through the object having the surface. Throughout this specification, the term "spectrum of transmittance values" means a spectrum of values of fractions of radiant flux of incident visible light, the values corresponding to a spectrum of wavelength values of visible light, that are permitted by a surface to pass through the object having the surface. Throughout this specification, the term "visible light-transmissive" means an object through which some visible light having some wavelengths is permitted by the object to pass. Throughout this specification, the term "absorbance" means a fraction of a radiant flux of incident visible light having a specified wavelength that is permitted by a reflective surface to pass through the reflective surface and is absorbed by the object having the reflective surface. Throughout this specification, the term "spectrum of absorbance values" means a spectrum of values of fractions of radiant flux of incident visible light, the values corresponding to a spectrum of wavelength values of visible light, that are permitted by a reflective surface to pass through the reflective surface and are absorbed by the object having the reflective surface. Throughout this specification, it is understood that a reflective surface, or an object, may have a spectrum of reflectance values, and a spectrum of transmittance values, and a spectrum of absorbance values. The spectra of reflectance values, absorbance values, and transmittance values of a reflective surface or of an object may be measured, for example, utilizing an ultraviolet-visible-near infrared (UV-VIS-NIR) spectrophotometer. Throughout this specification, the term "visible light reflector" means an object having a reflective surface. In examples, a visible light reflector may be selected as having a reflective surface characterized by light reflections that are more Lambertian than specular.

Throughout this specification, the term "lumiphor" means: a medium that includes one or more luminescent materials being positioned to absorb light that is emitted at a first spectral power distribution by a semiconductor light-emitting device, and to re-emit light at a second spectral power distribution in the visible or ultra violet spectrum being different than the first spectral power distribution, regardless of the delay between absorption and re-emission. Lumiphors may be categorized as being down-converting, i.e., a material that converts photons to a lower energy level (longer wavelength); or up-converting, i.e., a material that converts photons to a higher energy level (shorter wavelength). As examples, a luminescent material may include: a phosphor; a quantum dot; a quantum wire; a quantum well; a photonic nanocrystal; a semiconducting nanoparticle; a scintillator; a lumiphoric ink; a lumiphoric organic dye; a day glow tape; a phosphorescent material; or a fluorescent material. Throughout this specification, the term "quantum material" means any luminescent material that includes: a quantum dot; a quantum wire; or a quantum well. Some quantum materials may absorb and emit light at spectral power distributions having narrow wavelength ranges, for example, wavelength ranges having spectral widths being within ranges of between about 25 nanometers and about 50 nanometers. In examples, two or more different quantum materials may be included in a lumiphor, such that each of the quantum materials may have a spectral power distribution for light emissions that may not overlap with a spectral power distribution for light absorption of any of the one or more other quantum materials. In these examples, cross-absorption of light emissions among the quantum materials of the lumiphor may be minimized. As examples, a lumiphor may include one or more layers or bodies that may contain one or more luminescent materials that each may be: (1) coated or sprayed directly onto an semiconductor light-emitting device; (2) coated or sprayed onto surfaces of a lens or other elements of packaging for an semiconductor light-emitting device; (3) dispersed in a matrix medium; or (4) included within a clear encapsulant (e.g., an epoxy-based or silicone-based curable resin or glass or ceramic) that may be positioned on or over an semiconductor light-emitting device. A lumiphor may include one or multiple types of luminescent materials. Other materials may also be included with a lumiphor such as, for example, fillers, diffusants, colorants, or other materials that may as examples improve the performance of or reduce the overall cost of the lumiphor. In examples where multiple types of luminescent materials may be included in a lumiphor, such materials may, as examples, be mixed together in a single layer or deposited sequentially in successive layers.

Throughout this specification, the term "volumetric lumiphor" means a lumiphor being distributed in an object having a shape including defined exterior surfaces. In some examples, a volumetric lumiphor may be formed by dispersing a lumiphor in a volume of a matrix medium having suitable spectra of visible light transmittance values and visible light absorbance values. As examples, such spectra may be affected by a thickness of the volume of the matrix medium, and by a concentration of the lumiphor being distributed in the volume of the matrix medium. In examples, the matrix medium may have a composition that includes polymers or oligomers of: a polycarbonate; a silicone; an acrylic; a glass; a polystyrene; or a polyester such as polyethylene terephthalate. Throughout this specification, the term "remotely-located lumiphor" means a lumiphor being spaced apart at a distance from and positioned to receive light that is emitted by a semiconductor light-emitting device.

Throughout this specification, the term "light-scattering particles" means small particles formed of a non-luminescent, non-wavelength-converting material. In some examples, a volumetric lumiphor may include light-scattering particles being dispersed in the volume of the matrix medium for causing some of the light emissions having the first spectral power distribution to be scattered within the volumetric lumiphor. As an example, causing some of the light emissions to be so scattered within the matrix medium may cause the luminescent materials in the volumetric lumiphor to absorb more of the light emissions having the first spectral power distribution. In examples, the light-scattering particles may include: rutile titanium dioxide; anatase titanium dioxide; barium sulfate; diamond; alumina; magnesium oxide; calcium titanate; barium titanate; strontium titanate; or barium strontium titanate. In examples, light-scattering particles may have particle sizes being within a range of about 0.01 micron (10 nanometers) and about 2.0 microns (2,000 nanometers).

In some examples, a visible light reflector may be formed by dispersing light-scattering particles having a first index of refraction in a volume of a matrix medium having a second index of refraction being suitably different from the first index of refraction for causing the volume of the matrix medium with the dispersed light-scattering particles to have suitable spectra of reflectance values, transmittance values, and absorbance values for functioning as a visible light reflector. As examples, such spectra may be affected by a thickness of the volume of the matrix medium, and by a concentration of the light-scattering particles being distributed in the volume of the matrix medium, and by physical characteristics of the light-scattering particles such as the particle sizes and shapes, and smoothness or roughness of exterior surfaces of the particles. In an example, the smaller the difference between the first and second indices of refraction, the more light-scattering particles may need to be dispersed in the volume of the matrix medium to achieve a given amount of light-scattering. As examples, the matrix medium for forming a visible light reflector may have a composition that includes polymers or oligomers of: a polycarbonate; a silicone; an acrylic; a glass; a polystyrene; or a polyester such as polyethylene terephthalate. In further examples, the light-scattering particles may include: rutile titanium dioxide; anatase titanium dioxide; barium sulfate; diamond; alumina; magnesium oxide; calcium titanate; barium titanate; strontium titanate; or barium strontium titanate. In other examples, a visible light reflector may include a reflective polymeric or metallized surface formed on a visible light-transmissive polymeric or metallic object such as, for example, a volume of a matrix medium. Additional examples of visible light reflectors may include microcellular foamed polyethylene terephthalate sheets ("MCPET"). Suitable visible light reflectors may be commercially available under the trade names White Optics® and MIRO® from WhiteOptics LLC, 243-G Quigley Blvd., New Castle, Del. 19720 USA. Suitable MCPET visible light reflectors may be commercially available from the Furukawa Electric Co., Ltd., Foamed Products Division, Tokyo, Japan. Additional suitable visible light reflectors may be commercially available from CVI Laser Optics, 200 Dorado Place SE, Albuquerque, New Mexico 87123 USA.

In some examples, a converging or diverging lens may be formed as a volume of a matrix medium having a suitable shape for functioning as a lens. In further examples, forming a diverging lens may include dispersing light-scattering particles having a first index of refraction in a volume of a matrix medium having a second index of refraction being suitably different from the first index of refraction for causing the volume of the matrix medium with the dispersed light-scattering particles to have suitable light-scattering value for functioning as a diverging lens. As examples, the matrix medium for forming a lens may have a composition that includes polymers or oligomers of: a polycarbonate; a silicone; an acrylic; a glass; a polystyrene; or a polyester such as polyethylene terephthalate. In further examples, the light-scattering particles may include: rutile titanium dioxide; anatase titanium dioxide; barium sulfate; diamond; alumina; magnesium oxide; calcium titanate; barium titanate; strontium titanate; or barium strontium titanate.

In further examples, a volumetric lumiphor and a visible light reflector may be integrally formed. As examples, a volumetric lumiphor and a visible light reflector may be integrally formed in respective layers of a volume of a matrix medium, including a layer of the matrix medium having a dispersed lumiphor, and including another layer of the same or a different matrix medium having light-scattering particles being suitably dispersed for causing the another layer to have suitable spectra of reflectance values, transmittance values, and absorbance values for functioning as the visible light reflector. In other examples, an integrally-formed volumetric lumiphor and visible light reflector may incorporate any of the further examples of variations discussed above as to separately-formed volumetric lumiphors and visible light reflectors.

Throughout this specification, the term "phosphor" means: a material that exhibits luminescence when struck by photons. Examples of phosphors that may be utilized include: $CaAlSiN_3$:Eu, $SrAlSiN_3$:Eu, $CaAlSiN_3$:Eu, $Ba_3Si_6$ $O_{12}N_2$:Eu, $Ba_2SiO_4$:Eu, $Sr_2SiO_4$:Eu, $Ca_2SiO_4$:Eu, $Ca_3Sc_2Si_3O_{12}$:Ce, $Ca_3Mg_2Si_3O_{12}$:Ce, $CaSc_2O_4$:Ce, $CaSi_2O_2N_2$:Eu, $SrSi_2O_2N_2$:Eu, $BaSi_2O_2N_2$:Eu, $Ca_5(PO_4)_3Cl$:Eu, $Ba_5(PO_4)_3Cl$:Eu, $Cs_2CaP_2O_7$, $Cs_2SrP_2O_7$, $SrGa_2S_4$:Eu, $Lu_3Al_5O_{12}$:Ce, $Ca_8Mg(SiO_4)_4Cl_2$:Eu, $Sr_8Mg(SiO_4)_4Cl_2$:Eu, $La_3Si_6N_{11}$:Ce, $Y_3Al_5O_{12}$:Ce, $Y_3Ga_5O_{12}$:Ce, $Gd_3Al_5O_{12}$:Ce, $Gd_3Ga_5O_{12}$:Ce, $Tb_3Al_5O_{12}$:Ce, $Tb_3Ga_5O_{12}$:Ce, $Lu_3Ga_5O_{12}$:Ce, (SrCa)$AlSiN_3$:Eu, LuAG:Ce, $(Y,Gd)_2Al_5)_{12}$:Ce, CaS:Eu, SrS:Eu, $SrGa_2S_4$:$E_4$, $Ca_2(Sc,Mg)_2SiO_{12}$:Ce, $Ca_2Sc_2Si_2)_{12}$:C2, $Ca_2Sc_2O_4$:Ce, $Ba_2Si_6O_{12}N_2$:Eu, (Sr,Ca)$AlSiN_2$:Eu, and $CaAlSiN_2$:Eu.

Throughout this specification, the term "quantum dot" means: a nanocrystal made of semiconductor materials that are small enough to exhibit quantum mechanical properties, such that its excitons are confined in all three spatial dimensions.

Throughout this specification, the term "quantum wire" means: an electrically conducting wire in which quantum effects influence the transport properties.

Throughout this specification, the term "quantum well" means: a thin layer that can confine (quasi-)particles (typically electrons or holes) in the dimension perpendicular to the layer surface, whereas the movement in the other dimensions is not restricted.

Throughout this specification, the term "photonic nanocrystal" means: a periodic optical nanostructure that affects the motion of photons, for one, two, or three dimensions, in much the same way that ionic lattices affect electrons in solids.

Throughout this specification, the term "semiconducting nanoparticle" means: a particle having a dimension within a range of between about 1 nanometer and about 100 nanometers, being formed of a semiconductor.

Throughout this specification, the term "scintillator" means: a material that fluoresces when struck by photons.

Throughout this specification, the term "lumiphoric ink" means: a liquid composition containing a luminescent material. For example, a lumiphoric ink composition may contain semiconductor nanoparticles. Examples of lumiphoric ink compositions that may be utilized are disclosed in Cao et al., U.S. Patent Application Publication No. 20130221489 published on Aug. 29, 2013, the entirety of which hereby is incorporated herein by reference.

Throughout this specification, the term "lumiphoric organic dye" means an organic dye having luminescent up-converting or down-converting activity. As an example, some perylene-based dyes may be suitable.

Throughout this specification, the term "day glow tape" means: a tape material containing a luminescent material.

Throughout this specification, the term "visible light" means light having one or more wavelengths being within a range of between about 380 nanometers and about 670 nanometers; and "visible light spectrum" means the range of wavelengths of between about 380 nanometers and about 670 nanometers.

Throughout this specification, the term "white light" means: light having a color point located at a delta(uv) of about equal to or less than 0.006 and having a CCT being within a range of between about 10000K and about 1800K (herein referred to as a "white color point."). Many different hues of light may be perceived as being "white." For example, some "white" light, such as light generated by a tungsten filament incandescent lighting device, may appear yellowish in color, while other "white" light, such as light generated by some fluorescent lighting devices, may appear more bluish in color. As examples, white light having a CCT of about 3000K may appear yellowish in color, while white light having a CCT of about equal to or greater than 8000K may appear more bluish in color and may be referred to as "cool" white light. Further, white light having a CCT of between about 2500K and about 4500K may appear reddish or yellowish in color and may be referred to as "warm" white light. "White light" includes light having a spectral power distribution of wavelengths including red, green and blue color points. In an example, a CCT of a lumiphor may be tuned by selecting one or more particular luminescent materials to be included in the lumiphor. For example, light emissions from a semiconductor light-emitting device that includes three separate emitters respectively having red, green and blue color points with an appropriate spectral power distribution may have a white color point. As another example, light perceived as being "white" may be produced by mixing light emissions from a semiconductor light-emitting device having a blue, greenish-blue or purplish-blue color point together with light emissions having a yellow color point being produced by passing some of the light emissions having the blue, greenish-blue or purplish-blue color point through a lumiphor to down-convert them into light emissions having the yellow color point. General background information on systems and processes for generating light perceived as being "white" is provided in "Class A Color Designation for Light Sources Used in General Illumination", Freyssinier and Rea, *J. Light & Vis. Env.*, Vol. 37, No. 2 & 3 (Nov. 7, 2013, Illuminating Engineering Institute of Japan), pp. 10-14; the entirety of which hereby is incorporated herein by reference.

Throughout this specification, the term "in contact with" means: that a first object, being "in contact with" a second object, is in either direct or indirect contact with the second object. Throughout this specification, the term "in indirect contact with" means: that the first object is not in direct contact with the second object, but instead that there are a plurality of objects (including the first and second objects), and each of the plurality of objects is in direct contact with at least one other of the plurality of objects (e.g., the first and second objects are in a stack and are separated by one or more intervening layers). Throughout this specification, the term "in direct contact with" means: that the first object, which is "in direct contact" with a second object, is touching the second object and there are no intervening objects between at least portions of both the first and second objects.

Throughout this specification, the term "spectrophotometer" means: an apparatus that can measure a light beam's intensity as a function of its wavelength and calculate its total luminous flux.

Throughout this specification, the term "integrating sphere-spectrophotometer" means: a spectrophotometer operationally connected with an integrating sphere. An integrating sphere (also known as an Ulbricht sphere) is an optical component having a hollow spherical cavity with its interior covered with a diffuse white reflective coating, with small holes for entrance and exit ports. Its relevant property is a uniform scattering or diffusing effect. Light rays incident on any point on the inner surface are, by multiple scattering reflections, distributed equally to all other points. The effects of the original direction of light are minimized. An integrating sphere may be thought of as a diffuser which preserves power but destroys spatial information. Another type of integrating sphere that can be utilized is referred to as a focusing or Coblentz sphere. A Coblentz sphere has a mirror-like (specular) inner surface rather than a diffuse inner surface. Light scattered by the interior of an integrating sphere is evenly distributed over all angles. The total power (radiant flux) of a light source can then be measured without inaccuracy caused by the directional characteristics of the source. Background information on integrating sphere-spectrophotometer apparatus is provided in Liu et al., U.S. Pat. No. 7,532,324 issued on May 12, 2009, the entirety of which hereby is incorporated herein by reference. It is understood throughout this specification that color points may be measured, for example, by utilizing a spectrophotometer, such as an integrating sphere-spectrophotometer. The spectra of reflectance values, absorbance values, and transmittance values of a reflective surface or of an object may be measured, for example, utilizing an ultraviolet-visible-near infrared (UV-VIS-NIR) spectrophotometer.

Throughout this specification, the term "lenticular features" means: an array of semicircular convex lenses ("lenticles") on a surface, being arranged as a sinusoidal series of mutually parallel ridges between troughs, forming a series of "lenticular toroidal lenses." Background information on lenticular toroidal lenses and lenticular features is provided in Seo U.S. Pat. No. 8,503,083 issued on Aug. 6, 2013, the entirety of which hereby is incorporated herein by reference.

Throughout this specification, the term "microprismatic features" means an array of small, equally-spaced multi-faceted prisms being arranged in a regular array forming a "microprismatic lens" on a surface Background information on microprismatic lenses is provided in Pakhchyan U.S. Patent Application Publication No. 2011/0292483A1 published on Dec. 1, 2011, the entirety of which hereby is incorporated herein by reference.

Throughout this specification, the term "upward direction" means a direction illustrated as being upward, as indicated by an arrow shown in a Figure herein, being upward relative to an object shown in the Figure. Throughout this specification, the term "downward direction" means a direction illustrated as being downward, as indicated by an arrow shown in a Figure herein, being downward relative to an object shown in the Figure. It is understood that the terms "upward direction" and "downward direction" are relative terms defined by the corresponding arrows illustrated in the Figures as indicating such directions; and that the lighting systems illustrated in the Figures may be oriented in other directions.

Throughout this specification, the term "gasket" means a flat sheet of a resiliently-compressible material. The material of which a gasket is fabricated may include, as examples: rubber; silicone; metal; cork; felt; neoprene; nitrile rubber; fiberglass; polytetrafluoroethylene (PTFE); or polychlorotrifluoroethylene.

Throughout this specification, the term "container" means an object having an interior shaped for holding another object; and the term "sealed container" means a container being closed so as to resist the entry of a fluid into the interior of the container. A "sealed container" may, for example, resist the entry of water into the interior.

It is understood throughout this specification that numbering of the names of elements as being "first", "second" etcetera, is solely for purposes of clarity in referring to such elements in connection with various examples of lighting systems.

Figure 2:
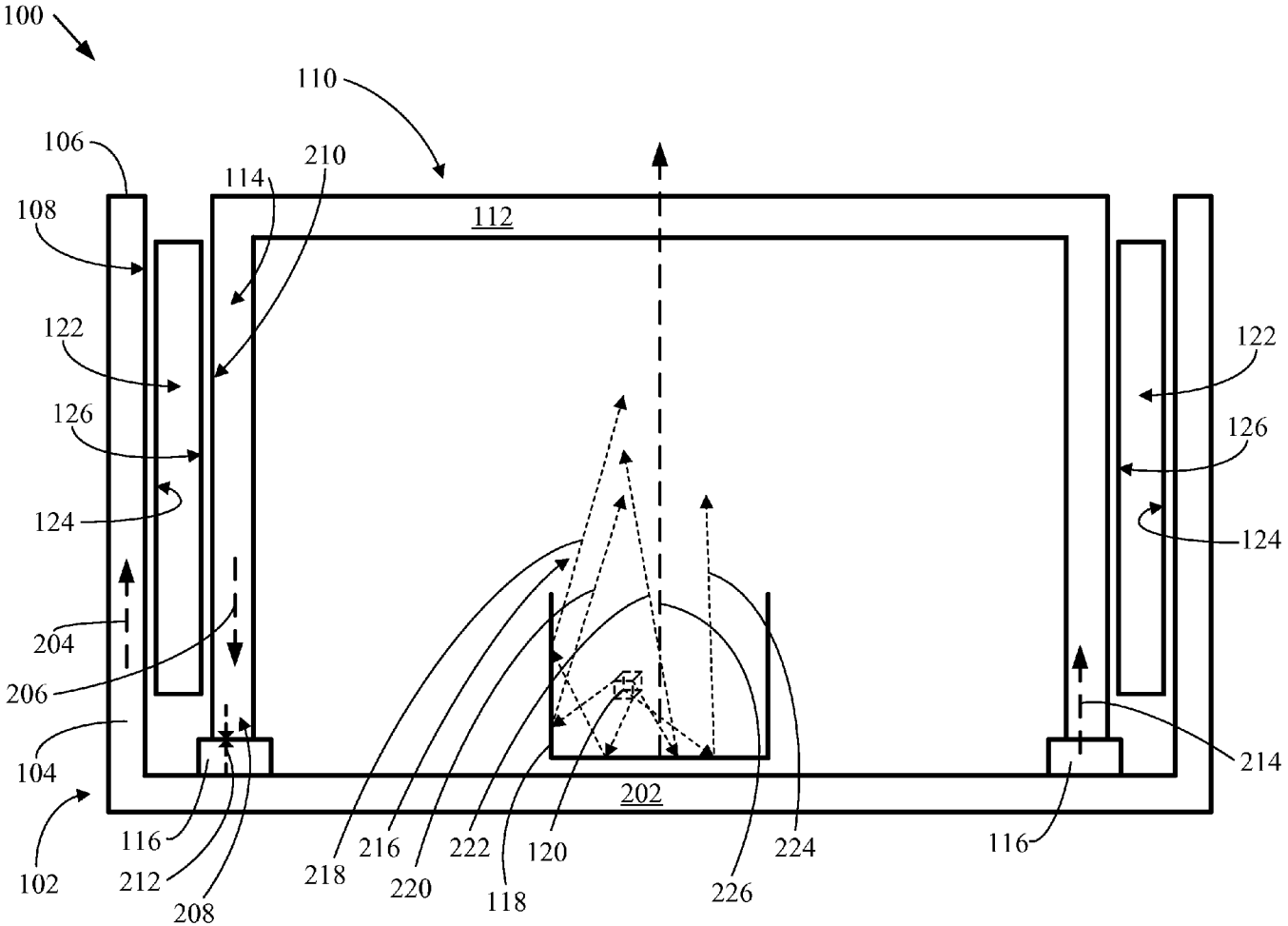
FIG. 2 is a cross-sectional side view taken along the line 2-2, showing the example of the lighting system.

FIG. 1 is a top view showing an example [100] of an implementation of a lighting system. FIG. 2 is a cross-sectional side view taken along the line 2-2, showing the example [100] of the lighting system. It is understood throughout this specification that an example [100] of a lighting system may include any combination of the features that are discussed herein in connection with the examples [100], [300], [500], [700], [900], [1100], [1300], [1500], [1700], [2000], [2200], [2400] of lighting systems. Accordingly, the entireties of the discussions of the other examples [300], [500], [700], [900], [1100], [1300], [1500], [1700], [2000], [2200], [2400] of lighting systems are hereby incorporated in this discussion of the examples [100] of the lighting systems. As shown in FIGS. 1 and 2, the example [100] of the implementation of the lighting system includes a housing [102] having a base plate [202] and a housing wall [104]. The housing wall [104] projects in an upward direction as represented by an arrow [204] away from the base plate [202]. The housing wall [104] has an end [106] and an interior side [108]. The example [100] of the implementation of the lighting system further includes a container [110] in the housing [102]. Further in the example [100] of the implementation of the lighting system, the container [110] has a visible light-transmissive top plate [112] and a container wall [114]. The container wall [114] of the example [100] of the implementation of the lighting system projects in a downward direction represented by an arrow [206] away from the top plate [112] toward the base plate [202]. In the example [100] of the implementation of the lighting system, the container wall [114] has an end [208] and an exterior side [210]. The example [100] of the implementation of the lighting system additionally includes a gasket [116] interposed between the base plate [202] and the end [208] of the container wall [114]. In the example [100] of the implementation of the lighting system, the gasket [116] is configured for forming a seal represented by an arrow [212] between the container wall [114] and the base plate [202] to seal the container [110], forming a sealed container as represented by the arrow [214]. The example [100] of the implementation of the lighting system further includes a lighting module [118] in the container [110]. The lighting module [118] of the example [100] of the implementation of the lighting system includes a semiconductor light-emitting device [120] (also referred to herein as a "SLED"). In the example [100] of the implementation of the lighting system, the SLED [120] is configured for emitting light emissions [216] in directions represented by the arrows [218], [220], [222], [224] along a central light emission axis [226] toward the top plate [112]. The example [100] of the implementation of the lighting system also includes a rail [122] interposed between the interior side [108] of the housing wall [104] and the exterior side [210] of the container wall [114]. In the example [100] of the implementation of the lighting system, the rail [122] has a first side [124] facing towards the interior side [108] of the housing wall [104] and a second side [126] facing toward the exterior side [210] of the container wall [114]. The example [100] of the implementation of the lighting system includes a first raised region (examples of which are shown in and discussed in connection with FIGS. 3-26) forming a part of the interior side [108] of the housing wall [104] or forming a part of the first side [124] of the rail [122], and a second raised region (examples of which are shown in and discussed in connection with FIGS. 3-26) forming a part of the exterior side [210] of the container wall [114] or forming a part of the second side [126] of the rail [122]. In the examples [100] of the implementation of the lighting system, the first raised region (not shown) is configured for limiting movement of the rail [122] away from the base plate [202] along the upward direction represented by the arrow [204]; and the second raised region (not shown) is configured for limiting movement of the container wall [114] away from the base plate [202] along the upward direction represented by the arrow [204].

Figure 3:
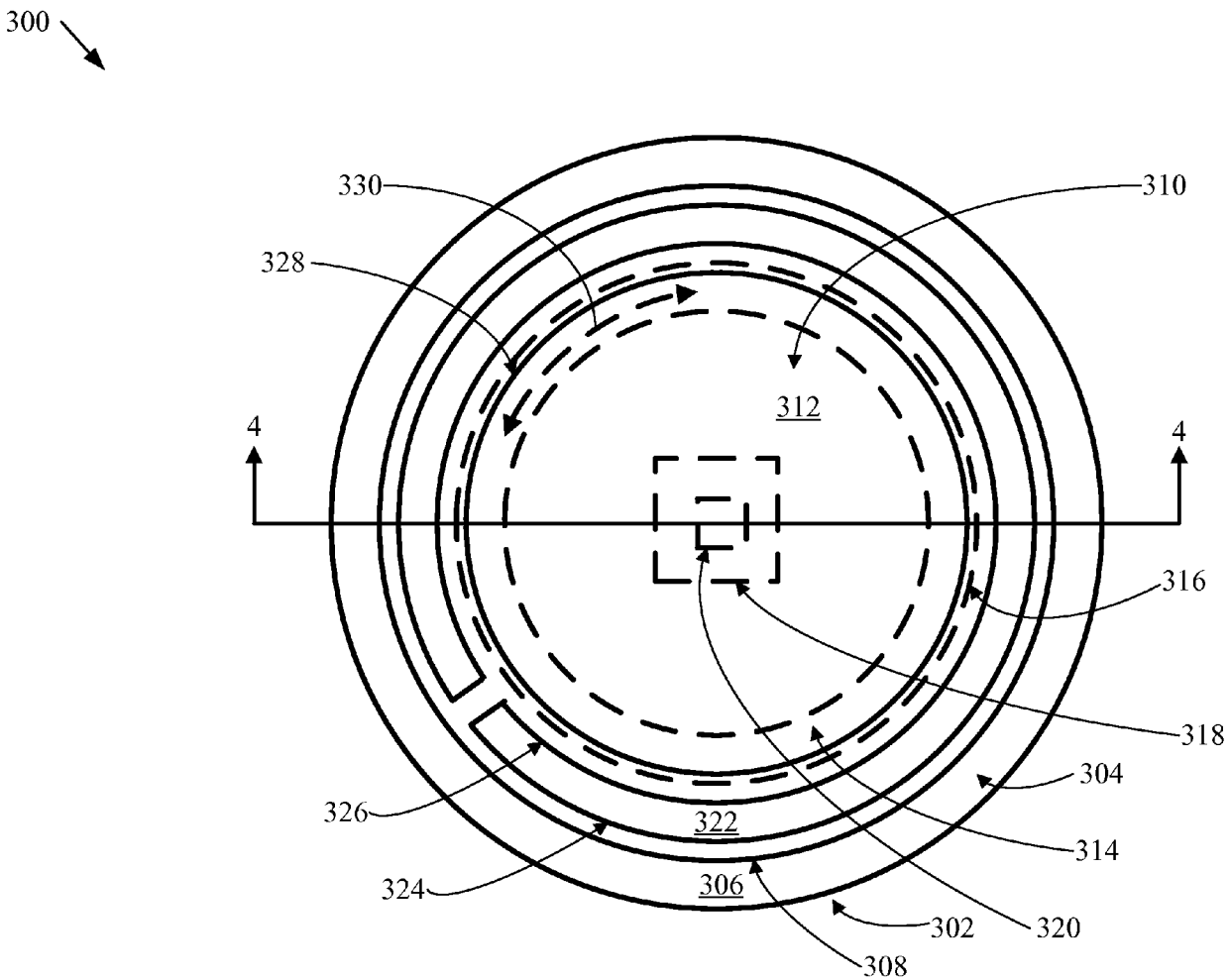
FIG. 3 is a top view showing another example [300] of an implementation of the lighting system.
Figure 4:
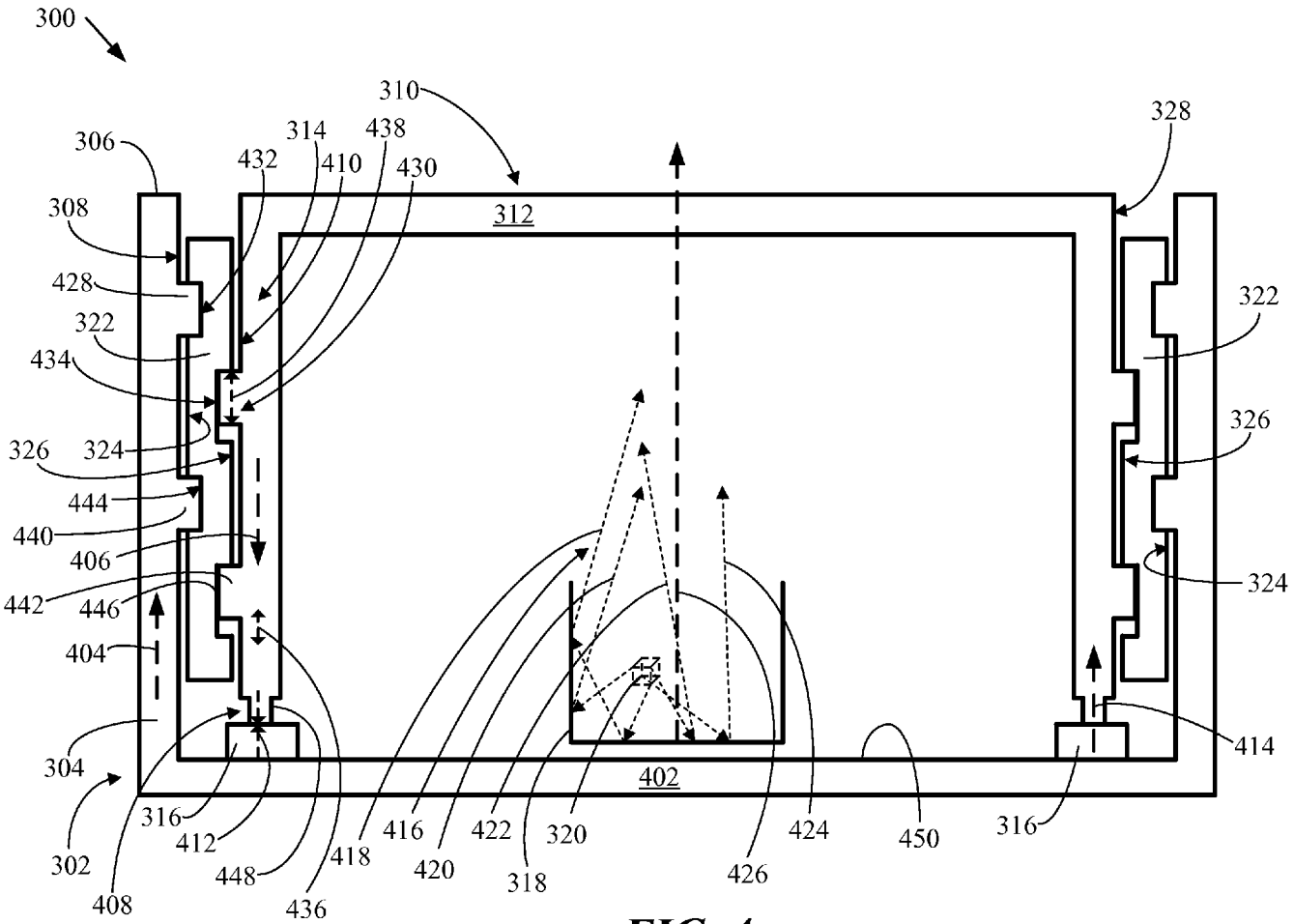
FIG. 4 is a cross-sectional side view taken along the line 4-4, showing the another example [300] of the lighting system.

FIG. 3 is a top view showing another example [300] of an implementation of the lighting system. FIG. 4 is a cross-sectional side view taken along the line 4-4, showing the another example [300] of the lighting system. It is understood throughout this specification that an example [300] of a lighting system may include any combination of the features that are discussed herein in connection with the examples [100], [300], [500], [700], [900], [1100], [1300], [1500], [1700], [2000], [2200], [2400] of lighting systems. Accordingly, the entireties of the discussions of the other examples [100], [500], [700], [900], [1100], [1300], [1500], [1700], [2000], [2200], [2400] of lighting systems are hereby incorporated in this discussion of the examples [300] of the lighting systems. As shown in FIGS. 3 and 4, the example [300] of the implementation of the lighting system includes a housing [302] having a base plate [402] and a housing wall [304]. The housing wall [304] projects in an upward direction as represented by an arrow [404] away from the base plate [402]. The housing wall [304] has an end [306] and an interior side [308]. The example [300] of the implementation of the lighting system further includes a container [310] in the housing [302]. Further in the example [300] of the implementation of the lighting system, the container [310] has a visible light-transmissive top plate [312] and a container wall [314]. The container wall [314] of the example [300] of the implementation of the lighting system projects in a downward direction represented by an arrow [406] away from the top plate [312] toward the base plate [402]. In the example [300] of the implementation of the lighting system, the container wall [314] has an end [408] and an exterior side [410]. The example [300] of the implementation of the lighting system additionally includes a gasket [316] interposed between the base plate [402] and the end [408] of the container wall [314]. In the example [300] of the implementation of the lighting system, the gasket [316] is configured for forming a seal represented by an arrow [412] between the container wall [314] and the base plate [402] to seal the container [310], forming a sealed container as represented by the arrow [414]. The example [300] of the implementation of the lighting system further includes a lighting module [318] in the container [310]. The lighting module [318] of the example [300] of the implementation of the lighting system includes a semiconductor light-emitting device [320]. In the example [300] of the implementation of the lighting system, the SLED [320] is configured for emitting light emissions [416] in directions represented by the arrows [418], [420], [422], [424] along a central light emission axis [426] toward the top plate [312]. The example [300] of the implementation of the lighting system also includes a rail [322] interposed between the interior side [308] of the housing wall [304] and the exterior side [410] of the container wall [314]. In the example [300] of the implementation of the lighting system, the rail [322] has a first side [324] facing towards the interior side [308] of the housing wall [304] and a second side [326] facing toward the exterior side [410] of the container wall [314]. In examples of the example [300] of the lighting system, the rail [322] may be flexible or rigid. As another example of the example [300] of the lighting system, the rail [322] may be arcuately interposed between the interior side [308] of the housing wall [304] and the exterior side [410] of the container wall [314]. In an additional example of the example [300] of the lighting system, the rail [322] may be a visible light-reflective rail [322]. For example, a visible light-reflective rail [322] may facilitate redirecting some of the light emissions [416] along the central light emission axis [426] toward the top plate [312]. In examples, the rail [322] may be formed of a metal or plastic material, for example, white polycarbonate, or aluminum. As examples of the example [300] of the lighting system, the top plate [312] may be a visible light-transparent top plate [312], or may be a visible light-translucent top plate [312]. The example [300] of the implementation of the lighting system may also include a first raised region [428] forming a part of the interior side [308] of the housing wall [304], and may further include a second raised region [430] forming a part of the exterior side [410] of the container wall [314]. In the examples [300] of the implementation of the lighting system, the first raised region [428] may be configured for limiting movement of the rail [322] away from the base plate [402] along the upward direction represented by the arrow [404]; and the second raised region [430] may be configured for limiting movement of the container wall [314] away from the base plate [402] along the upward direction represented by the arrow [404]. In an example of this example [300] of the implementation of the lighting system, the first side [324] of the rail [322] may include a first recess [432] configured for receiving the first raised region [428], and the second side [326] of the rail [322] may include a second recess [434] for receiving the second raised region [430]. In another example of this example [300] of the implementation of the lighting system, the second recess [434] may be configured for permitting movement of the container wall [410] through a selected distance represented by an arrow [436] along the upward direction [404] and along the downward direction [406] with the second raised region [430] being received in the second recess [434]. For example, the second recess [434] of this example of the example [300] of the implementation of the lighting system may have a greater length in the directions of the arrow [434] than a thickness, being represented by an arrow [438], of the second raised region [430]. In a further example of this example [300] of the implementation of the lighting system, the first recess [432] may be configured for permitting movement of the rail [322] through a selected distance represented by the arrow [436] along the upward direction [404] and along the downward direction [406] with the first raised region [428] being received in the first recess [432]. In further examples, the example [300] of the implementation of the lighting system may include another raised region [440] forming a part of the interior side [308] of the housing wall [304]; and may include an additional raised region [442] forming a part of the exterior side [410] of the container wall [314]. Further, for example, the first side [324] of the rail [322] may include a third recess [444] configured for receiving the another raised region [440], and the second side [326] of the rail [322] may include a fourth recess [446] for receiving the additional raised region [442]. In further examples of the example [300] of the lighting system, the top plate [312] may have a perimeter [328], and the container wall [314] may project away from the perimeter [328] of the top plate [312]. In another example of the example [300] of the lighting system, the perimeter [328] of the top plate [312] may be a curvilinear perimeter [328]. In additional examples of the example [300] of the lighting system, the perimeter [328] of the top plate [312] may be a circular or elliptical (not shown) perimeter [328]. Further, for example, the second raised region [430] may be continuous along a direction represented by an arrow [330] around the perimeter [328] of the top plate [312]. In additional examples of the example [300] of the lighting system, the second raised region [430] may be, or may include, a raised rib being continuous along the direction [330] around the perimeter [328] of the top plate [312]. Further, for example, the first raised region [428] may be continuous along the direction [330] around the perimeter [328] of the top plate [312]. In additional examples of the example [300]

of the lighting system, the first raised region [428] may be, or may include, a raised rib being continuous along the direction [330] around the perimeter [328] of the top plate [312]. In other examples, the example [300] of the lighting system may include a plurality of the second raised regions [430] being spaced apart along the direction [330] around the perimeter [328] of the top plate [312]. In further examples, the example [300] of the lighting system may include a plurality of the first raised regions [428] being spaced apart along the direction [330] around the perimeter [328] of the top plate [312]. In examples of the example [300] of the implementation of the lighting system, the rail [322] may be configured for compressing, in the directions of the arrow [412], a portion of the gasket [316] between the base plate [402] and the end [408] of the container wall [314]. Further, for example, the example [300] of the implementation of the lighting system may be configured for compressing the rail [322] between the first raised region [428] and the second raised region [430]. As further examples, edges of the rail [322] and the first and second raised regions [428], [430] may be rounded for facilitating insertion of the rail [322] between the first and second raised regions [428], [430]. In examples of the example [300] of the implementation of the lighting system, the gasket [316] may be configured for forming the seal represented by the arrow [412] between the end [408] of the container wall [314] and the base plate [402] as being water-resistant, forming the container [310] as being a water-resistant sealed container as represented by the arrow [414]. In additional examples of the example [300] of the implementation of the lighting system, the end [408] of the container wall [314] may have a ridge [448] being continuous along the direction [330] around the perimeter [328] of the top plate [312], the ridge [448] being configured for being placed in contact with a surface [450] of the gasket [316].

Figure 5:
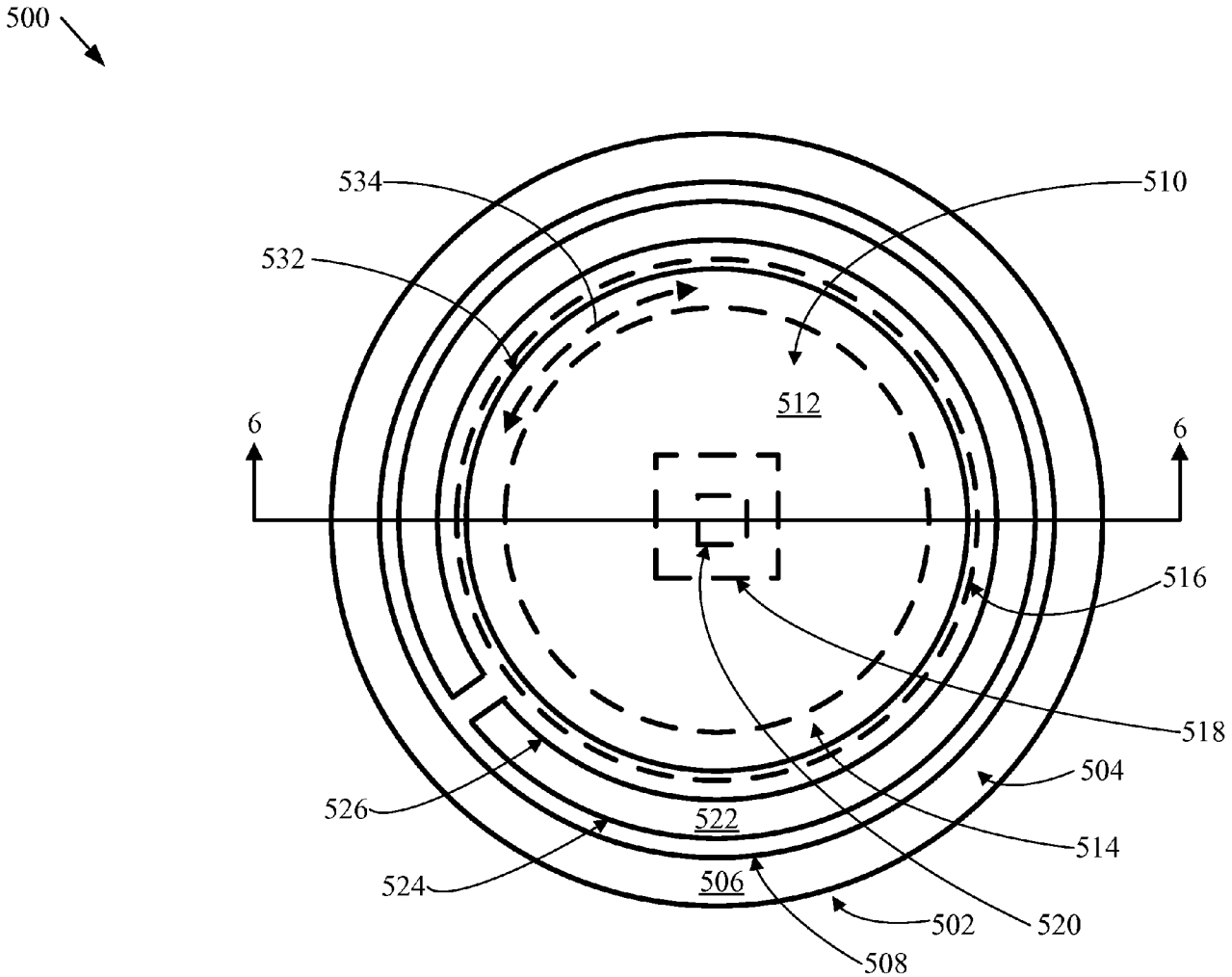
FIG. 5 is a top view showing a further example [500] of an implementation of the lighting system.
Figure 6:
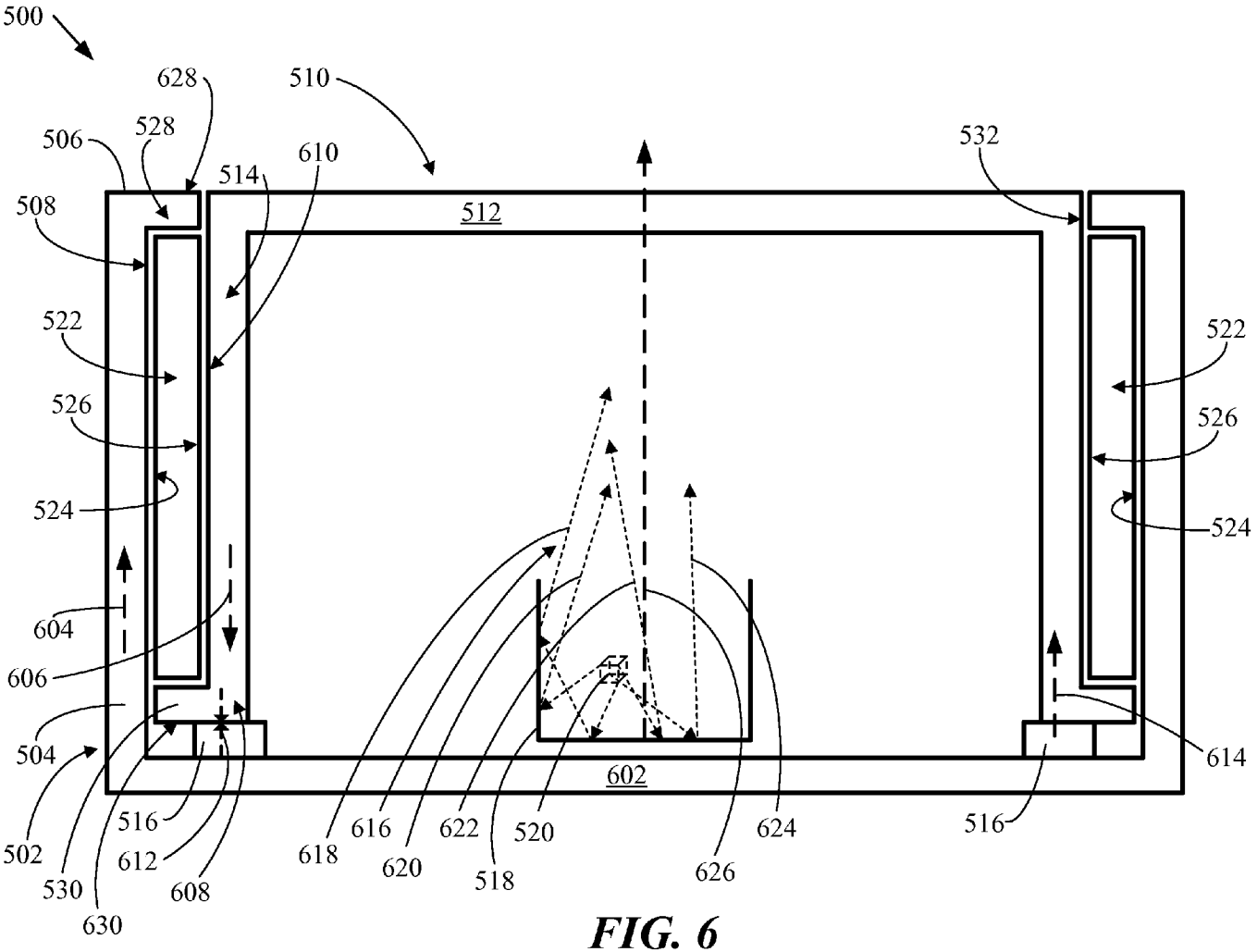
FIG. 6 is a cross-sectional side view taken along the line 6-6, showing the another example [500] of the lighting system.

FIG. 5 is a top view showing a further example [500] of an implementation of the lighting system. FIG. 6 is a cross-sectional side view taken along the line 6-6, showing the another example [500] of the lighting system. It is understood throughout this specification that an example [500] of a lighting system may include any combination of the features that are discussed herein in connection with the examples [100], [300], [500], [700], [900], [1100], [1300], [1500], [1700], [2000], [2200], [2400] of lighting systems. Accordingly, the entireties of the discussions of the other examples [100], [300], [700], [900], [1100], [1300], [1500], [1700], [2000], [2200], [2400] of lighting systems are hereby incorporated in this discussion of the examples [500] of the lighting systems. As shown in FIGS. 5 and 6, the example [500] of the implementation of the lighting system includes a housing [502] having a base plate [602] and a housing wall [504]. The housing wall [504] projects in an upward direction as represented by an arrow [604] away from the base plate [602]. The housing wall [504] has an end [506] and an interior side [508]. The example [500] of the implementation of the lighting system further includes a container [510] in the housing [502]. Further in the example [500] of the implementation of the lighting system, the container [510] has a visible light-transmissive top plate [512] and a container wall [514]. The container wall [514] of the example [500] of the implementation of the lighting system projects in a downward direction represented by an arrow [606] away from the top plate [512] toward the base plate [602]. In the example [500] of the implementation of the lighting system, the container wall [514] has an end [608] and an exterior side [610]. The example [500] of the implementation of the lighting system additionally includes a gasket [516] interposed between the base plate [602] and the end [608] of the container wall [514]. In the example [500] of the implementation of the lighting system, the gasket [516] is configured for forming a seal represented by an arrow [612] between the container wall [514] and the base plate [602] to seal the container [510], forming a sealed container as represented by the arrow [614]. The example [500] of the implementation of the lighting system further includes a lighting module [518] in the container [510]. The lighting module [518] of the example [500] of the implementation of the lighting system includes a semiconductor light-emitting device [520]. In the example [500] of the implementation of the lighting system, the SLED [520] is configured for emitting light emissions [616] in directions represented by the arrows [618], [620], [622], [624] along a central light emission axis [626] toward the top plate [512]. The example [500] of the implementation of the lighting system also includes a rail [522] interposed between the interior side [508] of the housing wall [504] and the exterior side [610] of the container wall [514]. In the example [500] of the implementation of the lighting system, the rail [522] has a first side [524] facing towards the interior side [508] of the housing wall [504] and a second side [526] facing toward the exterior side [610] of the container wall [514]. In examples of the example [500] of the lighting system, the rail [522] may be flexible or rigid. As another example of the example [500] of the lighting system, the rail [522] may be arcuately interposed between the interior side [508] of the housing wall [504] and the exterior side [610] of the container wall [514]. In an additional example of the example [500] of the lighting system, the rail [522] may be a visible light-reflective rail [522]. For example, a visible light-reflective rail [522] may facilitate redirecting some of the light emissions [616] along the central light emission axis [626] toward the top plate [512]. As examples of the example [500] of the lighting system, the top plate [512] may be a visible light-transparent top plate [512], or may be a visible light-translucent top plate [512]. The example [500] of the implementation of the lighting system may also include a first raised region [628] located at the end [506] of and forming a part of the interior side [508] of the housing wall [504], and may include a second raised region [630] located at the end [608] of and forming a part of the exterior side [610] of the container wall [514]. In the examples [500] of the implementation of the lighting system, the first raised region [628] may be configured for limiting movement of the rail [522] away from the base plate [602] along the upward direction represented by the arrow [604]; and the second raised region [630] may be configured for limiting movement of the container wall [514] away from the base plate [602] along the upward direction represented by the arrow [604]. In the examples [500] of the implementation of the lighting system, the first raised region [628] may, for example, be or include a flange [628] located at the end [506] of the housing wall [504] and forming a part of the interior side [508] of the housing wall [504]. Further in this example [500] of the implementation of the lighting system, the second raised region [630] may, for example, be or include a flange [630] located at the end [608] of and forming a part of the exterior side [610] of the container wall [514]. In further examples of the example [500] of the lighting system, the top plate [512] may have a perimeter [532], and the container wall [514] may project away from the perimeter [532] of the top plate [512]. In another example of the example [500] of the lighting system, the perimeter [528] of the top plate [512] may be a curvilinear perimeter [528]. In additional examples of the example

[500] of the lighting system, the perimeter [528] of the top plate [512] may be a circular or elliptical (not shown) perimeter [528]. Further, for example, the second raised region [630] may be continuous along a direction represented by an arrow [534] around the perimeter [532] of the top plate [512]. In additional examples of the example [500] of the lighting system, the second raised region [630] may be, or may include, a raised rib being continuous along the direction [534] around the perimeter [532] of the top plate [512]. Further, for example, the first raised region [628] may be continuous along the direction [534] around the perimeter [532] of the top plate [512]. In additional examples of the example [500] of the lighting system, the first raised region [628] may be, or may include, a raised rib being continuous along the direction [534] around the perimeter [532] of the top plate [512]. In other examples, the example [500] of the lighting system may include a plurality of the second raised regions [630] being spaced apart along the direction [534] around the perimeter [532] of the top plate [512]. In further examples, the example [500] of the lighting system may include a plurality of the first raised regions [628] being spaced apart along the direction [534] around the perimeter [532] of the top plate [512]. In examples of the example [500] of the implementation of the lighting system, the rail [522] may be configured for compressing, in the directions of the arrow [612], a portion of the gasket [516] between the base plate [602] and the end [608] of the container wall [514]. Further, for example, the example [500] of the implementation of the lighting system may be configured for compressing the rail [522] between the first raised region [628] and the second raised region [630]. In examples of the example [500] of the implementation of the lighting system, the gasket [516] may be configured for forming the seal represented by the arrow [612] between the end [608] of the container wall [514] and the base plate [602] as being water-resistant, forming the container [510] as being a water-resistant sealed container as represented by the arrow [614].

Figure 7:
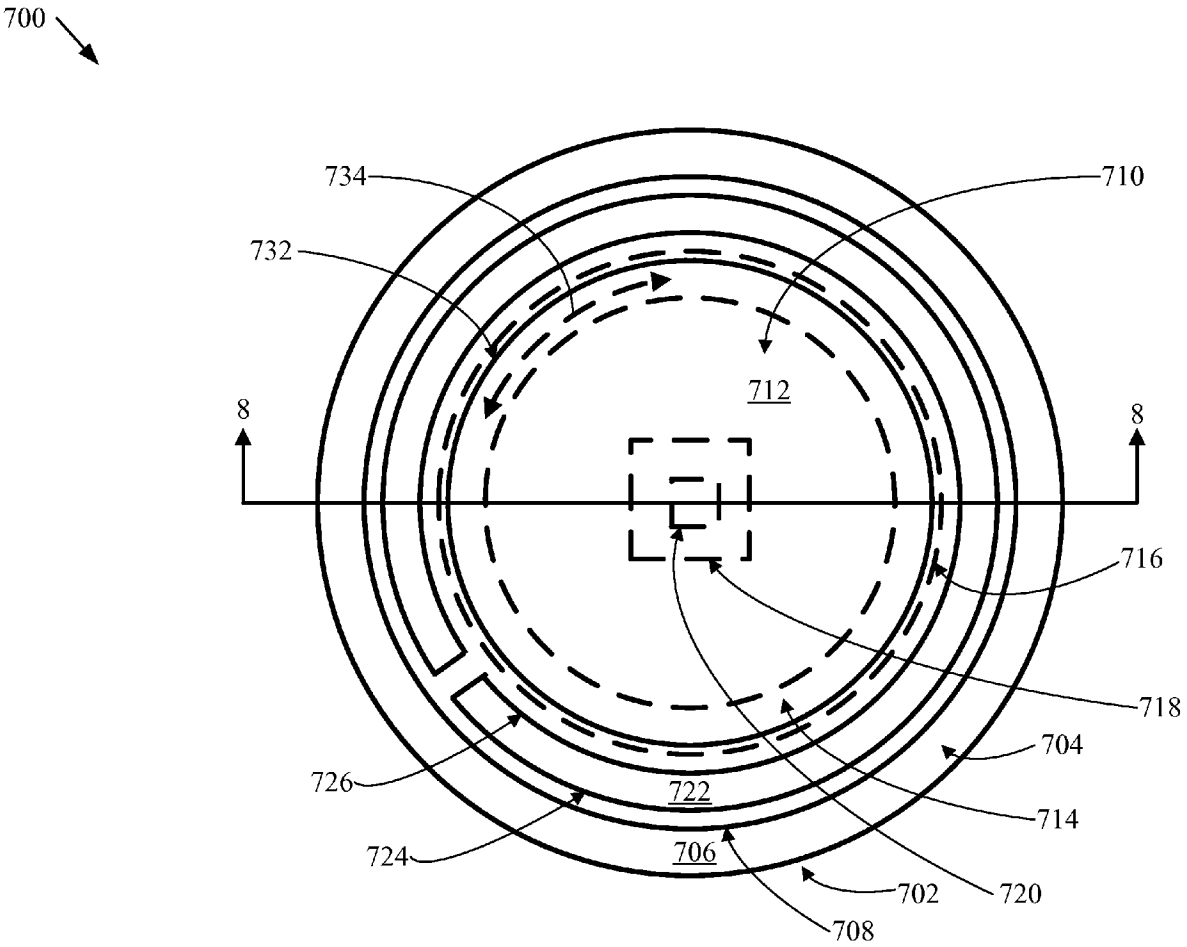
FIG. 7 is a top view showing an additional example [700] of an implementation of the lighting system.
Figure 8:
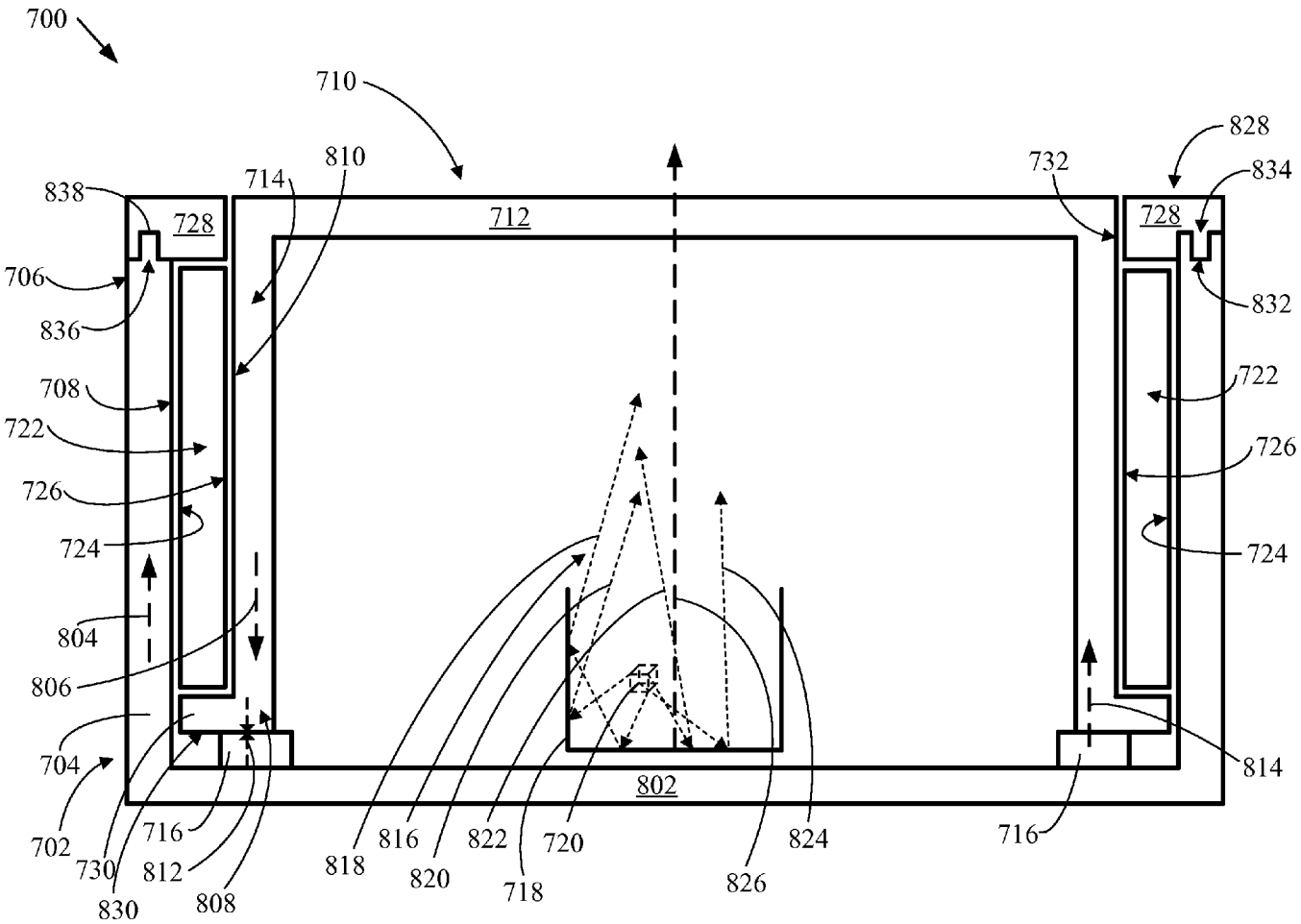
FIG. 8 is a cross-sectional side view taken along the line 8-8, showing the another example [700] of the lighting system.

FIG. 7 is a top view showing an additional example [700] of an implementation of the lighting system. FIG. 8 is a cross-sectional side view taken along the line 8-8, showing the another example [700] of the lighting system. It is understood throughout this specification that an example [700] of a lighting system may include any combination of the features that are discussed herein in connection with the examples [100], [300], [500], [700], [900], [1100], [1300], [1500], [1700], [2000], [2200], [2400] of lighting systems. Accordingly, the entireties of the discussions of the other examples [100], [300], [500], [900], [1100], [1300], [1500], [1700], [2000], [2200], [2400] of lighting systems are hereby incorporated in this discussion of the examples [700] of the lighting systems. As shown in FIGS. 7 and 8, the example [700] of the implementation of the lighting system includes a housing [702] having a base plate [802] and a housing wall [704]. The housing wall [704] projects in an upward direction as represented by an arrow [804] away from the base plate [802]. The housing wall [704] has an end [706] and an interior side [708]. The example [700] of the implementation of the lighting system further includes a container [710] in the housing [702]. Further in the example [700] of the implementation of the lighting system, the container [710] has a visible light-transmissive top plate [712] and a container wall [714]. The container wall [714] of the example [700] of the implementation of the lighting system projects in a downward direction represented by an arrow [806] away from the top plate [712] toward the base plate [802]. In the example [700] of the implementation of the lighting system, the container wall [714] has an end [808] and an exterior side [810]. The example [700] of the implementation of the lighting system additionally includes a gasket [716] interposed between the base plate [802] and the end [808] of the container wall [714]. In the example [700] of the implementation of the lighting system, the gasket [716] is configured for forming a seal represented by an arrow [812] between the container wall [714] and the base plate [802] to seal the container [710], forming a sealed container as represented by the arrow [814]. The example [700] of the implementation of the lighting system further includes a lighting module [718] in the container [710]. The lighting module [718] of the example [700] of the implementation of the lighting system includes a semiconductor light-emitting device [720]. In the example [700] of the implementation of the lighting system, the SLED [720] is configured for emitting light emissions [816] in directions represented by the arrows [818], [820], [822], [824] along a central light emission axis [826] toward the top plate [712]. The example [700] of the implementation of the lighting system also includes a rail [722] interposed between the interior side [708] of the housing wall [704] and the exterior side [810] of the container wall [714]. In the example [700] of the implementation of the lighting system, the rail [722] has a first side [724] facing towards the interior side [708] of the housing wall [704] and a second side [726] facing toward the exterior side [810] of the container wall [714]. In examples of the example [700] of the lighting system, the rail [722] may be flexible or rigid. As another example of the example [700] of the lighting system, the rail [722] may be arcuately interposed between the interior side [708] of the housing wall [704] and the exterior side [810] of the container wall [714]. In an additional example of the example [700] of the lighting system, the rail [722] may be a visible light-reflective rail [722]. For example, a visible light-reflective rail [722] may facilitate redirecting some of the light emissions [816] along the central light emission axis [826] toward the top plate [712]. As examples of the example [700] of the lighting system, the top plate [712] may be a visible light-transparent top plate [712], or may be a visible light-translucent top plate [712]. The example [700] of the implementation of the lighting system may also include a first raised region [828] located at the end [706] of and forming a part of the interior side [708] of the housing wall [704], and may include a second raised region [830] located at the end [808] of and forming a part of the exterior side [810] of the container wall [714]. In the examples [700] of the implementation of the lighting system, the first raised region [828] may be configured for limiting movement of the rail [722] away from the base plate [802] along the upward direction represented by the arrow [804]; and the second raised region [830] may be configured for limiting movement of the container wall [714] away from the base plate [802] along the upward direction represented by the arrow [804]. In the examples [700] of the implementation of the lighting system, the first raised region [828] may, for example, be or include a bar [728] located at the end [706] of the housing wall [704] and forming a part of the interior side [708] of the housing wall [704]. Further in this example [700] of the implementation of the lighting system, the second raised region [830] may, for example, be or include a flange [730] located at the end [708] of and forming a part of the exterior side [710] of the container wall [714]. In an example of this example [700] of the implementation of the lighting system, the end [706] of all or a portion of the housing wall [704] may have a groove [832], and the bar [728] may have a raised region [834], and the groove [832]

may be configured for receiving the raised region [834] for attaching the bar [728] to the end [706] of the housing wall [704]. In another example of this example [700] of the implementation of the lighting system, the end [706] of all or a portion of the housing wall [704] may have a ridge [836], and the bar [728] may have a groove [838], and the groove [838] may be configured for receiving the ridge [836] for attaching the bar [728] to the end [706] of the housing wall [704]. In further examples of the example [700] of the implementation of the lighting system, the bar [728] may be flexible or rigid. In further examples of the example [700] of the lighting system, the top plate [712] may have a perimeter [732], and the container wall [714] may project away from the perimeter [732] of the top plate [712]. In another example of the example [700] of the lighting system, the perimeter [728] of the top plate [712] may be a curvilinear perimeter [728]. In additional examples of the example [700] of the lighting system, the perimeter [728] of the top plate [712] may be a circular or elliptical (not shown) perimeter [728]. Further, for example, the second raised region [830] may be continuous along a direction represented by an arrow [734] around the perimeter [732] of the top plate [712]. In additional examples of the example [700] of the lighting system, the second raised region [830] may be, or may include, a raised rib being continuous along the direction [734] around the perimeter [732] of the top plate [712]. Further, for example, the first raised region [828] may be continuous along the direction [734] around the perimeter [732] of the top plate [712]. In additional examples of the example [700] of the lighting system, the bar [728] may be continuous along the direction [734] around the perimeter [732] of the top plate [712]. In other examples, the example [700] of the lighting system may include a plurality of the second raised regions [830] being spaced apart along the direction [734] around the perimeter [732] of the top plate [712]. In further examples, the example [700] of the lighting system may include a plurality of the first raised regions [828], or of the bars [728], being spaced apart along the direction [734] around the perimeter [732] of the top plate [712]. In examples of the example [700] of the implementation of the lighting system, the rail [722] may be configured for compressing, in the directions of the arrow [812], a portion of the gasket [716] between the base plate [802] and the end [808] of the container wall [714]. Further, for example, the example [700] of the implementation of the lighting system may be configured for compressing the rail [722] between the first raised region [828] and the second raised region [830]. In examples of the example [700] of the implementation of the lighting system, the gasket [716] may be configured for forming the seal represented by an arrow [812] between the end [808] of the container wall [714] and the base plate [802] as being water-resistant, forming the container [710] as being a water-resistant sealed container as represented by the arrow [814].

Figure 9:
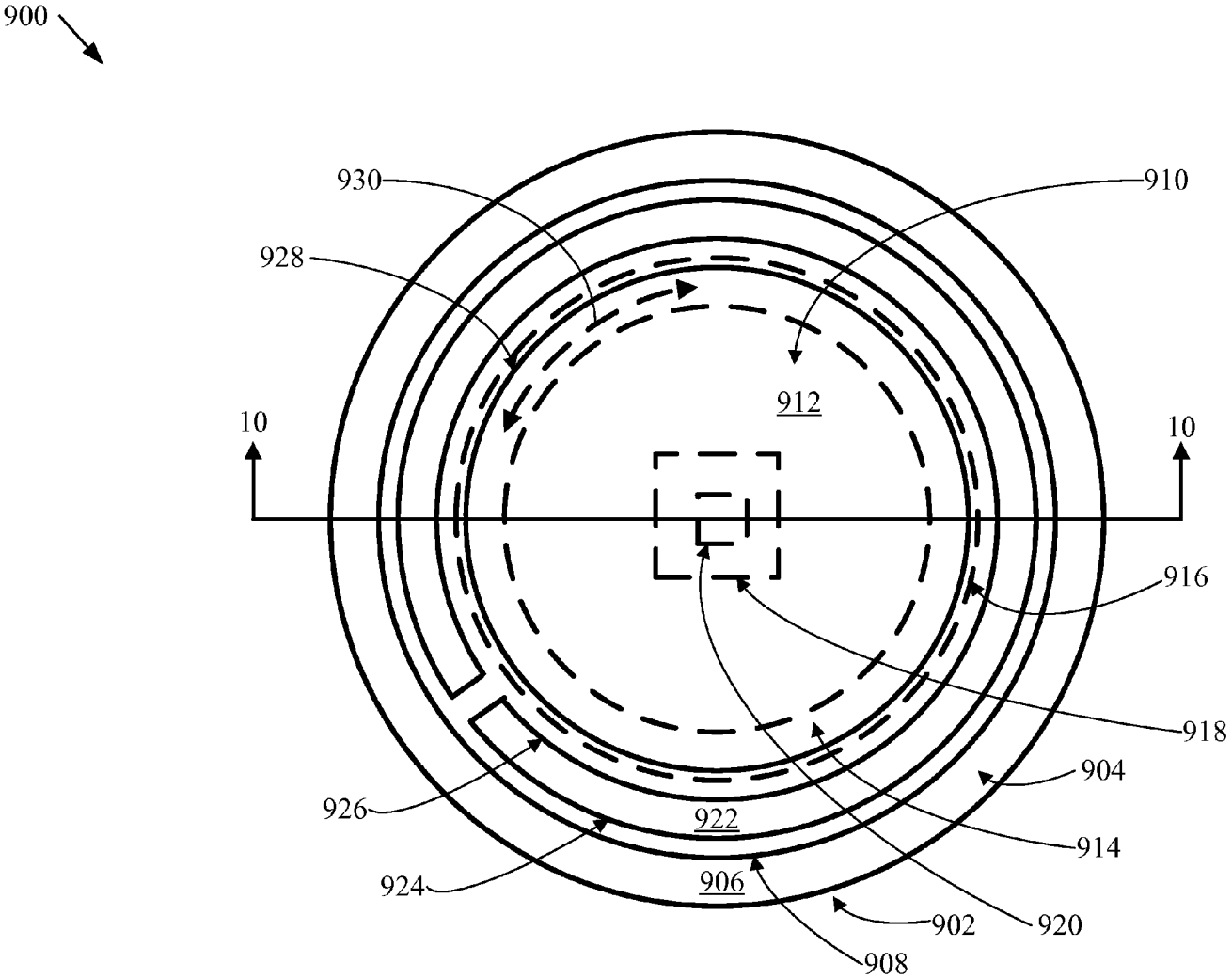
FIG. 9 is a top view showing another example [900] of an implementation of the lighting system.
Figure 10:
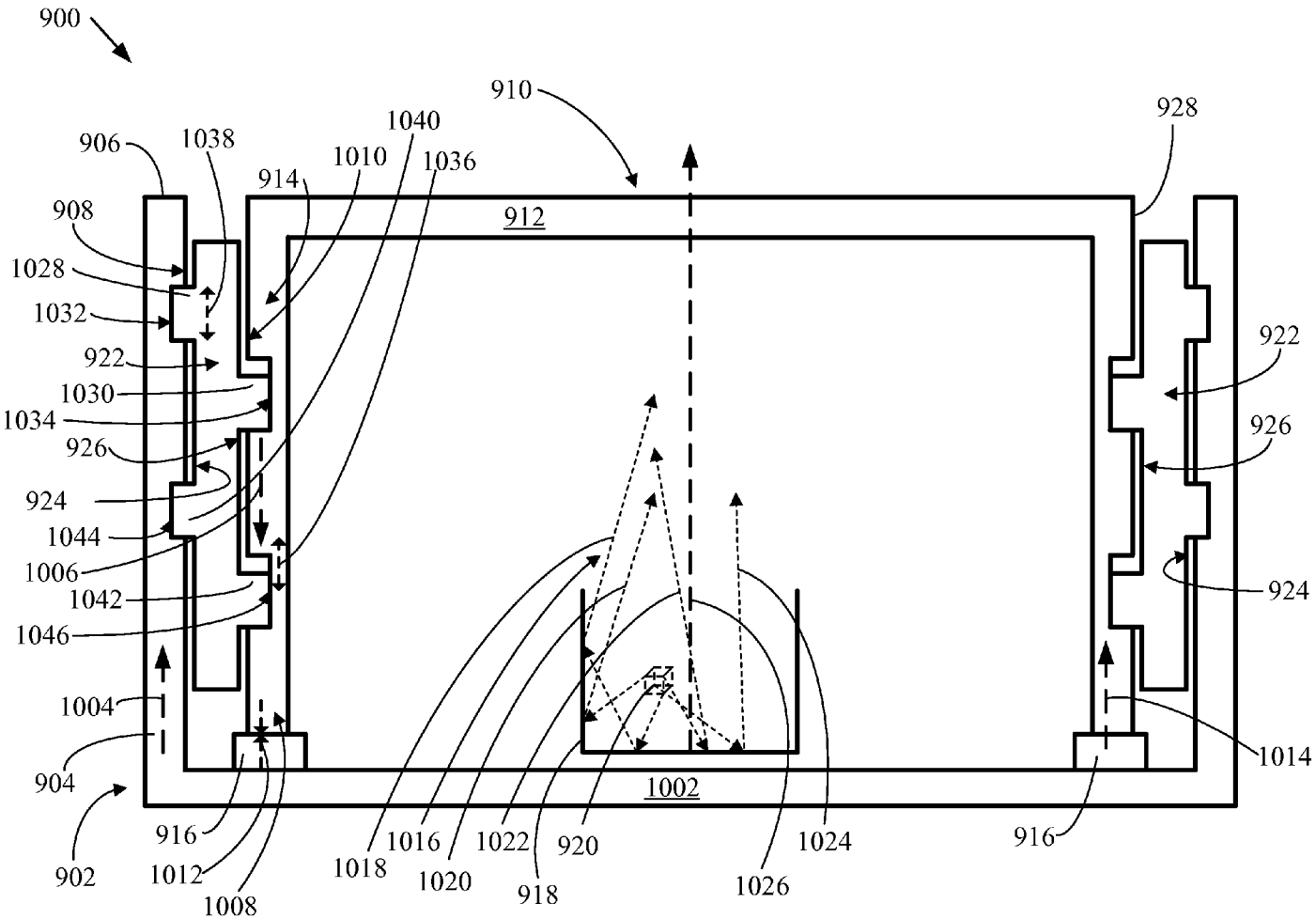
FIG. 10 is a cross-sectional side view taken along the line 10-10, showing the another example [900] of the lighting system.

FIG. 9 is a top view showing another example [900] of an implementation of the lighting system. FIG. 10 is a cross-sectional side view taken along the line 10-10, showing the another example [900] of the lighting system. It is understood throughout this specification that an example [900] of a lighting system may include any combination of the features that are discussed herein in connection with the examples [100], [300], [500], [700], [900], [1100], [1300], [1500], [1700], [2000], [2200], [2400] of lighting systems. Accordingly, the entireties of the discussions of the other examples [100], [300], [500], [700], [1100], [1300], [1500], [1700], [2000], [2200], [2400] of lighting systems are hereby incorporated in this discussion of the examples [900] of the lighting systems. As shown in FIGS. 9 and 10, the example [900] of the implementation of the lighting system includes a housing [902] having a base plate [1002] and a housing wall [904]. The housing wall [904] projects in an upward direction as represented by an arrow [1004] away from the base plate [1002]. The housing wall [904] has an end [906] and an interior side [908]. The example [900] of the implementation of the lighting system further includes a container [910] in the housing [902]. Further in the example [900] of the implementation of the lighting system, the container [910] has a visible light-transmissive top plate [912] and a container wall [914]. The container wall [914] of the example [900] of the implementation of the lighting system projects in a downward direction represented by an arrow [1006] away from the top plate [912] toward the base plate [1002]. In the example [900] of the implementation of the lighting system, the container wall [914] has an end [1008] and an exterior side [1010]. The example [900] of the implementation of the lighting system additionally includes a gasket [916] interposed between the base plate [1002] and the end [1008] of the container wall [914]. In the example [900] of the implementation of the lighting system, the gasket [916] is configured for forming a seal represented by an arrow [1012] between the container wall [914] and the base plate [1002] to seal the container [910], forming a sealed container as represented by the arrow [1014]. The example [900] of the implementation of the lighting system further includes a lighting module [918] in the container [910]. The lighting module [918] of the example [900] of the implementation of the lighting system includes a semiconductor light-emitting device [920]. In the example [900] of the implementation of the lighting system, the SLED [920] is configured for emitting light emissions [1016] in directions represented by the arrows [1018], [1020], [1022], [1024] along a central light emission axis [1026] toward the top plate [912]. The example [900] of the implementation of the lighting system also includes a rail [922] interposed between the interior side [908] of the housing wall [904] and the exterior side [1010] of the container wall [914]. In the example [900] of the implementation of the lighting system, the rail [922] has a first side [924] facing towards the interior side [908] of the housing wall [904] and a second side [926] facing toward the exterior side [1010] of the container wall [914]. In examples of the example [900] of the lighting system, the rail [922] may be flexible or rigid. As another example of the example [900] of the lighting system, the rail [922] may be arcuately interposed between the interior side [908] of the housing wall [904] and the exterior side [1010] of the container wall [914]. In an additional example of the example [900] of the lighting system, the rail [922] may be a visible light-reflective rail [922]. For example, a visible light-reflective rail [922] may facilitate redirecting some of the light emissions [1016] along the central light emission axis [1026] toward the top plate [912]. As examples of the example [900] of the lighting system, the top plate [912] may be a visible light-transparent top plate [912], or may be a visible light-translucent top plate [912]. The example [900] of the implementation of the lighting system may also include a first raised region [1028] forming a part of the first side [924] of the rail [922], and may include a second raised region [1030] forming a part of the second side [926] of the rail [922]. In the examples [900] of the implementation of the lighting system, the first raised region [1028] may be configured for limiting movement of the rail [922] away from the base plate [1002] along the upward direction represented by the arrow [1004]; and the second raised region [1030] may be configured for limiting movement of the container wall [914] away from the base plate [1002] along the upward direction represented by the arrow [1004]. In an example of this example [900] of the implementation of the lighting system, the interior side [908] of the housing wall [904] may include a first recess [1032] configured for receiving the first raised region [1028], and the exterior side [1010] of the container wall [914] may include a second recess [1034] for receiving the second raised region [1030]. In another example of this example [900] of the implementation of the lighting system, the second recess [1034] may be configured for permitting movement of the container wall [1010] through a selected distance represented by an arrow [1036] along the upward direction [1004] and along the downward direction [1006] with the second raised region [1030] being received in the second recess [1034]. For example, the second recess [1034] of this example of the example [900] of the implementation of the lighting system may have a greater length in the directions of the arrow [1034] than a thickness, being represented by an arrow [1038], of the second raised region [1030]. In a further example of this example [900] of the implementation of the lighting system, the first recess [1032] may be configured for permitting movement of the rail [922] through a selected distance represented by the arrow [1036] along the upward direction [1004] and along the downward direction [1006] with the first raised region [1028] being received in the first recess [1032]. In further examples, the example [900] of the implementation of the lighting system may include another raised region [1040] forming a part of the first side [924] of the rail [922]; and may include an additional raised region [1042] forming a part of the second side [926] of the rail [922]. Further, for example, the interior side [908] of the housing wall [904] may include a third recess [1044] configured for receiving the another raised region [1040], and the exterior side [1010] of the container wall [914] may include a fourth recess [1046] for receiving the additional raised region [1042]. In further examples of the example [900] of the lighting system, the top plate [912] may have a perimeter [928], and the container wall [914] may project away from the perimeter [928] of the top plate [912]. In another example of the example [900] of the lighting system, the perimeter [928] of the top plate [912] may be a curvilinear perimeter [928]. In additional examples of the example [900] of the lighting system, the perimeter [928] of the top plate [912] may be a circular or elliptical (not shown) perimeter [928]. Further, for example, the second raised region [1030] may be continuous along a direction represented by an arrow [930] around the perimeter [928] of the top plate [912]. In additional examples of the example [900] of the lighting system, the second raised region [1030] may be, or may include, a raised rib being continuous along the direction [930] around the perimeter [928] of the top plate [912]. Further, for example, the first raised region [1028] may be continuous along the direction [930] around the perimeter [928] of the top plate [912]. In additional examples of the example [900] of the lighting system, the first raised region [1028] may be, or may include, a raised rib being continuous along the direction [930] around the perimeter [928] of the top plate [912]. In other examples, the example [900] of the lighting system may include a plurality of the second raised regions [1030] being spaced apart along the direction [930] around the perimeter [928] of the top plate [912]. In further examples, the example [900] of the lighting system may include a plurality of the first raised regions [1028] being spaced apart along the direction [930] around the perimeter [928] of the top plate [912]. In examples of the example [900] of the implementation of the lighting system, the rail [922] may be configured for compressing, in the directions of the arrow [1012], a portion of the gasket [916] between the base plate [1002] and the end [1008] of the container wall [914]. Further, for example, the example [900] of the implementation of the lighting system may be configured for compressing the rail [922] between the first raised region [1028] and the second raised region [1030]. In examples of the example [900] of the implementation of the lighting system, the gasket [916] may be configured for forming the seal represented by an arrow [1012] between the end [1008] of the container wall [914] and the base plate [1002] as being water-resistant, forming the container [910] as being a water-resistant sealed container as represented by the arrow [1014].

Figure 11:
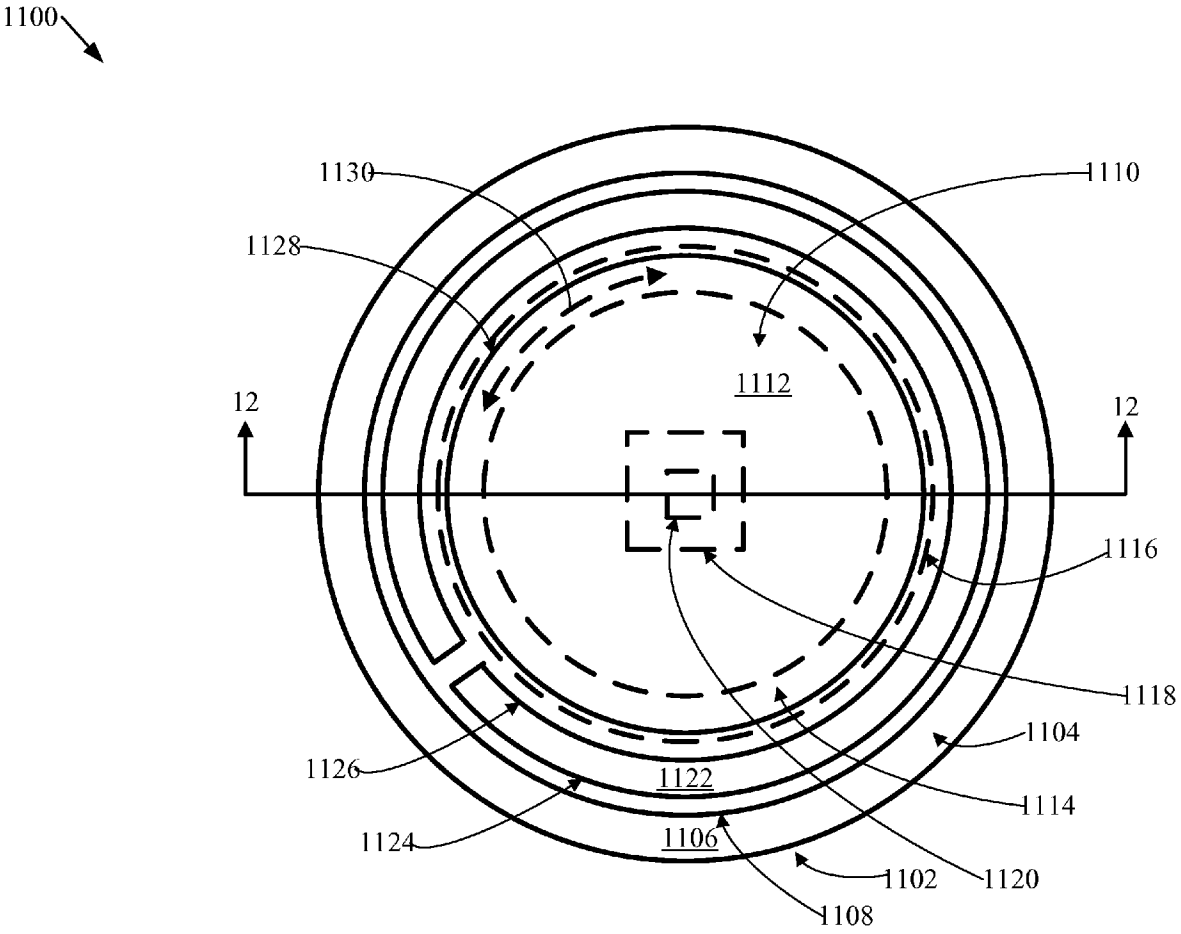
FIG. 11 is a top view showing a further example [1100] of an implementation of the lighting system.
Figure 12:
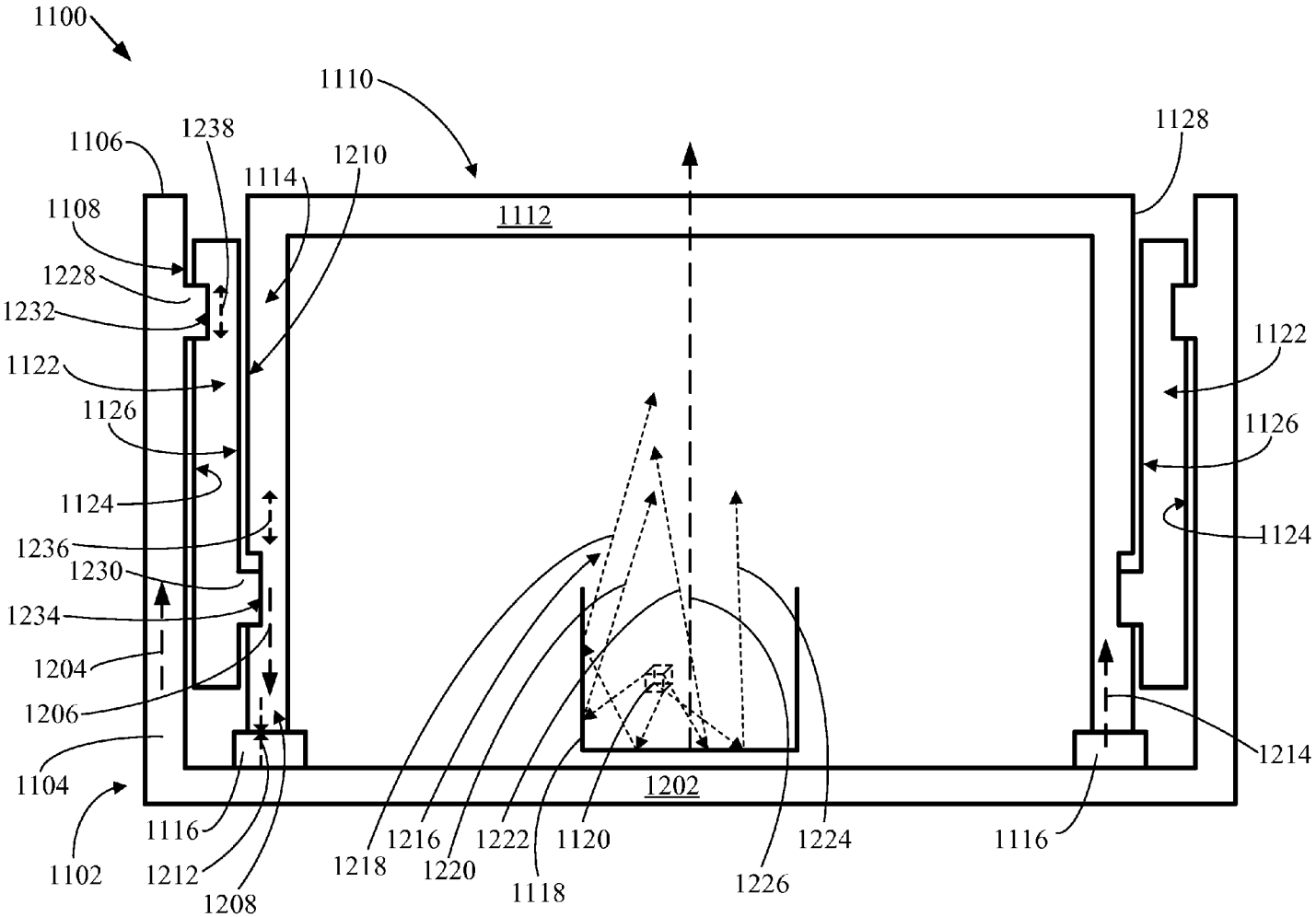
FIG. 12 is a cross-sectional side view taken along the line 12-12, showing the another example [1100] of the lighting system.

FIG. 11 is a top view showing a further example [1100] of an implementation of the lighting system. FIG. 12 is a cross-sectional side view taken along the line 12-12, showing the another example [1100] of the lighting system. It is understood throughout this specification that an example [1100] of a lighting system may include any combination of the features that are discussed herein in connection with the examples [100], [300], [500], [700], [900], [1100], [1300], [1500], [1700], [2000], [2200], [2400] of lighting systems. Accordingly, the entireties of the discussions of the other examples [100], [300], [500], [700], [900], [1300], [1500], [1700], [2000], [2200], [2400] of lighting systems are hereby incorporated in this discussion of the examples [1100] of the lighting systems. As shown in FIGS. 11 and 12, the example [1100] of the implementation of the lighting system includes a housing [1102] having a base plate [1202] and a housing wall [1104]. The housing wall [1104] projects in an upward direction as represented by an arrow [1204] away from the base plate [1202]. The housing wall [1104] has an end [1106] and an interior side [1108]. The example [1100] of the implementation of the lighting system further includes a container [1110] in the housing [1102]. Further in the example [1100] of the implementation of the lighting system, the container [1110] has a visible light-transmissive top plate [1112] and a container wall [1114]. The container wall [1114] of the example [1100] of the implementation of the lighting system projects in a downward direction represented by an arrow [1206] away from the top plate [1112] toward the base plate [1202]. In the example [1100] of the implementation of the lighting system, the container wall [1114] has an end [1208] and an exterior side [1210]. The example [1100] of the implementation of the lighting system additionally includes a gasket [1116] interposed between the base plate [1202] and the end [1208] of the container wall [1114]. In the example [1100] of the implementation of the lighting system, the gasket [1116] is configured for forming a seal represented by an arrow [1212] between the container wall [1114] and the base plate [1202] to seal the container [1110], forming a sealed container as represented by the arrow [1214]. The example [1100] of the implementation of the lighting system further includes a lighting module [1118] in the container [1110]. The lighting module [1118] of the example [1100] of the implementation of the lighting system includes a semiconductor light-emitting device [1120]. In the example [1100] of the implementation of the lighting system, the SLED [1120] is configured for emitting light emissions [1216] in directions represented by the arrows [1218], [1220], [1222], [1224] along a central light emission axis [1226] toward the top plate [1112]. The example [1100] of the implementation of the lighting system also includes a rail [1122] interposed between the interior side [1108] of the housing wall [1104] and the exterior side [1210] of the container wall [1114]. In the example [1100] of the implementation of the lighting system, the rail [1122] has a first side [1124] facing towards the interior side [1108] of the housing wall [1104] and a second side [1126] facing toward the exterior side [1210] of the container wall [1114]. In examples of the example [1100] of the lighting system, the rail [1122] may be flexible or rigid. As another example of the example [1100] of the lighting system, the rail [1122] may be arcuately interposed between the interior side [1108] of the housing wall [1104] and the exterior side [1210] of the container wall [1114]. In an additional example of the example [1100] of the lighting system, the rail [1122] may be a visible light-reflective rail [1122]. For example, a visible light-reflective rail [1122] may facilitate redirecting some of the light emissions [1216] along the central light emission axis [1226] toward the top plate [1112]. As examples of the example [1100] of the lighting system, the top plate [1112] may be a visible light-transparent top plate [1112], or may be a visible light-translucent top plate [1112]. The example [1100] of the implementation of the lighting system may also include a first raised region [1228] forming a part of the interior side [1108] of the housing wall [1104], and may include a second raised region [1230] forming a part of the second side [1126] of the rail [1122]. In the examples [1100] of the implementation of the lighting system, the first raised region [1228] may be configured for limiting movement of the rail [1122] away from the base plate [1202] along the upward direction represented by the arrow [1204]; and the second raised region [1230] may be configured for limiting movement of the container wall [1114] away from the base plate [1202] along the upward direction represented by the arrow [1204]. In an example of this example [1100] of the implementation of the lighting system, the first side [1124] of the rail [1122] may include a first recess [1232] configured for receiving the first raised region [1228], and the exterior side [1210] of the container wall [1114] may include a second recess [1234] for receiving the second raised region [1230]. In another example of this example [1100] of the implementation of the lighting system, the second recess [1234] may be configured for permitting movement of the container wall [1210] through a selected distance represented by an arrow [1236] along the upward direction [1204] and along the downward direction [1206] with the second raised region [1230] being received in the second recess [1234]. For example, the second recess [1234] of this example of the example [1100] of the implementation of the lighting system may have a greater length in the directions of the arrow [1234] than a thickness, being represented by an arrow [1238], of the second raised region [1230]. In a further example of this example [1100] of the implementation of the lighting system, the first recess [1232] may be configured for permitting movement of the rail [1122] through a selected distance represented by the arrow [1236] along the upward direction [1204] and along the downward direction [1206] with the first raised region [1228] being received in the first recess [1232]. In further examples of the example [1100] of the lighting system, the top plate [1112] may have a perimeter [1128], and the container wall [1114] may project away from the perimeter [1128] of the top plate [1112]. In another example of the example [1100] of the lighting system, the perimeter [1128] of the top plate [1112] may be a curvilinear perimeter [1128]. In additional examples of the example [1100] of the lighting system, the perimeter [1128] of the top plate [1112] may be a circular or elliptical (not shown) perimeter [1128]. Further, for example, the second raised region [1230] may be continuous along a direction represented by an arrow [1130] around the perimeter [1128] of the top plate [1112]. In additional examples of the example [1100] of the lighting system, the second raised region [1230] may be, or may include, a raised rib being continuous along the direction [1130] around the perimeter [1128] of the top plate [1112]. Further, for example, the first raised region [1228] may be continuous along the direction [1130] around the perimeter [1128] of the top plate [1112]. In additional examples of the example [1100] of the lighting system, the first raised region [1228] may be, or may include, a raised rib being continuous along the direction [1130] around the perimeter [1128] of the top plate [1112]. In other examples, the example [1100] of the lighting system may include a plurality of the second raised regions [1230] being spaced apart along the direction [1130] around the perimeter [1128] of the top plate [1112]. In further examples, the example [1100] of the lighting system may include a plurality of the first raised regions [1228] being spaced apart along the direction [1130] around the perimeter [1128] of the top plate [1112]. In examples of the example [1100] of the implementation of the lighting system, the rail [1122] may be configured for compressing, in the directions of the arrow [1212], a portion of the gasket [1116] between the base plate [1202] and the end [1208] of the container wall [1114]. Further, for example, the example [1100] of the implementation of the lighting system may be configured for compressing the rail [1122] between the first raised region [1228] and the second raised region [1230]. In examples of the example [1100] of the implementation of the lighting system, the gasket [1116] may be configured for forming the seal represented by an arrow [1212] between the end [1208] of the container wall [1114] and the base plate [1202] as being water-resistant, forming the container [1110] as being a water-resistant sealed container as represented by the arrow [1214].

Figure 13:
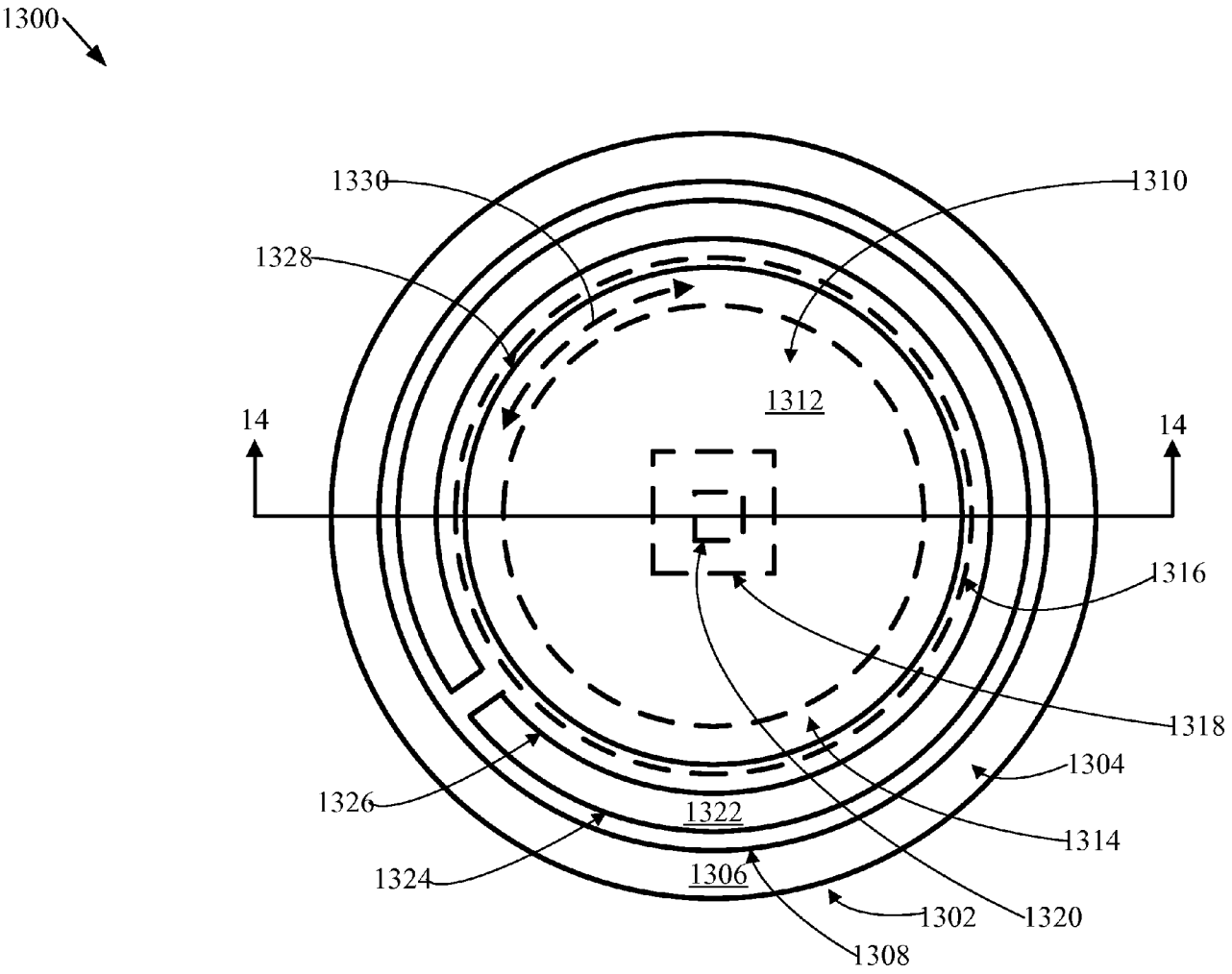
FIG. 13 is a top view showing an additional example [1300] of an implementation of the lighting system.
Figure 14:
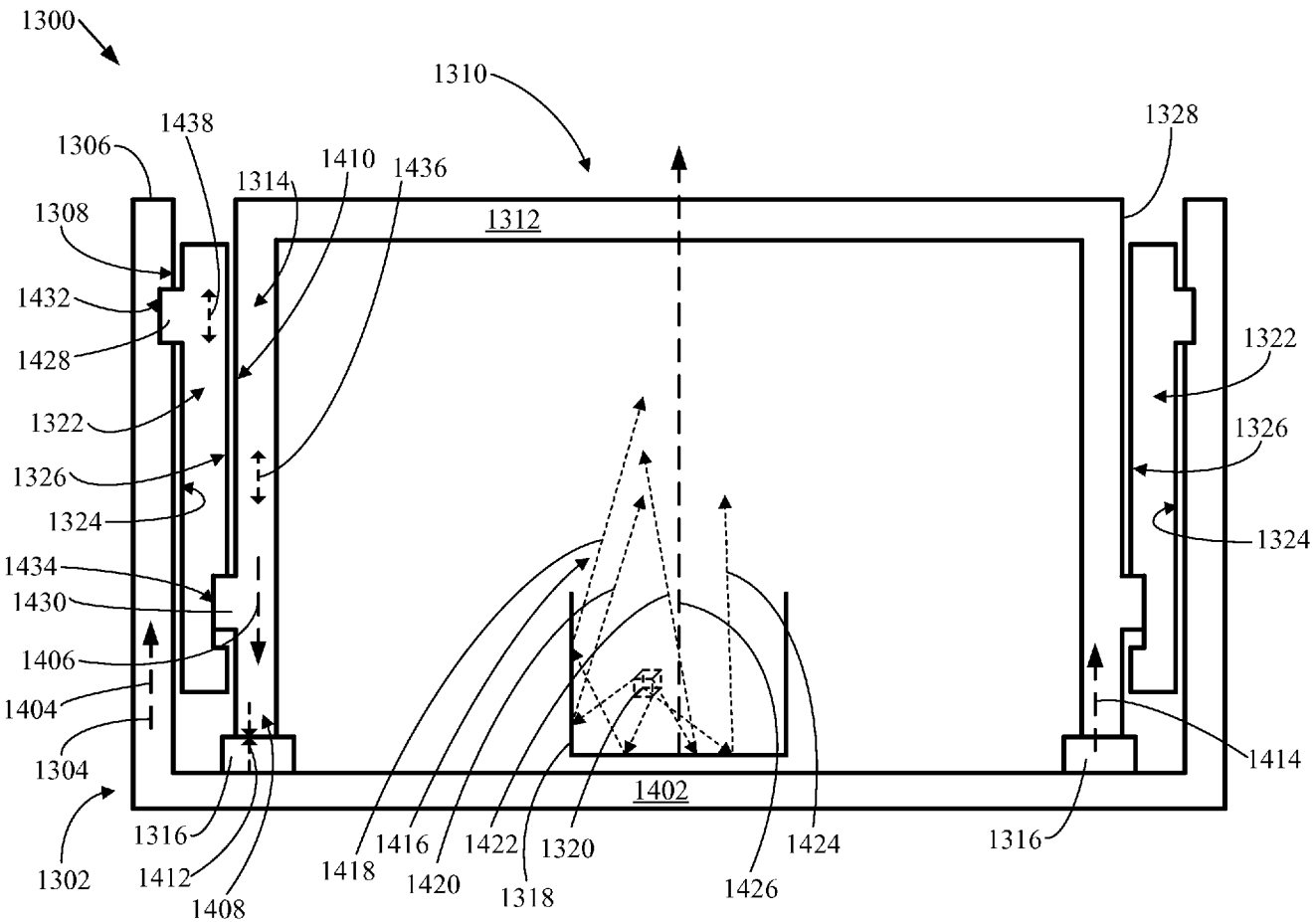
FIG. 14 is a cross-sectional side view taken along the line 14-14, showing the another example [1300] of the lighting system.

FIG. 13 is a top view showing an additional example [1300] of an implementation of the lighting system. FIG. 14 is a cross-sectional side view taken along the line 14-14, showing the another example [1300] of the lighting system. It is understood throughout this specification that an example [1300] of a lighting system may include any combination of the features that are discussed herein in connection with the examples [100], [300], [500], [700], [900], [1100], [1300], [1500], [1700], [2000], [2200], [2400] of lighting systems. Accordingly, the entireties of the discussions of the other examples [100], [300], [500], [700], [900], [1100], [1500], [1700], [2000], [2200], [2400] of lighting systems are hereby incorporated in this discussion of the examples [1300] of the lighting systems. As shown in FIGS. 13 and 14, the example [1300] of the implementation of the lighting system includes a housing [1302] having a base plate [1402] and a housing wall [1304]. The housing wall [1304] projects in an upward direction as represented by an arrow [1404] away from the base plate [1402]. The housing wall [1304] has an end [1306] and an interior side [1308]. The example [1300] of the implementation of the lighting system further includes a container [1310] in the housing [1302]. Further in the example [1300] of the implementation of the lighting system, the container [1310] has a visible light-transmissive top plate [1312] and a container wall [1314]. The container wall [1314] of the example [1300] of the implementation of the lighting system projects in a downward direction represented by an arrow [1406] away from the top plate [1312] toward the base plate [1402]. In the example [1300] of the implementation of the lighting system, the container wall [1314] has an end [1408] and an exterior side [1410]. The example [1300] of the implementation of the lighting system additionally includes a gasket

[1316] interposed between the base plate [1402] and the end [1408] of the container wall [1314]. In the example [1300] of the implementation of the lighting system, the gasket [1316] is configured for forming a seal represented by an arrow [1412] between the container wall [1314] and the base plate [1402] to seal the container [1310], forming a sealed container as represented by the arrow [1414]. The example [1300] of the implementation of the lighting system further includes a lighting module [1318] in the container [1310]. The lighting module [1318] of the example [1300] of the implementation of the lighting system includes a semiconductor light-emitting device [1320]. In the example [1300] of the implementation of the lighting system, the SLED [1320] is configured for emitting light emissions [1416] in directions represented by the arrows [1418], [1420], [1422], [1424] along a central light emission axis [1426] toward the top plate [1312]. The example [1300] of the implementation of the lighting system also includes a rail [1322] interposed between the interior side [1308] of the housing wall [1304] and the exterior side [1410] of the container wall [1314]. In the example [1300] of the implementation of the lighting system, the rail [1322] has a first side [1324] facing towards the interior side [1308] of the housing wall [1304] and a second side [1326] facing toward the exterior side [1410] of the container wall [1314]. In examples of the example [1300] of the lighting system, the rail [1322] may be flexible or rigid. As another example of the example [1300] of the lighting system, the rail [1322] may be arcuately interposed between the interior side [1308] of the housing wall [1304] and the exterior side [1410] of the container wall [1314]. In an additional example of the example [1300] of the lighting system, the rail [1322] may be a visible light-reflective rail [1322]. For example, a visible light-reflective rail [1322] may facilitate redirecting some of the light emissions [1416] along the central light emission axis [1426] toward the top plate [1312]. As examples of the example [1300] of the lighting system, the top plate [1312] may be a visible light-transparent top plate [1312], or may be a visible light-translucent top plate [1312]. The example [1300] of the implementation of the lighting system may also include a first raised region [1428] forming a part of the first side [1324] of the rail [1322], and may include a second raised region [1430] forming a part of the exterior side [1410] of the container wall [1314]. In the examples [1300] of the implementation of the lighting system, the first raised region [1428] may be configured for limiting movement of the rail [1322] away from the base plate [1402] along the upward direction represented by the arrow [1404]; and the second raised region [1430] may be configured for limiting movement of the container wall [1314] away from the base plate [1402] along the upward direction represented by the arrow [1404]. In an example of this example [1300] of the implementation of the lighting system, the interior side [1308] of the housing wall [1304] may include a first recess [1432] configured for receiving the first raised region [1428], and the second side [1326] of the rail [1322] may include a second recess [1434] for receiving the second raised region [1430]. In another example of this example [1300] of the implementation of the lighting system, the second recess [1434] may be configured for permitting movement of the container wall [1314] through a selected distance represented by an arrow [1436] along the upward direction [1404] and along the downward direction [1406] with the second raised region [1430] being received in the second recess [1434]. For example, the second recess [1434] of this example of the example [1300] of the implementation of the lighting system may have a greater length in the directions of the arrow [1434] than a thickness, being represented by an arrow [1438], of the second raised region [1430]. In a further example of this example [1300] of the implementation of the lighting system, the first recess [1432] may be configured for permitting movement of the rail [1322] through a selected distance represented by the arrow [1436] along the upward direction [1404] and along the downward direction [1406] with the first raised region [1428] being received in the first recess [1432]. In further examples of the example [1300] of the lighting system, the top plate [1312] may have a perimeter [1328], and the container wall [1314] may project away from the perimeter [1328] of the top plate [1312]. In another example of the example [1300] of the lighting system, the perimeter [1328] of the top plate [1312] may be a curvilinear perimeter [1328]. In additional examples of the example [1300] of the lighting system, the perimeter [1328] of the top plate [1312] may be a circular or elliptical (not shown) perimeter [1328]. Further, for example, the second raised region [1430] may be continuous along a direction represented by an arrow [1330] around the perimeter [1328] of the top plate [1312]. In additional examples of the example [1300] of the lighting system, the second raised region [1430] may be, or may include, a raised rib being continuous along the direction [1330] around the perimeter [1328] of the top plate [1312]. Further, for example, the first raised region [1428] may be continuous along the direction [1330] around the perimeter [1328] of the top plate [1312]. In additional examples of the example [1300] of the lighting system, the first raised region [1428] may be, or may include, a raised rib being continuous along the direction [1330] around the perimeter [1328] of the top plate [1312]. In other examples, the example [1300] of the lighting system may include a plurality of the second raised regions [1430] being spaced apart along the direction [1330] around the perimeter [1328] of the top plate [1312]. In further examples, the example [1300] of the lighting system may include a plurality of the first raised regions [1428] being spaced apart along the direction [1330] around the perimeter [1328] of the top plate [1312]. In examples of the example [1300] of the implementation of the lighting system, the rail [1322] may be configured for compressing, in the directions of the arrow [1412], a portion of the gasket [1316] between the base plate [1402] and the end [1408] of the container wall [1314]. Further, for example, the example [1300] of the implementation of the lighting system may be configured for compressing the rail [1322] between the first raised region [1428] and the second raised region [1430]. In examples of the example [1300] of the implementation of the lighting system, the gasket [1316] may be configured for forming the seal represented by an arrow [1412] between the end [1408] of the container wall [1314] and the base plate [1402] as being water-resistant, forming the container [1310] as being a water-resistant sealed container as represented by the arrow [1414].

Figure 15:
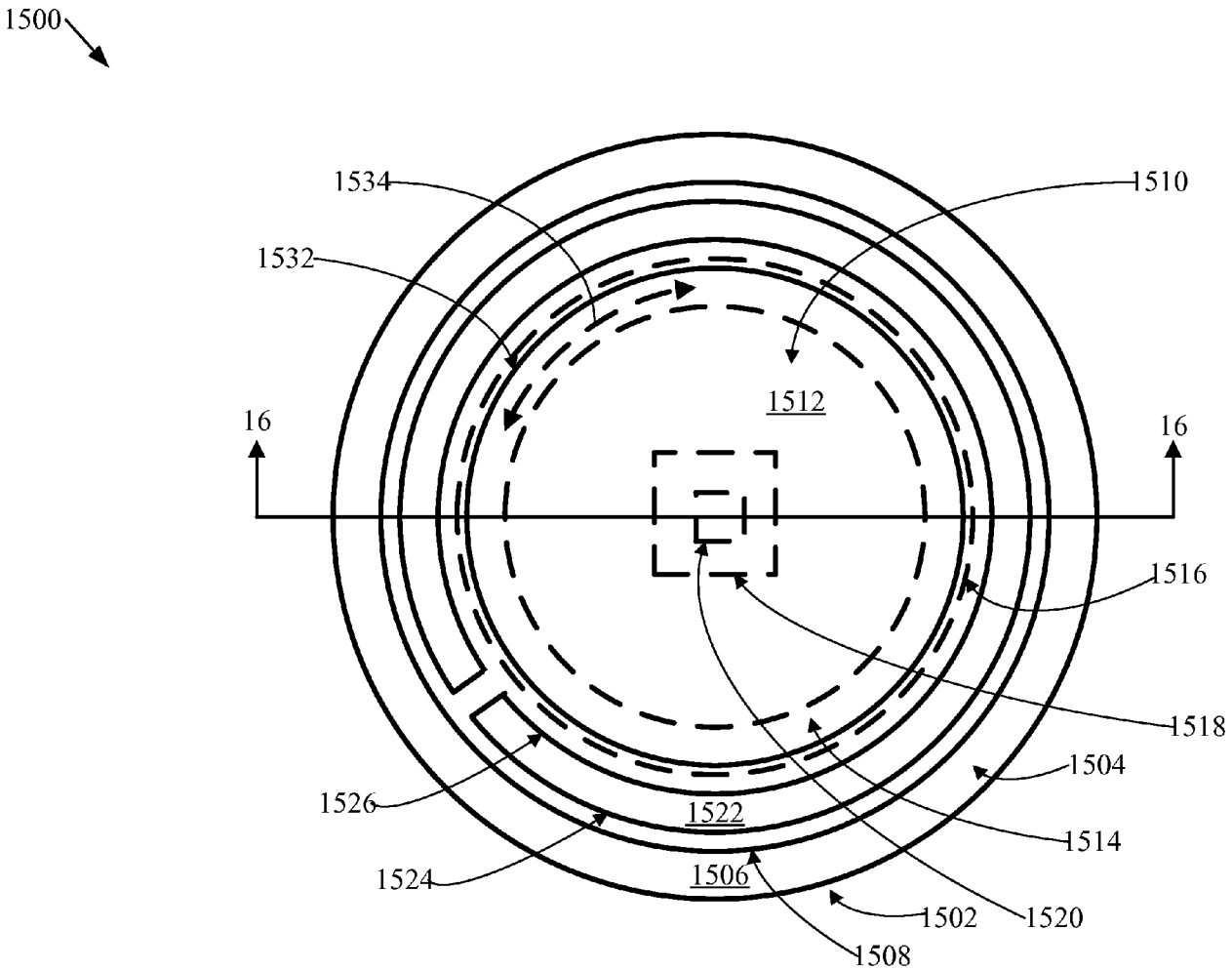
FIG. 15 is a top view showing another example [1500] of an implementation of the lighting system.
Figure 16:
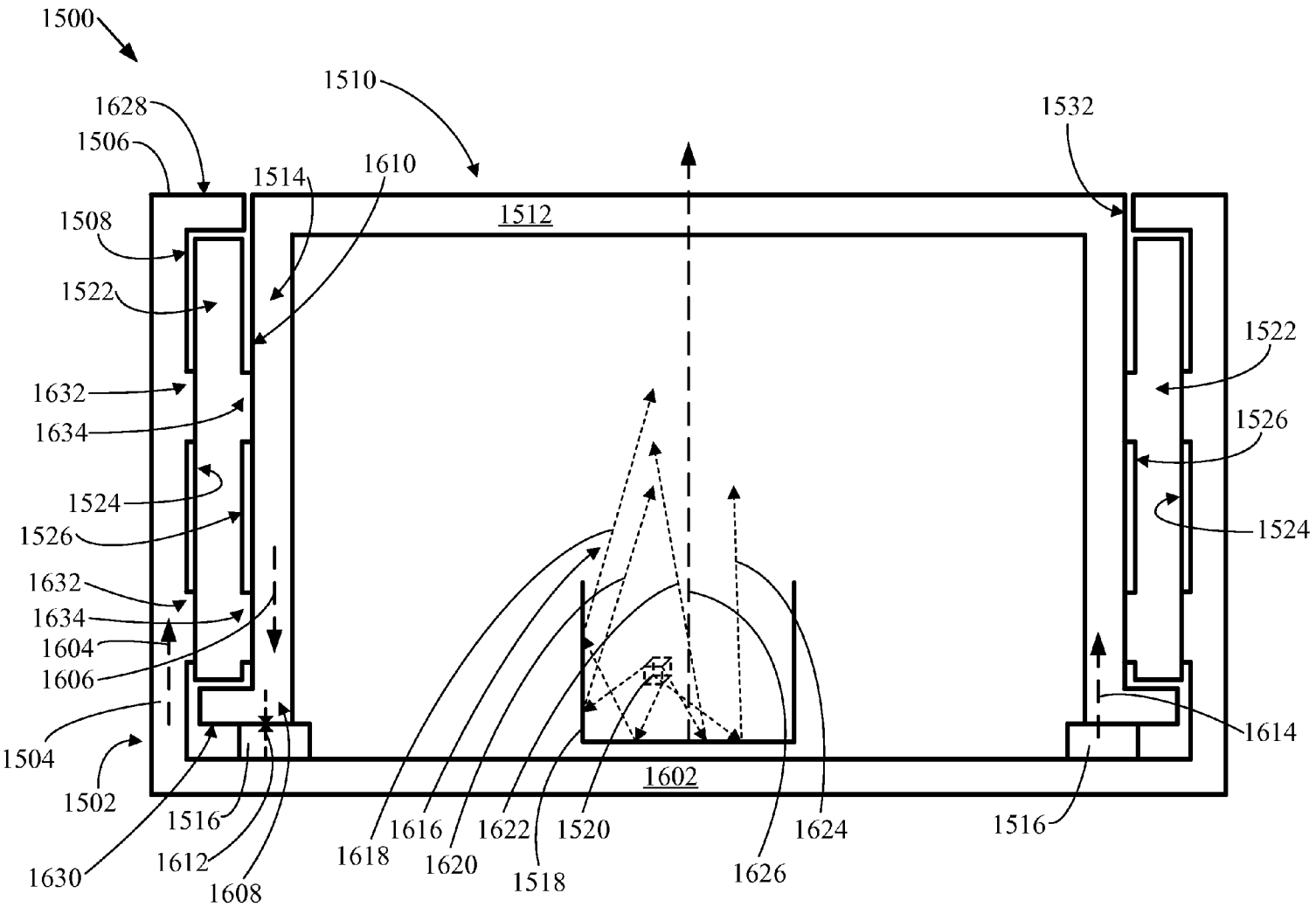
FIG. 16 is a cross-sectional side view taken along the line 16-16, showing the another example [1500] of the lighting system.

FIG. 15 is a top view showing another example [1500] of an implementation of the lighting system. FIG. 16 is a cross-sectional side view taken along the line 16-16, showing the another example [1500] of the lighting system. It is understood throughout this specification that an example [1500] of a lighting system may include any combination of the features that are discussed herein in connection with the examples [100], [300], [500], [700], [900], [1100], [1300], [1500], [1700], [2000], [2200], [2400] of lighting systems. Accordingly, the entireties of the discussions of the other examples [100], [300], [500], [700], [900], [1100], [1300], [1700], [2000], [2200], [2400] of lighting systems are hereby incorporated in this discussion of the examples

[1500] of the lighting systems. As shown in FIGS. 15 and 16, the example [1500] of the implementation of the lighting system includes a housing [1502] having a base plate [1602] and a housing wall [1504]. The housing wall [1504] projects in an upward direction as represented by an arrow [1604] away from the base plate [1602]. The housing wall [1504] has an end [1506] and an interior side [1508]. The example [1500] of the implementation of the lighting system further includes a container [1510] in the housing [1502]. Further in the example [1500] of the implementation of the lighting system, the container [1510] has a visible light-transmissive top plate [1512] and a container wall [1514]. The container wall [1514] of the example [1500] of the implementation of the lighting system projects in a downward direction represented by an arrow [1606] away from the top plate [1512] toward the base plate [1602]. In the example [1500] of the implementation of the lighting system, the container wall [1514] has an end [1608] and an exterior side [1610]. The example [1500] of the implementation of the lighting system additionally includes a gasket [1516] interposed between the base plate [1602] and the end [1608] of the container wall [1514]. In the example [1500] of the implementation of the lighting system, the gasket [1516] is configured for forming a seal represented by an arrow [1612] between the container wall [1514] and the base plate [1602] to seal the container [1510], forming a sealed container as represented by the arrow [1614]. The example [1500] of the implementation of the lighting system further includes a lighting module [1518] in the container [1510]. The lighting module [1518] of the example [1500] of the implementation of the lighting system includes a semiconductor light-emitting device [1520]. In the example [1500] of the implementation of the lighting system, the SLED [1520] is configured for emitting light emissions [1616] in directions represented by the arrows [1618], [1620], [1622], [1624] along a central light emission axis [1626] toward the top plate [1512]. The example [1500] of the implementation of the lighting system also includes a rail [1522] interposed between the interior side [1508] of the housing wall [1504] and the exterior side [1610] of the container wall [1514]. In the example [1500] of the implementation of the lighting system, the rail [1522] has a first side [1524] facing towards the interior side [1508] of the housing wall [1504] and a second side [1526] facing toward the exterior side [1610] of the container wall [1514]. In examples of the example [1500] of the lighting system, the rail [1522] may be flexible or rigid. As another example of the example [1500] of the lighting system, the rail [1522] may be arcuately interposed between the interior side [1508] of the housing wall [1504] and the exterior side [1610] of the container wall [1514]. In an additional example of the example [1500] of the lighting system, the rail [1522] may be a visible light-reflective rail [1522]. For example, a visible light-reflective rail [1522] may facilitate redirecting some of the light emissions [1616] along the central light emission axis [1626] toward the top plate [1512]. As examples of the example [1500] of the lighting system, the top plate [1512] may be a visible light-transparent top plate [1512], or may be a visible light-translucent top plate [1512]. The example [1500] of the implementation of the lighting system may also include a first raised region [1628] located at the end [1506] of and forming a part of the interior side [1508] of the housing wall [1504], and may include a second raised region [1630] located at the end [1608] of and forming a part of the exterior side [1610] of the container wall [1514]. In further examples of the example [1500] of the lighting system, the top plate [1512] may have a perimeter [1532], and the container wall [1514] may project away from the perimeter [1532] of the top plate [1512]. In another example of the example [1500] of the lighting system, the perimeter [1528] of the top plate [1512] may be a curvilinear perimeter [1528]. In additional examples of the example [1500] of the lighting system, the perimeter [1528] of the top plate [1512] may be a circular or elliptical (not shown) perimeter [1528]. Further, for example, the second raised region [1630] may be continuous along a direction represented by an arrow [1534] around the perimeter [1532] of the top plate [1512]. In additional examples of the example [1500] of the lighting system, the second raised region [1630] may be, or may include, a raised rib being continuous along the direction [1534] around the perimeter [1532] of the top plate [1512]. Further, for example, the first raised region [1628] may be continuous along the direction [1534] around the perimeter [1532] of the top plate [1512]. In additional examples of the example [1500] of the lighting system, the first raised region [1628] may be, or may include, a raised rib being continuous along the direction [1534] around the perimeter [1532] of the top plate [1512]. In additional examples, this example [1500] of the implementation of the lighting system may include a plurality of raised ridges [1632] forming a part of the interior side [1508] of the housing wall [1504], or may include a plurality of raised ridges (not shown) forming a part of the first side [1624] of the rail [1522], and the plurality of the raised ridges [1632] may be configured for spacing the first side [1624] of the rail [1522] apart from the interior side [1508] of the housing wall [1504]. As further examples, this example [1500] of the example of the implementation of the lighting system may include another plurality of raised ridges [1634] forming a part of the second side [1626] of the rail [1522], or may include another plurality of raised ridges (not shown) forming a part of the exterior side [1610] of the container wall [1514], and the another plurality of the raised ridges [1634] may be configured for spacing the second side [1626] of the rail [1522] apart from the exterior side [1610] of the container wall [1514]. In examples of the example [1500] of the implementation of the lighting system, the rail [1522] may be configured for compressing, in the directions of the arrow [1612], a portion of the gasket [1516] between the base plate [1602] and the end [1608] of the container wall [1514]. Further, for example, the example [1500] of the implementation of the lighting system may be configured for compressing the rail [1522] between the first raised region [1628] and the second raised region [1630]. In examples of the example [1500] of the implementation of the lighting system, the gasket [1516] may be configured for forming the seal represented by an arrow [1612] between the end [1608] of the container wall [1514] and the base plate [1602] as being water-resistant, forming the container [1510] as being a water-resistant sealed container as represented by the arrow [1614].

Figure 17:
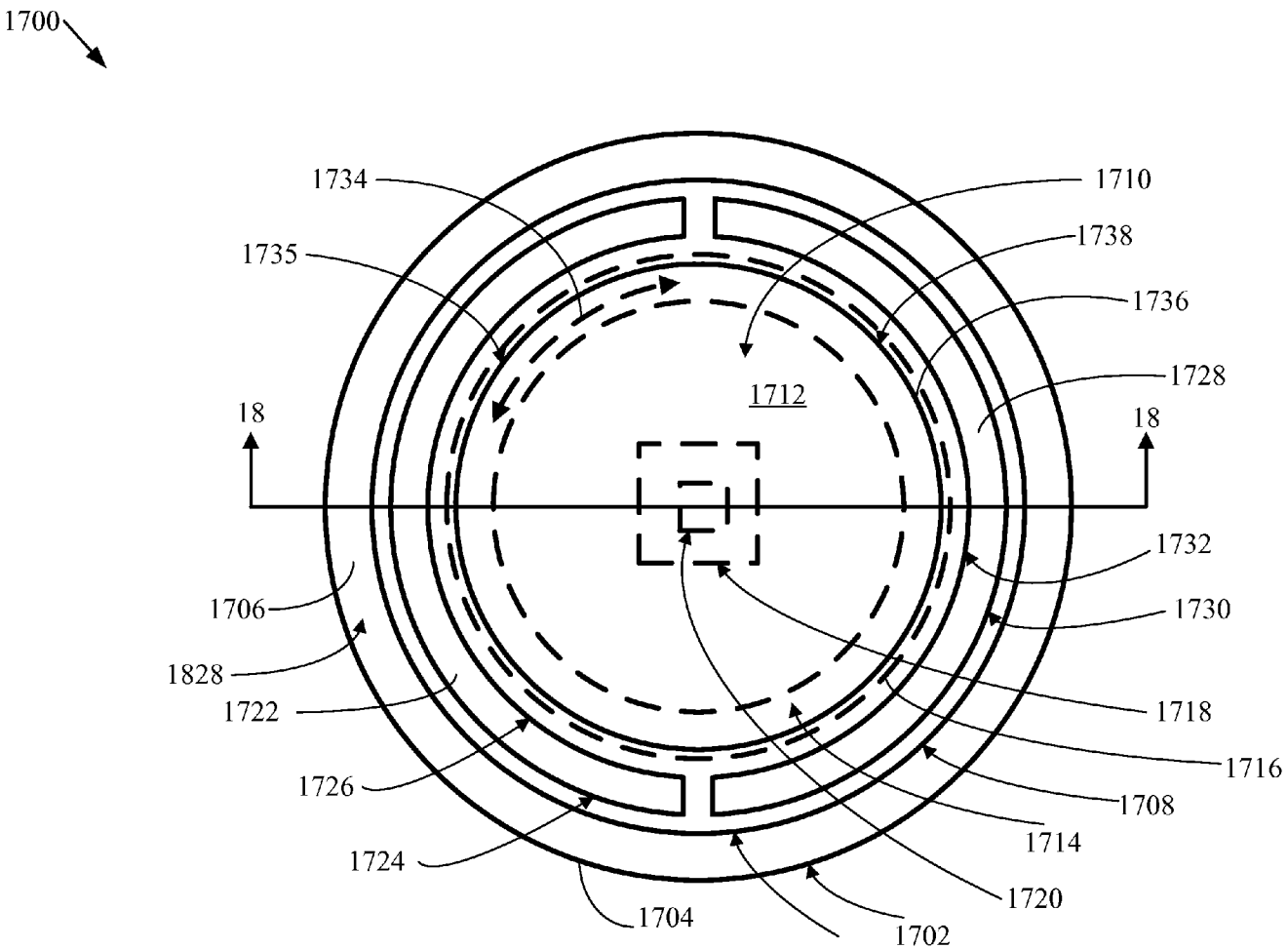
FIG. 17 is a top view showing a further example [1700] of an implementation of the lighting system.
Figure 18:
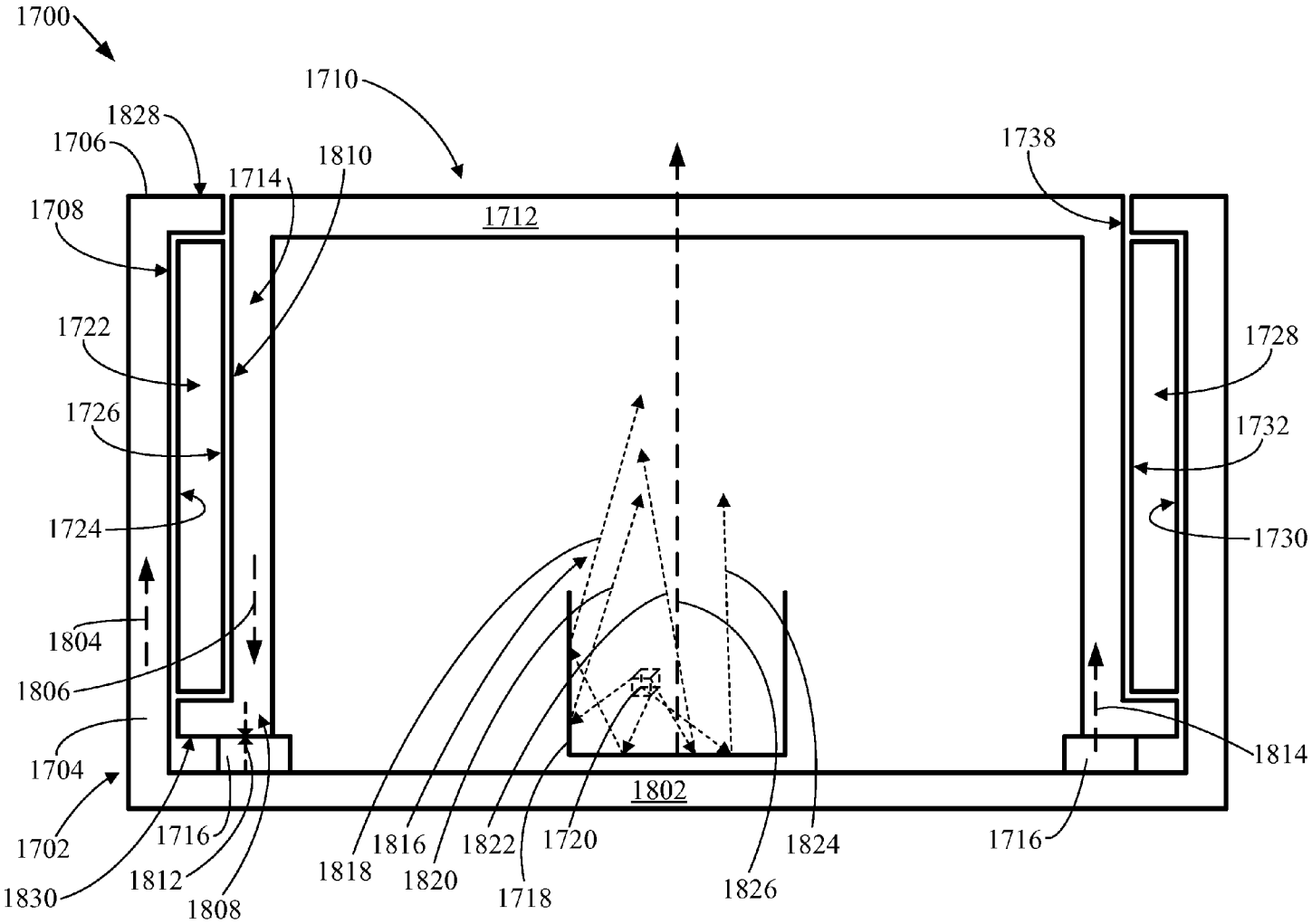
FIG. 18 is a cross-sectional side view taken along the line 18-18, showing the another example [1700] of the lighting system.
Figure 19:
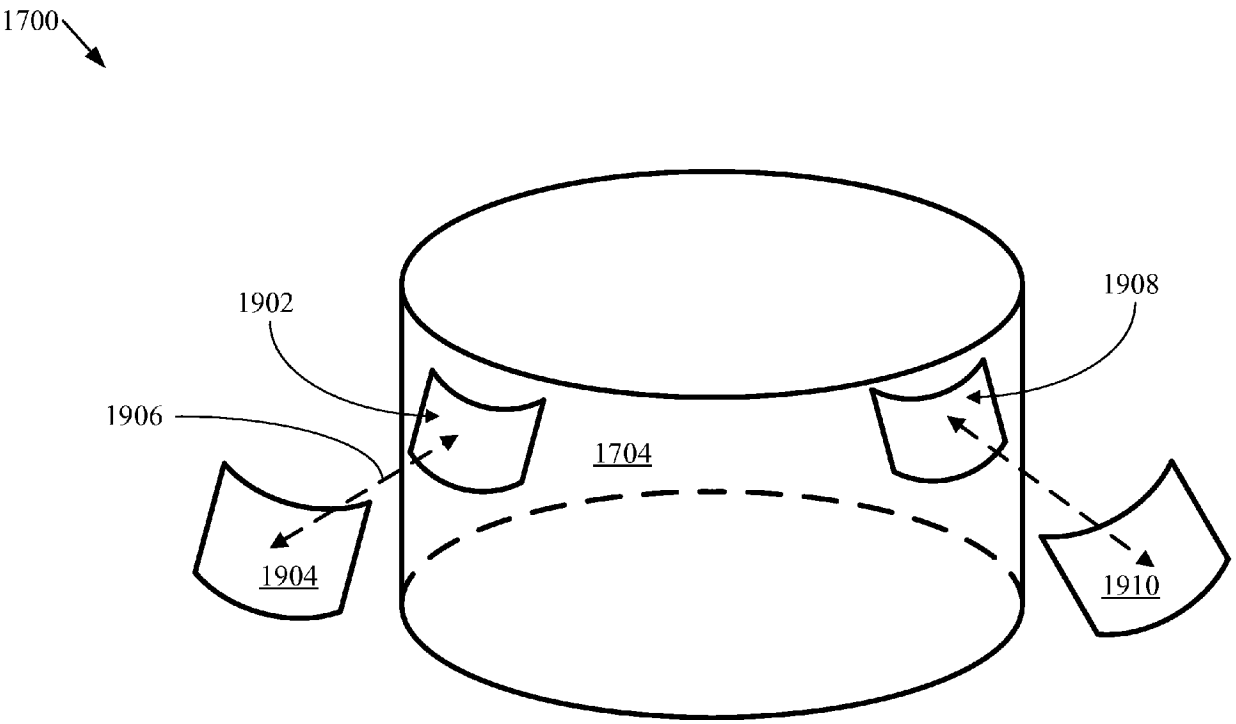
FIG. 19 is a perspective view of the another example [1700] of the implementation of the lighting system.

FIG. 17 is a top view showing a further example [1700] of an implementation of the lighting system. FIG. 18 is a cross-sectional side view taken along the line 18-18, showing the another example [1700] of the lighting system. FIG. 19 is a perspective view of the another example [1700] of the implementation of the lighting system. It is understood throughout this specification that an example [1700] of a lighting system may include any combination of the features that are discussed herein in connection with the examples [100], [300], [500], [700], [900], [1100], [1300], [1500], [1700], [2000], [2200], [2400] of lighting systems. Accordingly, the entireties of the discussions of the other examples [100], [300], [500], [700], [900], [1100], [1300], [1500], [2000], [2200], [2400] of lighting systems are hereby incorporated in this discussion of the examples [1700] of the lighting systems. As shown in FIGS. 17, 18 and 19, the example [1700] of the implementation of the lighting system includes a housing [1702] having a base plate [1802] and a housing wall [1704]. The housing wall [1704] projects in an upward direction as represented by an arrow [1804] away from the base plate [1802]. The housing wall [1704] has an end [1706] and an interior side [1708]. The example [1700] of the implementation of the lighting system further includes a container [1710] in the housing [1702]. Further in the example [1700] of the implementation of the lighting system, the container [1710] has a visible light-transmissive top plate [1712] and a container wall [1714]. The container wall [1714] of the example [1700] of the implementation of the lighting system projects in a downward direction represented by an arrow [1806] away from the top plate [1712] toward the base plate [1802]. In the example [1700] of the implementation of the lighting system, the container wall [1714] has an end [1808] and an exterior side [1810]. The example [1700] of the implementation of the lighting system additionally includes a gasket [1716] interposed between the base plate [1802] and the end [1808] of the container wall [1714]. In the example [1700] of the implementation of the lighting system, the gasket [1716] is configured for forming a seal represented by an arrow [1812] between the container wall [1714] and the base plate [1802] to seal the container [1710], forming a sealed container as represented by the arrow [1814]. The example [1700] of the implementation of the lighting system further includes a lighting module [1718] in the container [1710]. The lighting module [1718] of the example [1700] of the implementation of the lighting system includes a semiconductor light-emitting device [1720]. In the example [1700] of the implementation of the lighting system, the SLED [1720] is configured for emitting light emissions [1816] in directions represented by the arrows [1818], [1820], [1822], [1824] along a central light emission axis [1826] toward the top plate [1712]. The example [1700] of the implementation of the lighting system also includes a rail [1722] interposed between the interior side [1708] of the housing wall [1704] and the exterior side [1810] of the container wall [1714]. In the example [1700] of the implementation of the lighting system, the rail [1722] has a first side [1724] facing towards the interior side [1708] of the housing wall [1704] and a second side [1726] facing toward the exterior side [1810] of the container wall [1714]. In examples of the example [1700] of the lighting system, the rail [1722] may be flexible or rigid. As another example of the example [1700] of the lighting system, the rail [1722] may be arcuately interposed between the interior side [1708] of the housing wall [1704] and the exterior side [1810] of the container wall [1714]. In an additional example of the example [1700] of the lighting system, the rail [1722] may be a visible light-reflective rail [1722]. For example, a visible light-reflective rail [1722] may facilitate redirecting some of the light emissions [1816] along the central light emission axis [1826] toward the top plate [1712]. As examples of the example [1700] of the lighting system, the top plate [1712] may be a visible light-transparent top plate [1712], or may be a visible light-translucent top plate [1712]. The example [1700] of the implementation of the lighting system may also include another rail [1728] interposed between the interior side [1708] of the housing wall [1704] and the exterior side [1810] of the container wall [1714]. In the example [1700] of the implementation of the lighting system, the another rail [1728] may have a first side [1730] facing towards the interior side [1708] of the housing wall [1704] and a second side [1732] facing toward the exterior side [1810] of the container wall [1714]. The example [1700] of the implementation of the lighting system may also include a first raised region [1828] located at the end [1706] of and forming a part of the interior side [1708] of the housing wall [1704], and may include a second raised region [1830] located at the end [1808] of and forming a part of the exterior side [1810] of the container wall [1714]. In the examples [1700] of the implementation of the lighting system, the first raised region [1828] may be configured for limiting movement of the rails [1722], 1728] away from the base plate [1802] along the upward direction represented by the arrow [1804]; and the second raised region [1830] may be configured for limiting movement of the container wall [1714] away from the base plate [1802] along the upward direction represented by the arrow [1804]. In further examples of the example [1700] of the lighting system, the top plate [1712] may have a perimeter [1738], and the container wall [1714] may project away from the perimeter [1738] of the top plate [1712]. In another example of the example [1700] of the lighting system, the perimeter [1728] of the top plate [1712] may be a curvilinear perimeter [1728]. In additional examples of the example [1700] of the lighting system, the perimeter [1728] of the top plate [1712] may be a circular or elliptical (not shown) perimeter [1728]. Further, for example, the rail [1722] may be continuous along a direction represented by an arrow [1734] around a portion [1735] of the perimeter [1738] of the top plate [1712]; and the another rail [1728] may be continuous along the direction [1734] around another portion [1736] of the perimeter [1738] of the top plate [1712]. In another example of the example [1700] of the lighting system, the housing wall [1704] may have an opening [1902] configured for inserting the rails [1722], [1728] into the housing [1702] and for interposing the rails [1722], [1728] between the interior side [1708] of the housing wall [1704] and the exterior side [1810] of the container wall [1714]. Further, for example, the example [1700] of the lighting system may include a cover [1904] for the opening [1902], the cover [1904] being detachable and attachable as represented by the dashed line [1906]. As examples, the cover [1904] may be attached to the housing [1702] by one or more suitable fasteners (not shown), such as hinges, snaps, or screws. In another example of the example [1700] of the lighting system, the housing wall [1704] may have another opening [1908], and each of the openings [1902], [1908] may be configured for inserting a one of the rails [1722], [1728] into the housing [1702]. Further, for example, the example [1700] of the lighting system may include another cover [1910] for the opening [1908], being likewise detachable and attachable to the housing [1702]. In examples of the example [1700] of the implementation of the lighting system, each of the rails [1722], [1728] may be configured for compressing, in the directions of the arrow [1812], a portion of the gasket [1716] between the base plate [1802] and the end [1808] of the container wall [1714]. Further, for example, the example [1700] of the implementation of the lighting system may be configured for compressing the rails [1722], [1728] between the first raised region [1828] and the second raised region [1830]. In examples of the example [1700] of the implementation of the lighting system, the gasket [1716] may be configured for forming the seal represented by an arrow [1812] between the end [1808] of the container wall [1714] and the base plate [1802] as being water-resistant, forming the container [1710] as being a water-resistant sealed container as represented by the arrow [1814].

Figure 20:
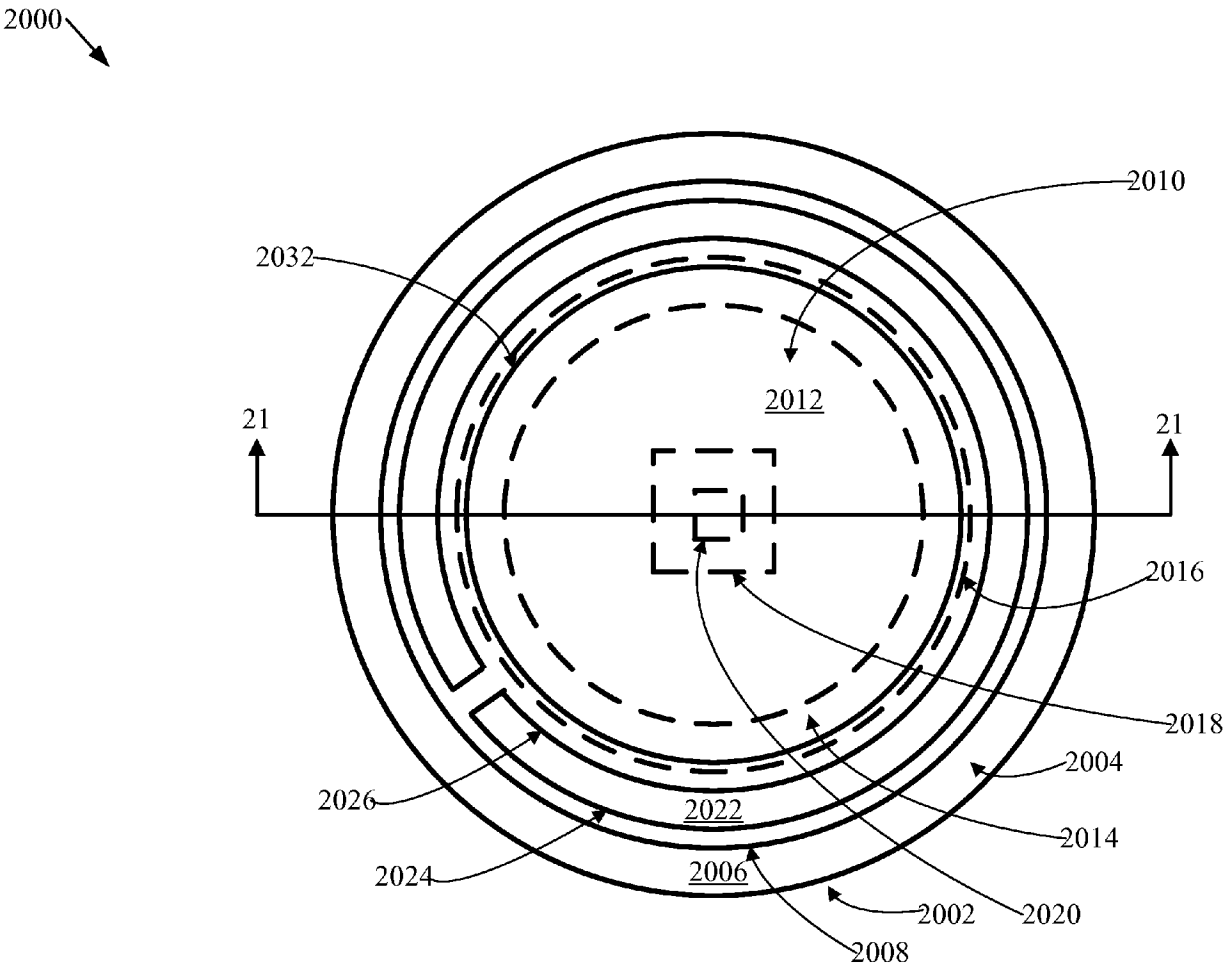
FIG. 20 is a top view showing an additional example [2000] of an implementation of the lighting system.
Figure 21:
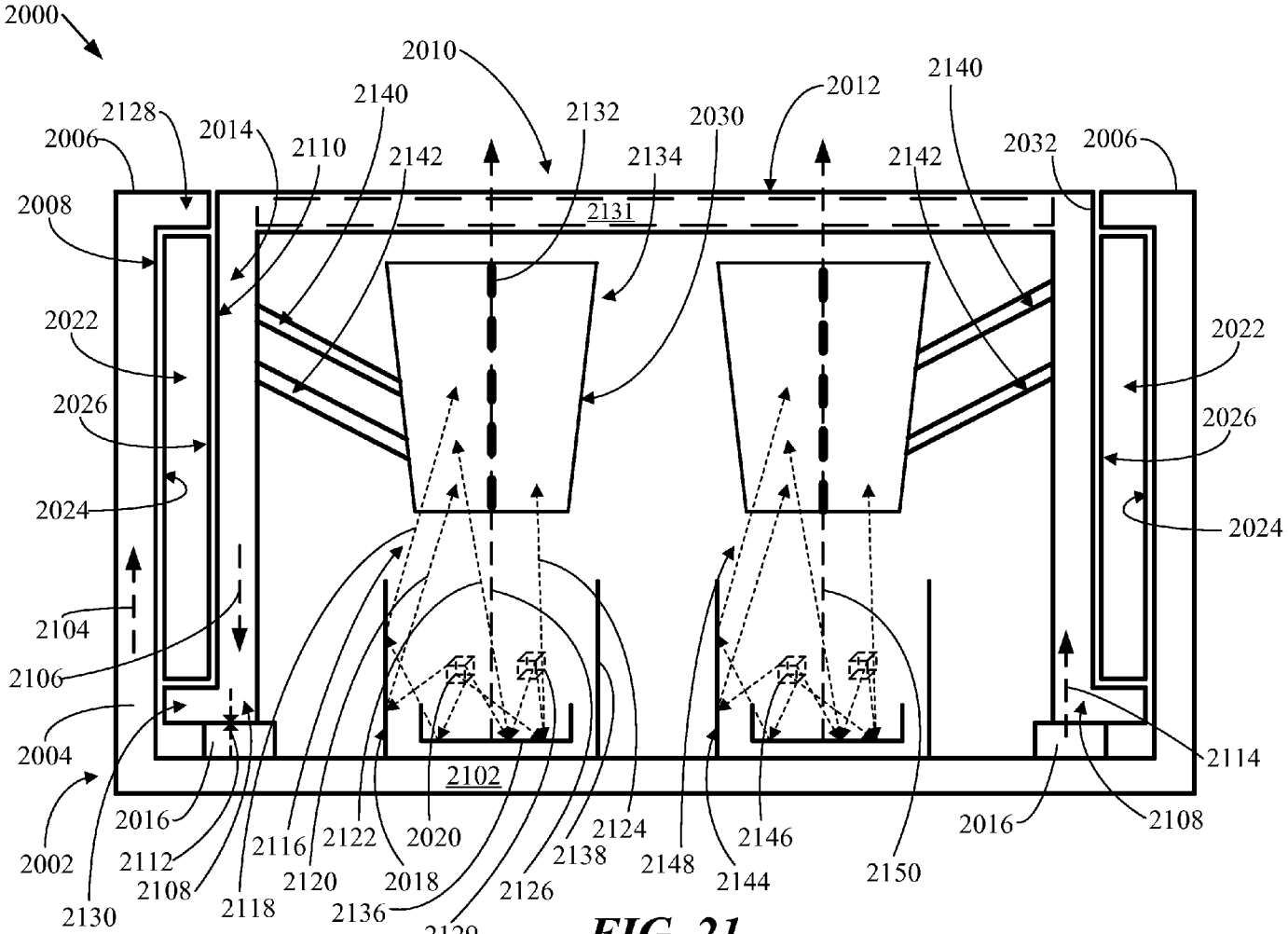
FIG. 21 is a cross-sectional side view taken along the line 21-21, showing the another example [2000] of the lighting system.

FIG. 20 is a top view showing an additional example [2000] of an implementation of the lighting system. FIG. 21 is a cross-sectional side view taken along the line 21-21, showing the another example [2000] of the lighting system. It is understood throughout this specification that an example [2000] of a lighting system may include any combination of the features that are discussed herein in connection with the examples [100], [300], [500], [700], [900], [1100], [1300], [1500], [1700], [2000], [2200], [2400] of lighting systems. Accordingly, the entireties of the discussions of the other examples [100], [300], [500], [700], [900], [1100], [1300], [1500], [1700], [2000], [2400] of lighting systems are hereby incorporated in this discussion of the examples [2000] of the lighting systems. As shown in FIGS. 20 and 21, the example [2000] of the implementation of the lighting system includes a housing [2002] having a base plate [2102] and a housing wall [2004]. The housing wall [2004] projects in an upward direction as represented by an arrow [2104] away from the base plate [2102]. The housing wall [2004] has an end [2006] and an interior side [2008]. The example [2000] of the implementation of the lighting system further includes a container [2010] in the housing [2002]. Further in the example [2000] of the implementation of the lighting system, the container [2010] has a visible light-transmissive top plate [2012] and a container wall [2014]. The container wall [2014] of the example [2000] of the implementation of the lighting system projects in a downward direction represented by an arrow [2106] away from the top plate [2012] toward the base plate [2102]. In the example [2000] of the implementation of the lighting system, the container wall [2014] has an end [2108] and an exterior side [2110]. The example [2000] of the implementation of the lighting system additionally includes a gasket [2016] interposed between the base plate [2102] and the end [2108] of the container wall [2014]. In the example [2000] of the implementation of the lighting system, the gasket [2016] is configured for forming a seal represented by an arrow [2112] between the container wall [2014] and the base plate [2102] to seal the container [2010], forming a sealed container as represented by the arrow [2114]. The example [2000] of the implementation of the lighting system also includes a rail [2022] interposed between the interior side [2008] of the housing wall [2004] and the exterior side [2110] of the container wall [2014]. In the example [2000] of the implementation of the lighting system, the rail [2022] has a first side [2024] facing towards the interior side [2008] of the housing wall [2004] and a second side [2026] facing toward the exterior side [2110] of the container wall [2014]. The example [2000] of the implementation of the lighting system may also include a first raised region [2128] located at the end [2006] of and forming a part of the interior side [2008] of the housing wall [2004], and may include a second raised region [2130] located at the end [2108] of and forming a part of the exterior side [2110] of the container wall [2014]. In the examples [2000] of the implementation of the lighting system, the first raised region [2128] may be configured for limiting movement of the rail [2022] away from the base plate [2102] along the upward direction represented by the arrow [2104]; and the second raised region [2130] may be configured for limiting movement of the container wall [2014] away from the base plate [2102] along the upward direction represented by the arrow [2104]. In further examples of the example [2000] of the lighting system, the top plate [2012] may have a perimeter [2032], and the container wall [2014] may project away from the perimeter [2032] of the top plate [2012]. The example [2000] of the implementation of the lighting system further includes a lighting module [2018] in the container [2010]. The lighting module [2018] of the example [2000] of the implementation of the lighting system includes a semiconductor light-emitting device [2020]. In the example [2000] of the implementation of the lighting system, the SLED [2020] is configured for emitting light emissions [2116] in directions represented by the arrows [2118], [2120], [2122], [2124] along a central light emission axis [2126] toward the top plate [2012]. In an additional example of the example [2000] of the lighting system, the rail [2022] may be a visible light-reflective rail [2022]. For example, a visible light-reflective rail [2022] may facilitate redirecting some of the light emissions [2116] along the central light emission axis [2126] toward the top plate [2012]. In another example of the example [2000] of the lighting system, the lighting module [2018] may include another semiconductor light-emitting device 2129. In an example of the example [2000] of the lighting system, the top plate [2012] may include a lens [2131]. As examples, the lens [2131] may be, or may include, a diverging or converging lens. In further examples of the example [2000] of the lighting system, the lens [2131] of the top plate [2112] may be, or may include, a diverging lens screen [2131]; and the diverging lens screen [2131] may be, or may include, (not shown), a lenticular or microprismatic surface. In another example of the example [2000] of the lighting system, the container [2010] may include a lens [2030]. As examples, the lens [2030] may have a lens axis [2132] and may be interposed between the SLED [2020] and the top plate [2012] of the container [2010], and the lens axis [2132] may be aligned with the central light emission axis [2126] of the SLED [2020]. As examples, the lens [2030] may be, or may include, a diverging or converging lens. In a further example of the example [2000] of the lighting system, the lens [2030] may be, or may include, a converging lens [2030] having a frusto-conical shape [2134] and (not shown) a total internal reflection side surface. In a further example, the example [2000] of the lighting system may include a carrier [2136] in the container [2010], the carrier [2136] being configured for positioning the lens [2030] in the container [2010] with the lens axis [2132] as being aligned with the central light emission axis [2126]. As another example, the example [2000] of the lighting system may include a primary visible light reflector [2138] configured for being positioned in the container [2010] between the gasket [2016] and the carrier [2136]. In examples of the example [2000] of the lighting system, the primary visible light reflector [2138] may be configured for redirecting some of the light emissions of the SLED along the central light emission axis [2126]. As an additional example of the example [2000] of the lighting system, the container wall [2014] may include a raised feature [2140] configured for positioning the lens [2030] in the carrier [2136]. As a further example of the example [2000] of the lighting system, the container wall [2014] may include a plurality of raised features [2140], [2142] configured for collectively positioning and securing the lens [2030] in the carrier [2136]. In additional examples, the example [2000] of the lighting system may include an additional lighting module [2144] in the container [2010], the additional lighting module [2144] including an additional SLED [2146]. As an example, the additional SLED [2146] may be configured for emitting additional light emissions [2148] along an additional central light emission axis [2150] toward the top plate [2110].

Figure 22:
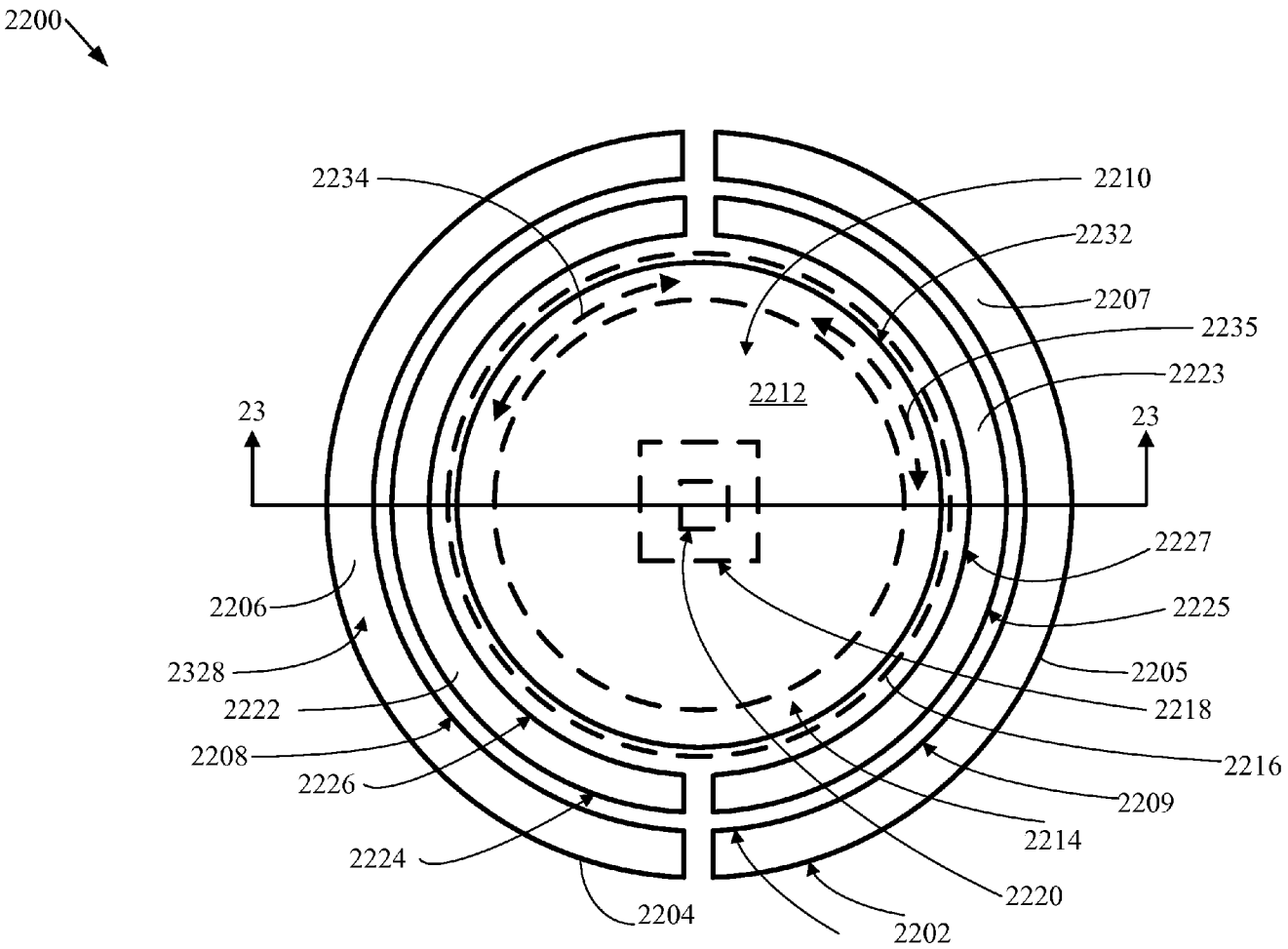
FIG. 22 is a top view showing another example [2200] of an implementation of the lighting system.
Figure 23:
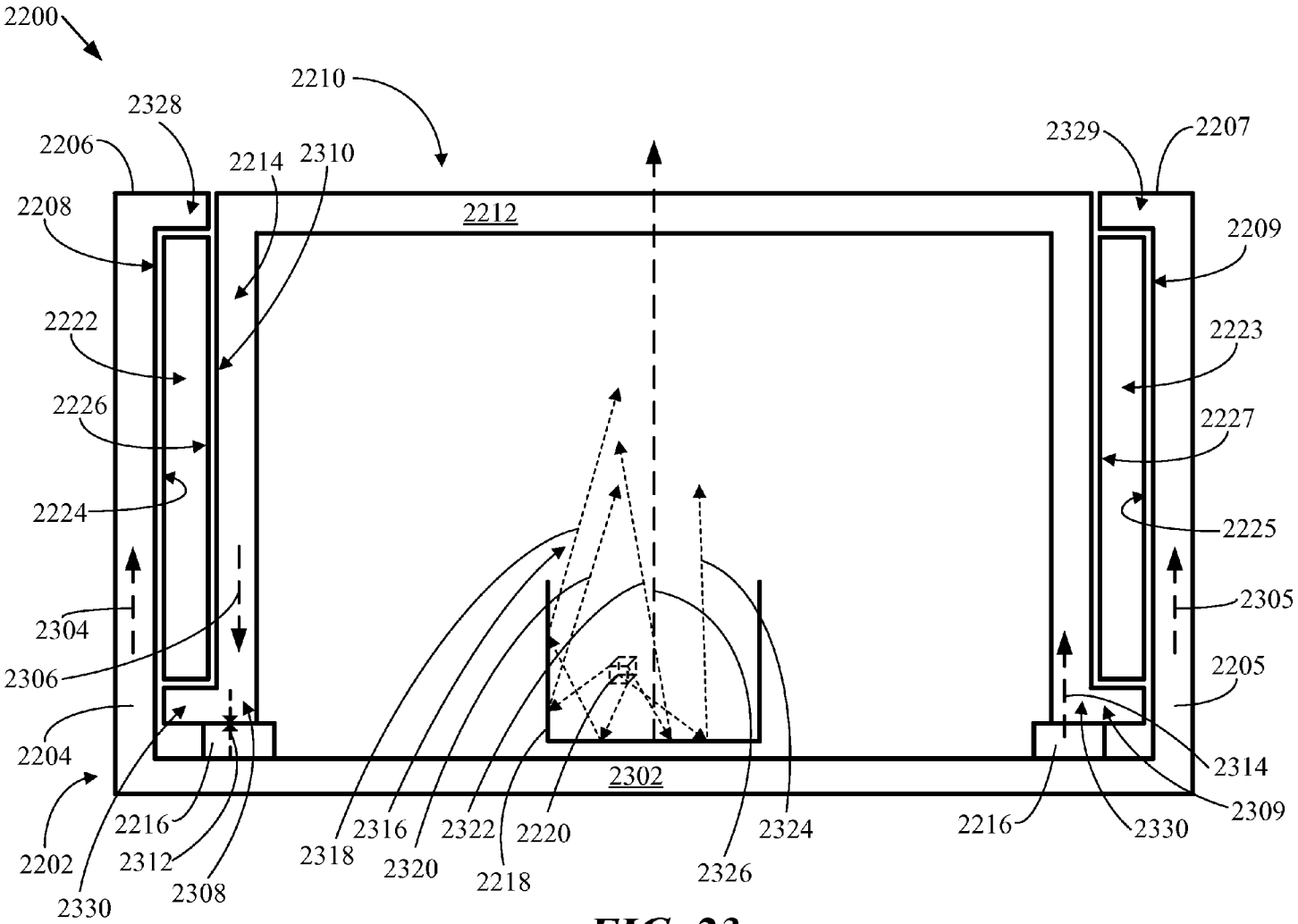
FIG. 23 is a cross-sectional side view taken along the line 23-23, showing the another example [2200] of the lighting system.

FIG. 22 is a top view showing another example [2200] of an implementation of the lighting system. FIG. 23 is a cross-sectional side view taken along the line 23-23, showing the another example [2200] of the lighting system. It is understood throughout this specification that an example [2200] of a lighting system may include any combination of the features that are discussed herein in connection with the examples [100], [300], [500], [700], [900], [1100], [1300], [1500], [1700], [2000], [2200], [2400] of lighting systems. Accordingly, the entireties of the discussions of the other examples [100], [300], [500], [700], [900], [1100], [1300], [1500], [1700], [2000], [2400] of lighting systems are hereby incorporated in this discussion of the examples [2200] of the lighting systems. As shown in FIGS. 22 and 23, the example [2200] of the implementation of the lighting system may include a housing [2202] having a base plate [2302], and may include a housing wall [2204] and another housing wall [2205]. In an example of the example [2200] of the lighting system, the base plate [2302], the housing wall [2204] and the another housing wall [2205] may integrally form the housing [2202]. The housing wall [2204] may project in an upward direction as represented by an arrow [2304] away from the base plate [2302]. The another housing wall [2205] may project in another upward direction as represented by an arrow [2305] away from the base plate [2302]. The housing wall [2204] may have an end [2206] and an interior side [2208]. The another housing wall [2205] may have another end [2207] and another interior side [2209]. The example [2200] of the implementation of the lighting system may further include a container [2210] in the housing [2202]. Further in the example [2200] of the implementation of the lighting system, the container [2210] may have a visible light-transmissive top plate [2212] and a container wall [2214]. The container wall [2214] of the example [2200] of the implementation of the lighting system may project in a downward direction represented by an arrow [2306] away from the top plate [2212] toward the base plate [2302]. In the example [2200] of the implementation of the lighting system, the container wall [2214] may have an end [2308] and an exterior side [2310]. The example [2200] of the implementation of the lighting system may additionally include a gasket [2216] interposed between the base plate [2302] and the end [2308] of the container wall [2214]. In the example [2200] of the implementation of the lighting system, the gasket [2216] may be configured for forming a seal represented by an arrow [2312] between the container wall [2214] and the base plate [2302] to seal the container [2210], forming a sealed container as represented by the arrow [2314]. The example [2200] of the implementation of the lighting system may further include a lighting module [2218] in the container [2210]. The lighting module [2218] of the example [2200] of the implementation of the lighting system may include a semiconductor light-emitting device [2220]. In the example [2200] of the implementation of the lighting system, the SLED [2220] may be configured for emitting light emissions [2316] in directions represented by the arrows [2318], [2320], [2322], [2324] along a central light emission axis [2326] toward the top plate [2212]. The example [2200] of the implementation of the lighting system may also include a rail [2222] interposed between the interior side [2208] of the housing wall [2204] and the exterior side [2310] of the container wall [2214]. The example [2200] of the implementation of the lighting system may further include another rail [2223] interposed between the interior side [2209] of the another housing wall [2205] and the exterior side [2310] of the container wall [2214]. In the example [2200] of the implementation of the lighting system, the rail [2222] may have a first side [2224] facing towards the interior side [2208] of the housing wall [2204] and a second side [2226] facing toward the exterior side [2310] of the container wall [2214]. Further in the example [2200] of the implementation of the lighting system, the another rail [2223] may have a first side [2225] facing towards the interior side [2209] of the another housing wall [2205] and a second side [2227] facing toward the exterior side [2310] of the container wall [2214]. In examples of the example [2200] of the lighting system, each of the rails [2222], [2223] independently may be flexible or rigid. As another example of the example [2200] of the lighting system, the rail [2222] may be arcuately interposed between the interior side [2208] of the housing wall [2204] and the exterior side [2310] of the container wall [2214]; and the another rail [2223] may be arcuately interposed between the interior side [2209] of the another housing wall [2205] and the exterior side [2310] of the container wall [2214]. In an additional example of the example [2200] of the lighting system, each of the rails [2222], [2223] independently may be visible light-reflective rails [2222], [2223]. As examples of the example [2200] of the lighting system, the top plate [2212] may be a visible light-transparent top plate [2212], or may be a visible light-translucent top plate [2212]. The example [2200] of the implementation of the lighting system may also include a first raised region [2328] located at the end [2206] of and forming a part of the interior side [2208] of the housing wall [2204], and may include a second raised region [2330] located at the end [2308] of and forming a part of the exterior side [2310] of the container wall [2214], and may further include a third raised region [2329] located at the end [2207] of and forming a part of the another interior side [2209] of the another housing wall [2205]. In the examples [2200] of the implementation of the lighting system, the first raised region [2328] may be configured for limiting movement of the rail [2222] away from the base plate [2302] along the upward direction represented by the arrow [2304]; and the second raised region [2330] may be configured for limiting movement of the container wall [2214] away from the base plate [2302] along the upward direction represented by the arrow [2304]; and the third raised region [2329] may be configured for limiting movement of the another rail [2223] away from the base plate [2302] along the another upward direction represented by the arrow [2305]. In another example, the example [2200] of the lighting system may include another container wall (not shown); and the another container wall may project in a downward direction away from the top plate [2212] toward the base plate [2302]; and the another container wall may include a fourth raised region (not shown) located at the another end [2309] of and forming a part of an exterior side of another container wall. Further in that example of the example [2200] of the lighting system, the top plate [2212], the container wall [2214] and the another container wall (not shown) may integrally form the container [2210]. In further examples of the example [2200] of the lighting system, the top plate [2212] may have a perimeter [2232], and the container wall [2214] may project away from the perimeter [2232] of the top plate [2212]. In additional examples of the example [2200] of the lighting system, the perimeter [2232] of the top plate [2212] may be a circular or elliptical (not shown) perimeter [2232]. As further examples (not shown) of the example [2200] of the lighting system, the top plate [2212] may have a polygonal perimeter. As additional examples [2200] of the lighting system (not shown), the perimeter [2232] of the top plate [2212] may have a shape, wherein the shape is: a triangle; a cone; a square; a diamond; a rectangle; a trapezoid; a pentagon; a hexagon; a heptagon; or an octagon. Further, for example, the second raised region [2330] may be continuous along a direction represented by an arrow [2234] around a portion [2311] of the perimeter [2232] of the top plate [2212]. Additionally, for example, the third raised region [2329] may be continuous along a direction represented by an arrow [2235] around another portion [2313] of the perimeter [2232] of the top plate [2212]. In examples of the example [2200] of the implementation of the lighting system, the rails [2222], [2223] may respectively be configured for compressing, in the directions of the arrows [2312], [2313], portions of the gasket [2216] between the base plate [2302] and the end [2308] of the container wall [2214]. Further, for example, the example [2200] of the implementation of the lighting system may be configured for compressing the rail [2222] between the first raised region [2328] and the second raised region [2330]. Additionally, for example, the example [2200] of the implementation of the lighting system may be configured for compressing the another rail [2223] between the third raised region [2329] and the second raised region [2330]. In examples of the example [2200] of the implementation of the lighting system, the gasket [2216] may be configured for forming the seal represented by arrows [2312], [2313] between the end [2308] of the container wall [2214] and the base plate [2302] as being water-resistant, forming the container [2210] as being a water-resistant sealed container as represented by the arrow [2314].

Figure 24:
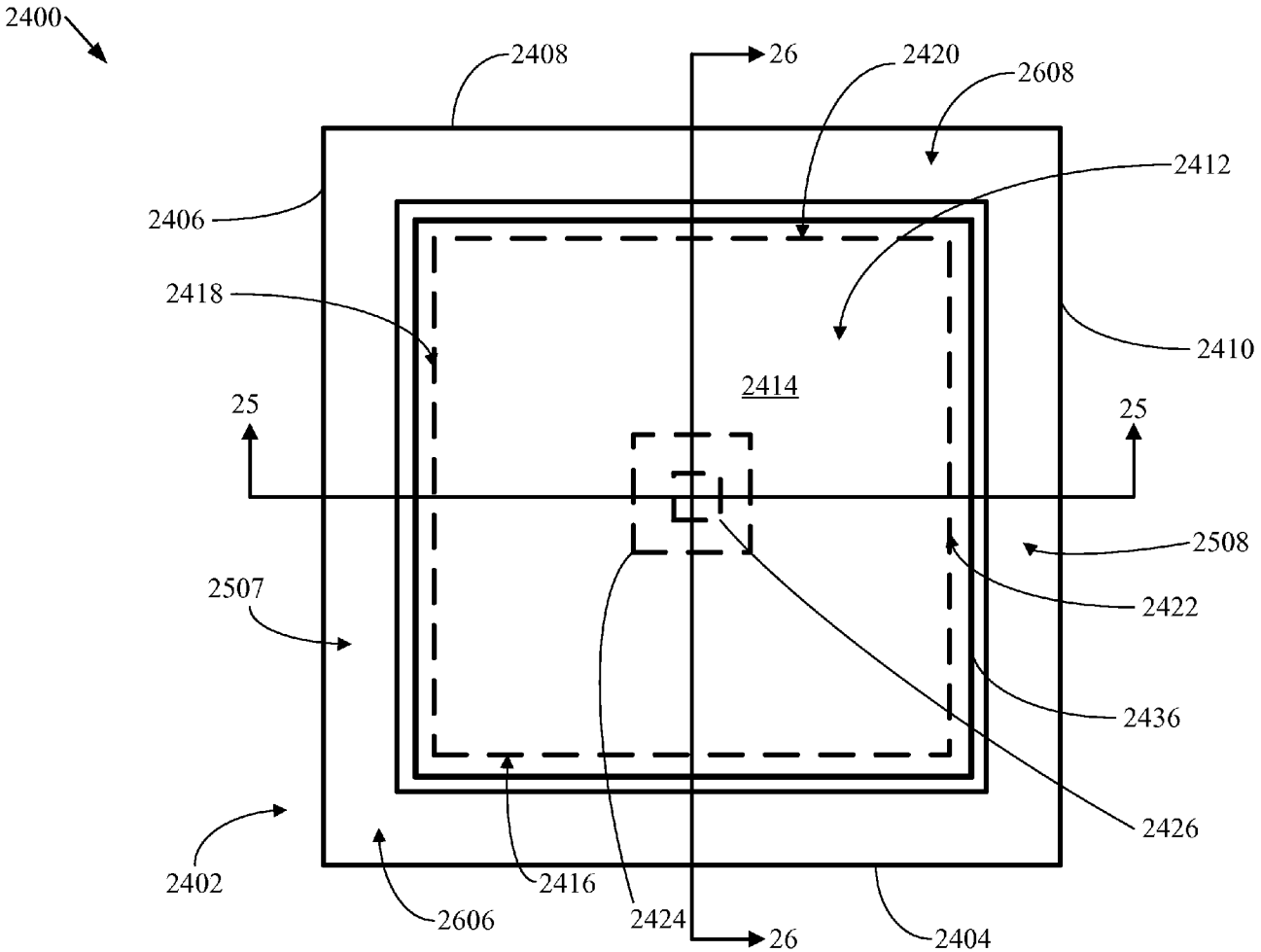
FIG. 24 is a top view showing a further example [2400] of an implementation of the lighting system.
Figure 25:
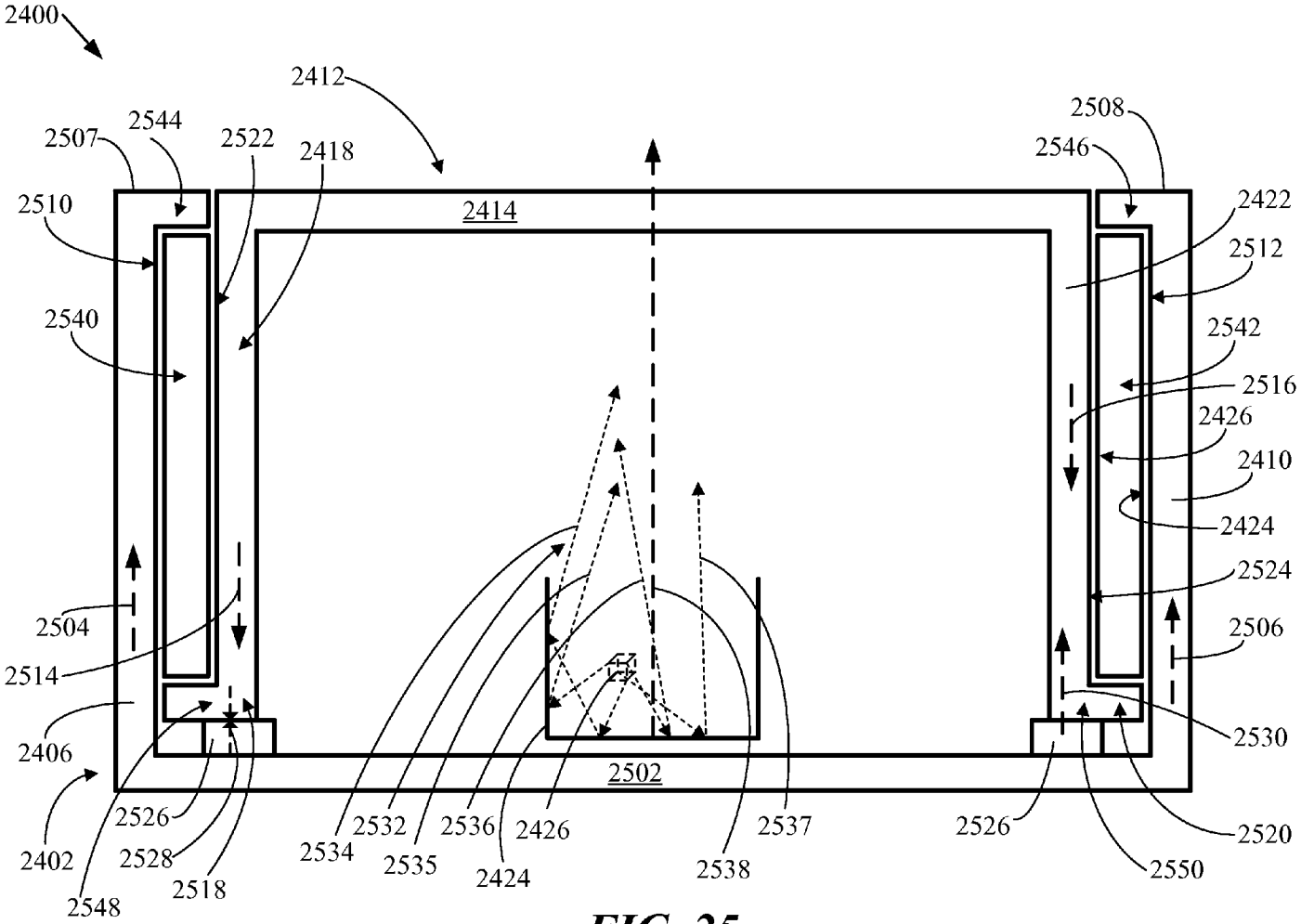
FIG. 25 is a cross-sectional side view taken along the line 25-25, showing the another example [2400] of the lighting system.
Figure 26:
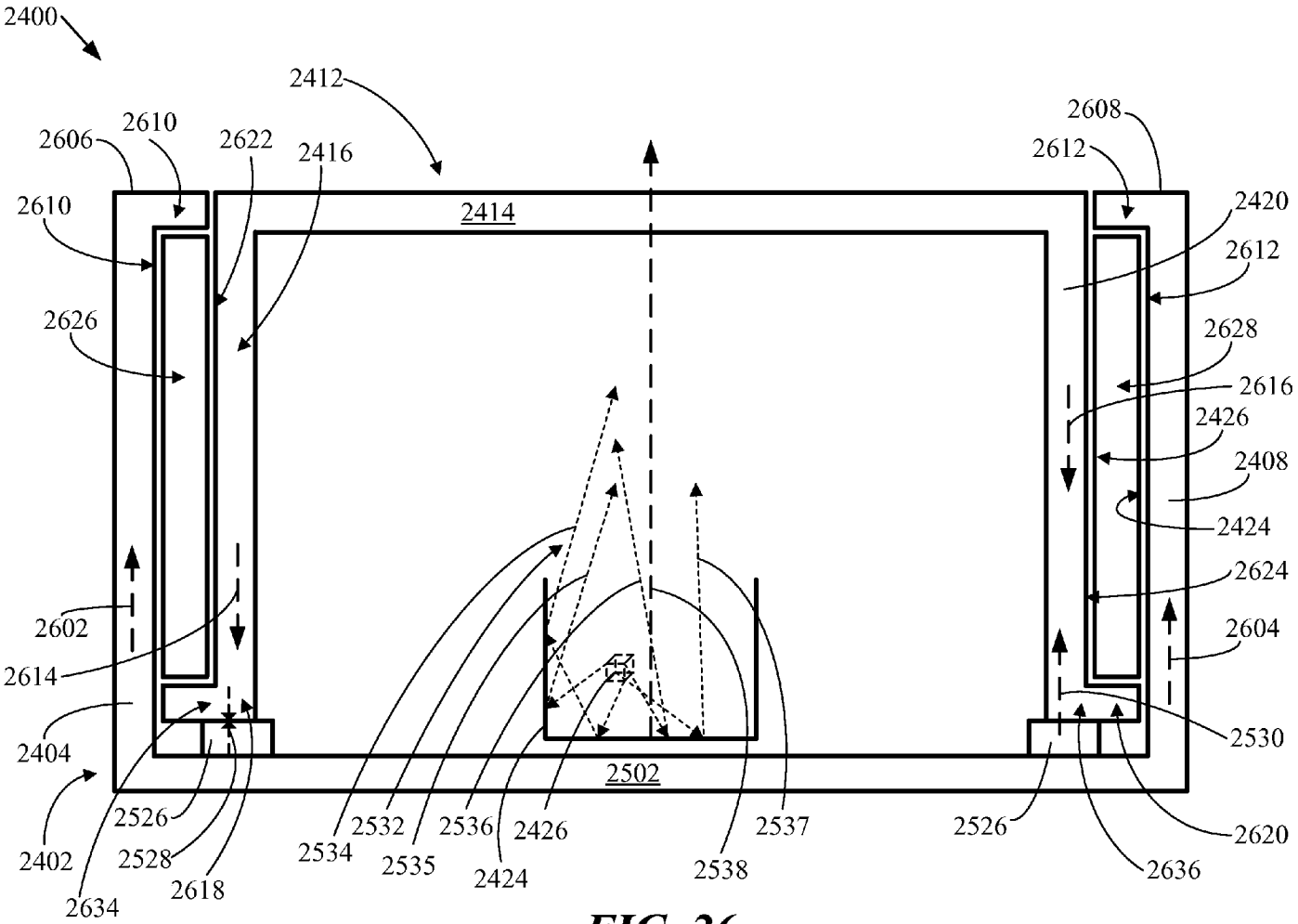
FIG. 26 is a cross-sectional side view taken along the line 26-26, showing the another example [2400] of the lighting system.

FIG. 24 is a top view showing a further example [2400] of an implementation of the lighting system. FIG. 25 is a cross-sectional side view taken along the line 25-25, showing the another example [2400] of the lighting system. FIG. 26 is a cross-sectional side view taken along the line 26-26, showing the another example [2400] of the lighting system. It is understood throughout this specification that an example [2400] of a lighting system may include any combination of the features that are discussed herein in connection with the examples [100], [300], [500], [700], [900], [1100], [1300], [1500], [1700], [2000], [2200] of lighting systems. Accordingly, the entireties of the discussions of the other examples [100], [300], [500], [700], [900], [1100], [1300], [1500], [1700], [2000], [2200], [2400] of lighting systems are hereby incorporated in this discussion of the examples [2400] of the lighting systems. As shown in FIGS. 24, 25 and 26, the example [2400] of the implementation of the lighting system may include a housing [2402] having a base plate [2502]. The example [2400] of the lighting system may also include: a first housing wall [2404]; a second housing wall [2406]; a third housing wall [2408]; and a fourth housing wall [2410]. In an example of the example [2400] of the lighting system, the base plate [2502] and the housing walls [2404], [2406], [2408], [2410] may integrally form the housing [2402]. The housing walls [2404], [2406], [2408], [2410] may project along upward directions as respectively represented by arrows [2602], [2504], [2604], [2506] away from the base plate [2502]. The housing walls [2404], [2406], [2408], [2410] may respectively have ends [2606], [2507], [2608], [2508]. The housing walls [2404], [2406], [2408], [2410] may respectively have interior sides [2610], [2510], [2612], [2512]. The example [2400] of the implementation of the lighting system may further include a container [2412] in the housing [2402]. Further in the example [2400] of the implementation of the lighting system, the container [2412] may have a visible light-transmissive top plate [2414]. The example [2400] of the implementation of the lighting system may further include: a first container wall [2416]; a second container wall [2418]; a third container wall [2420]; and a fourth container wall [2422]. The container walls [2416], [2418], [2420], and [2422] of the example [2400] of the lighting system may project in downward directions respectfully represented by arrows [2614], [2514], [2616], [2516] away from the top plate [2412] toward the base plate [2502]. In the example [2400] of the implementation of the lighting system, the container walls [2416], [2418], [2420], and [2422] may respectively have ends [2618], [2518], [2620], [2520]. Further in the example [2400] of the implementation of the lighting system, the container walls [2416], [2418], [2420], and [2422] may respectively have exterior sides [2622], [2522], [2624], [2524]. The example [2400] of the implementation of the lighting system may additionally include a gasket [2526] interposed between the base plate [2502] and the ends [2618], [2518], [2620], [2520] of the container walls [2416], [2418], [2420], and [2422]. In the example [2400] of the implementation of the lighting system, the gasket [2526] may be configured for forming a seal represented by an arrow [2528] between the container walls [2416], [2418], [2420], [2422] and the base plate [2502] to seal the container [2412], forming a sealed container as represented by the arrow [2530]. The example [2400] of the implementation of the lighting system may further include a lighting module [2424] in the container [2412]. The lighting module [2424] of the example [2400] of the implementation of the lighting system may include a semiconductor light-emitting device [2426]. In the example [2400] of the implementation of the lighting system, the SLED [2426] may be configured for emitting light emissions [2532] in directions represented by the arrows [2534], [2535], [2536], [2537] along a central light emission axis [2538] toward the top plate [2412]. The example [2400] of the implementation of the lighting system may also include a first rail [2626] interposed between the interior side [2610] of the first housing wall [2404] and the exterior side [2622] of the container wall [2416]. The example [2400] of the implementation of the lighting system may further include a second rail [2540] interposed between the interior side [2510] of the second housing wall [2406] and the exterior side [2522] of the container wall [2418]. The example [2400] of the implementation of the lighting system may additionally include a third rail [2628] interposed between the interior side [2612] of the third housing wall [2408] and the exterior side [2624] of the container wall [2420]. The example [2400] of the implementation of the lighting system may further include a fourth rail [2542] interposed between the interior side [2512] of the fourth housing wall [2410] and the exterior side [2524] of the container wall [2422]. In the example [2400] of the implementation of the lighting system, the rails [2626], [2540], [2628], [2542] may each have a first side respectively facing towards the interior sides [2610], [2510], [2612], [2512] of the housing walls [2404], [2406], [2408], [2410]; and may each have a second side respectively facing toward the exterior sides [2622], [2522], [2624], [2524] of the container walls [2416], [2418], [2420], [2422]. The example [2400] of the implementation of the lighting system may also include a first raised region forming a part of the interior side [2610] of the first housing wall [2404] or forming a part of the first side of the rail [2626]; and a second raised region forming a part of the exterior side [2622] of the container wall [2416] or forming a part of the second side of the rail [2626]. The example [2400] of the implementation of the lighting system may further include a first raised region forming a part of the interior side [2510] of the second housing wall [2406] or forming a part of the first side of the rail [2540]; and a second raised region forming a part of the exterior side [2522] of the container wall [2418] or forming a part of the second side of the rail [2540]. The example [2400] of the implementation of the lighting system may additionally include a first raised region forming a part of the interior side [2612] of the third housing wall [2408] or forming a part of the first side of the rail

[2628]; and a second raised region forming a part of the exterior side [2624] of the container wall [2420] or forming a part of the second side of the rail [2628]. The example [2400] of the implementation of the lighting system may also include a first raised region forming a part of the interior side [2512] of the fourth housing wall [2410] or forming a part of the first side of the rail [2542]; and a second raised region forming a part of the exterior side [2524] of the container wall [2422] or forming a part of the second side of the rail [2542]. In an example, the example [2400] of the lighting system may include flanges [2630], [2544], [2632], [2546] as being first raised regions forming parts of the interior sides [2610], [2510], [2612], [2515] of the housing walls [2404], [2406], [2408], [2410]. As another example, the example [2400] of the lighting system may include flanges [2634], [2548], [2636], [2550] as being second raised regions forming parts of the exterior sides [2622], [2522], [2624], [2524] of the container walls [2416], [2418], [2420], [2422]. In further examples [2400] of the lighting system, the first raised regions [2630], [2544], [2632], [2546] may extend along the housing walls [2404], [2406], [2408], [2410]. As additional examples [2400] of the lighting system, the second raised regions [2634], [2548], [2636], [2550] may likewise extend along the container walls [2416], [2418], [2420], [2422]. In examples [2400] of the lighting system, the first raised regions [2630], [2544], [2632], [2546] may be configured for limiting movement of the rails [2626], [2540], [2628], [2542] away from the base plate [2502] along the upward directions represented by the arrows [2602], [2504], [2604], [2506]; and the second raised regions [2634], [2548], [2636], [2550] may be configured for limiting movement of the container walls [2416], [2418], [2420], [2422] away from the base plate [2502] along the upward directions. In other examples (not shown) of the example [2400] of the lighting system, the first raised regions and the second raised regions may be provided as discussed in any of the examples [100], [300], [500], [700], [900], [1100], [1300], [1500]. In examples of the example [2400] of the implementation of the lighting system, the rails [2626], [2540], [2628], [2542] may be configured for compressing portions of the gasket [2526] between the base plate [2502] and the ends [2618], [2518], [2620], [2520] of the container walls [2416], [2418], [2420], [2422]. Further, for example, the example [2400] of the lighting system may be configured for compressing the rails [2626], [2540], [2628], [2542] between the first raised regions [2630], [2544], [2632], [2546] and the second raised regions [2634], [2548], [2636], [2550]. In other examples of the example [2400] of the lighting system, all or a portion of one or more of the housing walls [2404], [2406], [2408], [2410] may be detachable; and the lighting system may be configured for insertion of the container [2412] in the housing [2402] with all or the portion of one or more of the housing walls [2404], [2406], [2408], [2410] as being detached. As an example, the housing wall [2404] may be attached to the housing walls [2406], [2410] and the base plate [2502] by suitable fasteners such as screws, hinges, or clamps. Further in that example, with the housing wall [2404] as being detached, the container [2412] and the rails [2540], [2542] may be inserted as seen in FIG. 25. As further examples of the example [2400] of the lighting system, all or a portion of one or more of the container walls [2416], [2418], [2420], [2422] may be resiliently deformable; and the lighting system may be configured for insertion of the container [2412] in the housing [2402] with all or the portion of one or more of the container walls [2416], [2418], [2420], [2422] as being so deformed. In further examples of the example [2400] of the lighting system, the top plate [2412] may have a perimeter [2436], and the container walls [2416], [2418], [2420], [2422] may project in the downward directions [2614], [2514], [2616], [2516] away from the perimeter [2436] of the top plate [2412]. In additional examples of the example [2400] of the lighting system, the top plate [2412] may have a polygonal perimeter [2436]. As an example, the perimeter [2432] of the top plate [2412] may have a square shape as shown in FIGS. 24-26. In additional examples [2400] of the lighting system (not shown), the perimeter [2432] of the top plate [2412] may have another shape, examples of which include: a triangle; a cone; a diamond; a rectangle; a trapezoid; a pentagon; a hexagon; a heptagon; or an octagon. In examples of the example [2400] of the lighting system, the rails [2626], [2540], [2628], [2542] may be inserted in between the first raised regions [2630], [2544], [2632], [2546] and the second raised regions [2634], [2548], [2636], [2550] by applying downward pressure to the container walls [2416], [2418], [2420], [2422] in the directions represented by the arrows [2614], [2514], [2616], [2516]. With the gasket [2526] being so compressed, the distance between the first and second raised regains may be sufficiently increased to provide clearance for insertion of each of the rails [2626], [2540], [2628], [2542]. As an example, a manual or automated press may be configured for applying the downward pressure. After the rails [2626], [2540], [2628], [2542] have been inserted into the example [2400] of the lighting system, the pressure may be released, and the rails may then be securely held in place by remaining compression of the rails [2626], [2540], [2628], [2542] between the first and second raised regions and by remaining compression of the gasket [2526]. Further, for example, the example [2400] of the lighting system may be so assembled without any need for other fasteners such as screws or bolts.

The examples [100], [300], [500], [700], [900], [1100], [1300], [1500], [1700], [2000], [2200], [2400] of lighting systems may generally be utilized in end-use applications where lighting systems may be exposed to or may need to resist penetration by precipitation, humidity, other ambient fluids containing water, and other chemical fluids. The examples of lighting systems that are disclosed herein may also be fabricated and utilized together with the teachings disclosed in the following two commonly-owned U.S. patent applications, the entireties of both of which are hereby incorporated herein by reference: U.S. patent application Ser. No. 14/636,204 filed on Mar. 3, 2015, entitled "Lighting Systems Including Lens Modules For Selectable Light Distribution"; and U.S. patent application Ser. No. 14/636,205 filed on Mar. 3, 2015, entitled "Low-Profile Lighting System Having Pivotable Lighting Enclosure."

While the present invention has been disclosed in a presently defined context, it will be recognized that the present teachings may be adapted to a variety of contexts consistent with this disclosure and the claims that follow. For example, the lighting systems shown in the figures and discussed above can be adapted in the spirit of the many optional parameters described.

What is claimed is:

1. A lighting system, comprising:

a housing having a base plate and a housing wall, the housing wall projecting in an upward direction away from the base plate, the housing wall having an end and an interior side;

a container in the housing, the container having a visible light-transmissive top plate and a container wall, the container wall projecting in a downward direction away from the top plate toward the base plate, the container wall having an end and an exterior side;

a gasket interposed between the base plate and the end of the container wall, the gasket being configured for forming a seal between the container wall and the base plate to form a sealed container;

a lighting module in the container, the lighting module including a semiconductor light-emitting device ("SLED"), the SLED being configured for emitting light emissions along a central light emission axis toward the top plate;

a rail interposed between the interior side of the housing wall and the exterior side of the container wall, the rail having a first side facing towards the interior side of the housing wall and having a second side facing toward the exterior side of the container wall;

a first raised region forming a part of the interior side of the housing wall or forming a part of the first side of the rail, and a second raised region forming a part of the exterior side of the container wall or forming a part of the second side of the rail;

wherein the first raised region is configured for limiting movement of the rail away from the base plate along the upward direction, and wherein the second raised region is configured for limiting movement of the container wall away from the base plate along the upward direction.

2. The lighting system of claim 1, wherein the first raised region forms a part of the interior side of the housing wall, and wherein the second raised region forms a part of the exterior side of the container wall.

3. The lighting system of claim 2, wherein the first side of the rail includes a first recess configured for receiving the first raised region, and wherein the second side of the rail includes a second recess for receiving the second raised region.

4. The lighting system of claim 3, wherein the second recess is configured for permitting movement of the container wall through a selected distance along the upward and downward directions with the second raised region being received in the second recess.

5. The lighting system of claim 4, wherein the first recess is configured for permitting movement of the rail through a selected distance along the upward and downward directions with the first raised region being received in the first recess.

6. The lighting system of claim 1, wherein the first raised region is located at the end of and forms a part of the interior side of the housing wall, and wherein the second raised region is located at the end of and forms a part of the exterior side of the container wall.

7. The lighting system of claim 1, wherein the first raised region includes a flange located at the end of the housing wall and forming a part of the interior side of the housing wall, and wherein the second raised region includes a flange located at the end of and forming a part of the exterior side of the container wall.

8. The lighting system of claim 7, further including a bar configured for forming the flange at the end of the housing wall.

9. The lighting system of claim 8, wherein the end of the housing wall has a groove, and wherein the bar has a raised region configured for being received by the groove for attaching the bar to the end of the housing wall.

10. The lighting system of claim 8, wherein the bar has a groove, and wherein the end of the housing wall has a raised region configured for being received by the groove for attaching the bar to the end of the housing wall.

11. The lighting system of claim 8, wherein the bar is flexible.

12. The lighting system of claim 1, wherein the first raised region forms a part of the first side of the rail, and wherein the second raised region forms a part of the second side of the rail.

13. The lighting system of claim 12, wherein the interior side of the housing wall includes a recess configured for receiving the first raised region, and wherein the exterior side of the container wall includes a recess for receiving the second raised region.

14. The lighting system of claim 13, wherein the second recess is configured for permitting movement of the container wall through a selected distance along the upward and downward directions with the second raised region being received in the second recess.

15. The lighting system of claim 14, wherein the first recess is configured for permitting movement of the rail through a selected distance along the upward and downward directions with the first raised region being received in the rail.

16. The lighting system of claim 1, wherein the first raised region forms a part of the interior side of the housing wall, and wherein the second raised region forms a part of the second side of the rail.

17. The lighting system of claim 1, wherein the first raised region forms a part of the first side of the rail, and wherein the second raised region forms a part of the exterior side of the container wall.

18. The lighting system of claim 1, further including another raised region forming a part of the interior side of the housing wall or forming a part of the first side of the rail.

19. The lighting system of claim 1, further including an additional raised region forming a part of the exterior side of the container wall or forming a part of the second side of the rail.

20. The lighting system of claim 1, wherein the top plate has a perimeter, and wherein the container wall projects away from the perimeter of the top plate.

21. The lighting system of claim 20, wherein the second raised region is continuous in a direction along the perimeter of the top plate.

22. The lighting system of claim 21, wherein the second raised region includes a raised rib being continuous in the direction along the perimeter of the top plate.

23. The lighting system of claim 20, wherein the first raised region is continuous in a direction along the perimeter of the top plate.

24. The lighting system of claim 23, wherein the first raised region includes a raised rib being continuous in the direction along the perimeter of the top plate.

25. The lighting system of claim 20, including a plurality of the second raised regions being spaced apart in a direction along the perimeter of the top plate.

26. The lighting system of claim 20, including a plurality of the first raised regions being spaced apart in a direction along the perimeter of the top plate.

27. The lighting system of claim 1, including a plurality of raised ridges forming a part of the interior side of the housing wall or forming a part of the first side of the rail, wherein the plurality of the raised ridges are configured for spacing the first side of the rail apart from the interior side of the housing wall.

28. The lighting system of claim 1, including another plurality of raised ridges forming a part of the exterior side of the container wall or forming a part of the second side of the rail, wherein the another plurality of the raised ridges are configured for spacing the second side of the rail apart from the exterior side of the container wall.

29. The lighting system of claim 1, wherein the rail is configured for compressing a portion of the gasket between the base plate and the end of the container wall.

30. The lighting system of claim 29, wherein the lighting system is configured for compressing the rail between the first raised region and the second raised region.

31. The lighting system of claim 29, wherein the gasket is configured for forming a water-resistant sealed container together with the end of the container wall.

32. The lighting system of claim 29, wherein the end of the container wall has a ridge configured for being placed in contact with a surface of the gasket.

33. The lighting system of claim 1, wherein the housing wall has an opening configured for inserting the rail into the housing and for interposing the rail between the interior side of the housing wall and the exterior side of the container wall.

34. The lighting system of claim 33, further including a detachable cover for the opening.

35. The lighting system of claim 33, including another rail being interposed between the interior side of the housing wall and the exterior side of the container wall, the another rail having a first side facing towards the interior side of the housing wall and having a second side facing toward the exterior side of the container wall.

36. The lighting system of claim 35, wherein the housing wall has another opening configured for inserting the another rail into the housing and for interposing the another rail between the interior side of the housing wall and the exterior side of the container wall.

37. The lighting system of claim 1, wherein the rail is flexible.

38. The lighting system of claim 37, wherein the rail is arcuately shaped and is located between the interior side of the housing wall and the exterior side of the container wall.

39. The lighting system of claim 1, wherein the rail is a visible light-reflective rail.

40. The lighting system of claim 1, wherein the top plate is a visible light-transparent top plate.

41. The lighting system of claim 1, wherein the top plate is a visible light-translucent top plate.

42. The lighting system of claim 1, wherein the top plate includes a lens.

43. The lighting system of claim 42, wherein the top plate includes a diverging or converging lens.

44. The lighting system of claim 43, wherein the top plate includes a diverging lens screen.

45. The lighting system of claim 44, wherein the diverging lens screen includes a lenticular or microprismatic surface.

46. The lighting system of claim 1, further including a lens in the container, the lens having a lens axis and being interposed between the SLED and the top plate of the container, wherein the lens axis is aligned with the central light emission axis of the SLED.

47. The lighting system of claim 46, wherein the lens in the container is a diverging or converging lens.

48. The lighting system of claim 47, wherein the lens in the container is a converging lens having a frusto-conical shape and a total internal reflection side surface.

49. The lighting system of claim 46, wherein the top plate includes a lens.

50. The lighting system of claim 49, wherein the top plate includes a diverging or converging lens.

51. The lighting system of claim 50, wherein the top plate includes a diverging lens screen.

52. The lighting system of claim 51, wherein the diverging lens screen includes a lenticular or microprismatic surface.

53. The lighting system of claim 47, further including a carrier in the container, the carrier being configured for positioning the lens in the container with the lens axis as being aligned with the central light emission axis.

54. The lighting system of claim 53, further including a primary visible light reflector configured for being positioned in the container between the gasket and the carrier, wherein the primary visible light reflector is configured for redirecting some of the light emissions of the SLED along the central light emission axis.

55. The lighting system of claim 53, wherein the container wall includes a raised feature configured for positioning the lens in the carrier.

56. The lighting system of claim 1, including an additional lighting module in the container, the additional lighting module including an additional SLED, the additional SLED being configured for emitting additional light emissions along an additional central light emission axis toward the top plate, the additional central light emission axis being spaced apart along a longitudinal axis over the base plate away from the central light emission axis.

57. The lighting system of claim 20, wherein the top plate has a curvilinear perimeter.

58. The lighting system of claim 57, wherein the top plate has a circular or elliptical perimeter.

59. The lighting system of claim 20, wherein the housing includes another housing wall, the another housing wall projecting in another upward direction away from the base plate, the another housing wall having another end and another interior side; and wherein the container has another container wall, the another container wall projecting in another downward direction away from the top plate toward the base plate, the another container wall having another end and another exterior side; and wherein the gasket is interposed between the base plate and the another end of the another container wall.

60. The lighting system of claim 59, wherein a portion of the housing wall is detachable, and wherein the lighting system is configured for insertion of the container in the housing with the portion of the housing wall as being detached.

61. The lighting system of claim 59, wherein a portion of the container wall is configured for being resiliently deformed, and wherein the lighting system is configured for insertion of the container in the housing with the portion of the container wall as being resiliently deformed.

62. The lighting system of claim 59, wherein the top plate, the container wall and the another container wall integrally form the container.

63. The lighting system of claim 59, wherein the base plate, the housing wall and the another housing wall integrally form the housing.

64. The lighting system of claim 59, including another rail interposed between the interior side of the another housing wall and the exterior side of the another container wall, the another rail having a first side facing towards the interior side of the another housing wall and having a second side facing toward the exterior side of the another container wall; and including a third raised region forming a part of the interior side of the another housing wall or forming a part of the first side of the another rail, and a fourth raised region forming a part of the exterior side of the another container wall or forming a part of the second side of the another rail; wherein the third raised region is configured for limiting movement of the another rail away from the base plate along the another upward direction, and wherein the fourth raised region is configured for limiting movement of the another container wall away from the base plate along the another upward direction.

65. The lighting system of claim 64, wherein the another rail is configured for compressing a portion of the gasket between the base plate and the end of the another container wall.

66. The lighting system of claim 64, wherein the lighting system is configured for compressing the another rail between the third raised region and the fourth raised region.

67. The lighting system of claim 64, wherein the gasket is configured for forming a water-resistant sealed container together with the end of the container wall and the end of the another container wall.

68. The lighting system of claim 64, wherein the end of the another container wall has a ridge configured for being placed in contact with the surface of the gasket.

69. The lighting system of claim 64, wherein the another housing wall has another opening configured for inserting the another rail into the housing and for interposing the another rail between the interior side of the another housing wall and the exterior side of the another container wall.

70. The lighting system of claim 69, further including another detachable cover for the another opening.

71. The lighting system of claim 70, wherein the another rail is flexible.

72. The lighting system of claim 71, wherein the another rail is arcuately shaped and is located between the interior side of the another housing wall and the exterior side of the another container wall.

73. The lighting system of claim 64, wherein the top plate has a polygonal perimeter.

74. The lighting system of claim 64, wherein the perimeter of the top plate has a shape, and wherein the shape is: a triangle; a cone; a square; a diamond; a rectangle; a trapezoid; a pentagon; a hexagon; a heptagon; or an octagon.

75. The lighting system of claim 64, wherein the housing includes a third housing wall, the third housing wall projecting in a third upward direction away from the base plate, the third housing wall having a third end and a third interior side; and wherein the container has a third container wall, the third container wall projecting in a third downward direction away from the top plate toward the base plate, the third container wall having a third end and a third exterior side; and wherein the gasket is interposed between the base plate and the third end of the third container wall.

76. The lighting system of claim 75, including a third rail interposed between the interior side of the third housing wall and the exterior side of the third container wall, the third rail having a first side facing towards the interior side of the third housing wall and having a second side facing toward the exterior side of the third container wall; and including a fifth raised region forming a part of the interior side of the third housing wall or forming a part of the first side of the third rail, and a sixth raised region forming a part of the exterior side of the third container wall or forming a part of the second side of the third rail; wherein the fifth raised region is configured for limiting movement of the third rail away from the base plate along the third upward direction, and wherein the sixth raised region is configured for limiting movement of the third container wall away from the base plate along the third upward direction.

77. The lighting system of claim 76, wherein the housing includes a fourth housing wall, the fourth housing wall projecting in a fourth upward direction away from the base plate, the fourth housing wall having a fourth end and a fourth interior side; and wherein the container has a fourth container wall, the fourth container wall projecting in a fourth downward direction away from the top plate toward the base plate, the fourth container wall having a fourth end and a fourth exterior side; and wherein the gasket is interposed between the base plate and the fourth end of the fourth container wall.

78. The lighting system of claim 77, including a fourth rail interposed between the interior side of the fourth housing wall and the exterior side of the fourth container wall, the fourth rail having a first side facing towards the interior side of the fourth housing wall and having a second side facing toward the exterior side of the fourth container wall; and including a seventh raised region forming a part of the interior side of the fourth housing wall or forming a part of the first side of the fourth rail, and an eighth raised region forming a part of the exterior side of the fourth container wall or forming a part of the second side of the fourth rail; wherein the seventh raised region is configured for limiting movement of the fourth rail away from the base plate along the fourth upward direction, and wherein the eighth raised region is configured for limiting movement of the fourth container wall away from the base plate along the fourth upward direction.

* * * * *